US009632441B2

(12) United States Patent
Abe et al.

(10) Patent No.: US 9,632,441 B2
(45) Date of Patent: Apr. 25, 2017

(54) TONER

(71) Applicant: CANON KABUSHIKI KAISHA, Tokyo (JP)

(72) Inventors: Koji Abe, Numazu (JP); Yuhei Terui, Numazu (JP); Taiji Katsura, Suntou-gun (JP); Katsuyuki Nonaka, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/509,257

(22) Filed: Oct. 8, 2014

(65) Prior Publication Data

US 2015/0099224 A1 Apr. 9, 2015

(30) Foreign Application Priority Data

Oct. 9, 2013 (JP) ..... 2013-212262
Jun. 20, 2014 (JP) ..... 2014-127242

(51) Int. Cl.

| | |
|---|---|
| ***G03G 9/00*** | (2006.01) |
| ***G03G 9/093*** | (2006.01) |
| ***G03G 9/08*** | (2006.01) |
| ***G03G 9/087*** | (2006.01) |

(52) U.S. Cl.
CPC ..... *G03G 9/09328* (2013.01); *G03G 9/0825* (2013.01); *G03G 9/08773* (2013.01)

(58) Field of Classification Search
CPC ..... G03G 9/09328; G03G 9/0825; G03G 9/08773
USPC ..... 430/110.2, 137.15
See application file for complete search history.

(56) References Cited

U.S. PATENT DOCUMENTS

| | | | | |
|---|---|---|---|---|
| 5,153,089 | A | 10/1992 | Ong et al. | |
| 6,358,658 | B1 | 3/2002 | Tazawa et al. | |
| 6,627,709 | B2 | 9/2003 | Endo | |
| 8,980,517 | B2 * | 3/2015 | Kawaguchi | G03G 9/09775 430/110.1 |
| 2010/0159375 | A1 | 6/2010 | Zhou et al. | |

FOREIGN PATENT DOCUMENTS

| | | | |
|---|---|---|---|
| EP | 1 003 080 | A1 | 5/2000 |
| JP | 3-89361 | A | 4/1991 |
| JP | H08-095284 | | 4/1996 |
| JP | 9-179341 | A | 7/1997 |

(Continued)

OTHER PUBLICATIONS

European Search Report dated Mar. 2, 2015 in European Application No. 14003458.8.

(Continued)

*Primary Examiner* — Thorl Chea
(74) *Attorney, Agent, or Firm* — Fitzpatrick Cella Harper and Scinto

(57) ABSTRACT

The present invention is a toner that has toner particles that have a surface layer that contains an organosilicon polymer, wherein this organosilicon polymer has a specific substructure and the ratio [ST3], in a $^{29}$Si-NMR measurement of a tetrahydrofuran-insoluble matter of the toner particles, of the peak area for this substructure to the total peak area for the organosilicon polymer satisfies the relationship ST3≥0.40.

10 Claims, 4 Drawing Sheets

(56) References Cited

FOREIGN PATENT DOCUMENTS

| | | | |
|---|---|---|---|
| JP | 2000-297106 | | 10/2000 |
| JP | 2001-75304 | A | 3/2001 |
| JP | 2001-330996 | | 11/2001 |
| JP | 2006-146056 | A | 6/2006 |
| JP | 2007-279712 | | 10/2007 |

OTHER PUBLICATIONS

U.S. Appl. No. 14/465,722 dated Aug. 21, 2014. Inventor: Naotaka Ikeda, et al.
U.S. Appl. No. 14/509,239 dated Oct. 8, 2014. Inventor: Koji Abe, et al.

* cited by examiner

TONER

BACKGROUND OF THE INVENTION

1. Field of the Invention

The present invention relates to a toner for the development of electrostatic images (electrostatic latent images) that are used in image-forming methods such as electrophotography and electrostatic printing.

2. Description of the Related Art

The ubiquity of computers and the growth of multimedia have in recent years created demand for means that can output high-definition full-color images in a wide range of fields from the office to the home.

Use in an office where extensive copying or printing is performed requires a high durability whereby even high count copying or printing does not cause a decline in image quality. Use in the home or a small office, on the other hand, requires the production of high quality images as well as downsizing of the image-forming apparatus in order to economize on space and energy and lower the weight. Additional improvements in toner properties, i.e., environmental stability, member contamination, low-temperature fixability, development durability, and storage stability, have become necessary in order to respond to these requirements.

In the particular case of full-color images, the image is formed by overlaying color toners; however, if the color toners for the individual colors do not undergo similar development, the color reproducibility declines and color unevenness is produced. An influence on the development performance may appear and color unevenness may be produced when the dye or pigment used as the colorant for the toner is precipitated or deposited on the surface of the toner particle.

A fixing performance and color mixability at the time of fixing are crucial for the formation of full-color images. For example, in order to achieve the higher speeds that are in demand, binder resins are selected that are adapted for low-temperature fixability, but these binder resins also exercise a substantial influence on the developing performance and durability of color toners.

Another demand is for means capable of extended use and high-definition full-color image output in a variety of environments that present different temperatures and humidities. Responding to this demand requires a solution for the problem of the changes in the amount of toner charging and changes in the properties of the toner surface that are produced by differences in the temperature and humidity of the use environment. Another problem that must be solved is contamination of such members as the developing roller, charging roller, regulating blade, and photosensitive drum. The development is thus required of a toner that, even during long-term storage in different environments, has a stable charging performance and a stable development durability that is free of the appearance of member contamination.

As one cause of the fluctuations in toner storage stability and amount of charging that are due to temperature and humidity, a phenomenon is produced in which the release agent and/or resin component of the toner migrate out from the interior of the toner particle to its surface (also referred to as "bleed" herebelow), thus causing the properties of the toner surface to change.

Coating the surface of the toner particle with a resin is one means for solving this problem.

A toner having inorganic fine particles firmly fixed to the surface is disclosed in Japanese Patent Application Laid-open No. 2006-146056 as a toner that exhibits an excellent high-temperature storability and an excellent printing durability during image output in a normal-temperature, normal-humidity environment or a high-temperature, high-humidity environment.

However, even though inorganic fine particles are firmly fixed to the toner particles, bleeding by the release agent and/or resin component occurs from gaps between the inorganic fine particles and the inorganic fine particles are liberated due to a deterioration in the durability, and additional improvements with regard to member contamination and the durability in severe environments are thus required.

A method of producing a polymerized toner is disclosed in Japanese Patent Application Laid-open No. H03-089361, this method being characterized by the addition of a silane coupling agent to the reaction system in order to obtain a toner for which the amount of charging has a narrow distribution, the amount of charging exhibits little dependence on the humidity, and colorant and polar substances are not exposed at the toner particle surface.

With this method, however, the amount of deposition of the silane compound at the toner particle surface and/or the hydrolysis and condensation polymerization of the silane compound are inadequate and additional improvements are required with regard to the environmental stability and the development durability.

A method is disclosed in Japanese Patent Application Laid-open No. H09-179341 for controlling the amount of toner charge and forming a high-quality output image independently of the temperature and humidity environment: the disclosed method uses a polymerized toner that contains a silicon compound executed in the form of a continuous thin film at the surface region.

However, the organofunctional groups have a high polarity and the deposition of the silane compound at the toner particle surface and/or the hydrolysis and condensation polymerization of the silane compound are inadequate and the degree of crosslinking is low. Additional improvements are thus required with regard to the image density variations induced by changes in the charging performance at high temperatures and high humidities and by member contamination caused by a deterioration in the durability.

As a toner that improves the flowability, fluidizing agent liberation, low-temperature fixability, and blocking, Japanese Patent Application Laid-open No. 2001-75304 discloses a polymerized toner that has a coat layer formed by attachment among silicon compound-containing particulate masses.

Additional improvements are required, however, with respect to the occurrence of bleeding in which the release agent and/or resin component migrate out from gaps in the silicon compound-containing particulate masses; variations in image density due to changes in the charging performance at high temperatures and high humidities produced by an inadequate amount of deposition of the silane compound at the toner particle surface and inadequate hydrolysis and condensation polymerization of the silane compound; the generation of member contamination due to melt adhesion of the toner; and the storage stability.

SUMMARY OF THE INVENTION

An object of the present invention is to provide a toner that exhibits an excellent development durability, storage stability, environmental stability, resistance to member contamination, and low-temperature fixability.

The present invention relates to a toner having toner particles that have a surface layer that contains an organosilicon polymer, wherein the organosilicon polymer has a substructure represented by formula (T3) below and the ratio [ST3], in a $^{29}$Si-NMR measurement of a tetrahydrofuran (THF)-insoluble matter of the toner particles, of the peak area for the substructure represented by formula (T3) to the total peak area for the organosilicon polymer satisfies the relationship ST3≥0.40

[C1]

$$R—Si(O_{1/2})_3 \quad (T3)$$

(in formula (T3), R represents an alkyl group having from at least 1 to not more than 6 carbons or a phenyl group).

The present invention can provide a toner that exhibits an excellent development durability, storage stability, environmental stability, resistance to member contamination, and low-temperature fixability.

Further features of the present invention will become apparent from the following description of exemplary embodiments (with reference to the attached drawings).

DESCRIPTION OF THE EMBODIMENTS

Figure 1:
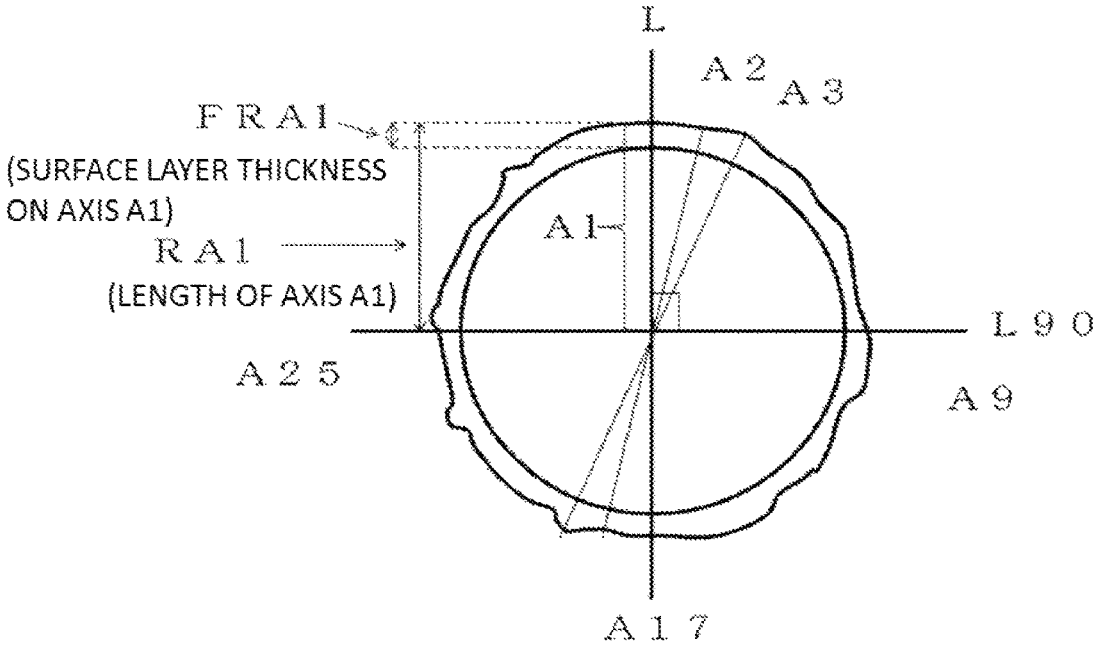
FIG. 1 is a descriptive diagram of the toner particle cross section provided by TEM observation.

The present invention is described in detail herebelow, but this should not be construed as a limitation to this description.

The toner of the present invention is a toner that has toner particles that have a surface layer that contains an organosilicon polymer, wherein this organosilicon polymer has a substructure represented by formula (T3) below and the ratio [ST3], in a $^{29}$Si-NMR measurement of a tetrahydrofuran (THF)-insoluble matter of the toner particles, of the peak area for the substructure represented by formula (T3) to the total peak area for the organosilicon polymer satisfies the relationship ST3≥0.40

[C2]

$$R—Si(O_{1/2})_3 \quad (T3)$$

(in formula (T3), R represents an alkyl group having from at least 1 to not more than 6 carbons or a phenyl group).

The toner in the present invention has toner particles that have a surface layer that contains an organosilicon polymer, and this organosilicon polymer, because it has the substructure represented by formula (T3), can improve the hydrophobicity through the presence of the organic structure, thus making it possible to obtain a highly environmentally stable toner.

By having the relationship ST3≥0.40—where [ST3] is the ratio of the peak area of the substructure represented by formula (T3) (also referred to hereafter as the T3 structure) to the total peak area for the organosilicon polymer in a $^{29}$Si-NMR measurement of the THF-insoluble matter of the toner particles—be satisfied, the surface free energy of the toner particle surface can be lowered and as a consequence the effects accrue of an excellent environmental stability and an excellent resistance to member contamination.

The durability due to the T3 structure in the organosilicon polymer and the charging performance and hydrophobicity of the R in formula (T3) bring about an inhibition of bleed out by outmigration-prone low molecular weight (Mw not more than 1,000) resins, low-Tg (not more than 40° C.) resins, and, depending on the circumstances, release agent, which are present to the interior from the surface layer. As a result, a toner can be obtained that has an improved toner stirring behavior, an excellent storage stability, and an excellent development durability and environmental stability during high print percentage image output durability testing at print percentages of 30% and more.

With regard to ST3, the relationship 1.00≥ST3≥0.40 is preferably satisfied and the relationship 0.80≥ST3≥0.50 is more preferably satisfied. Viewed in terms of the charging performance and durability, ST3 is preferably not more than 1.00, more preferably not more than 0.90, and even more preferably not more than 0.80.

ST3 can be controlled through the type and amount of the organosilicon compound or compounds used to form the organosilicon polymer and through the reaction temperature, reaction time, reaction solvent, and pH for the hydrolysis, addition polymerization, and condensation polymerization during formation of the organosilicon polymer.

The relationship ST3/SX2≥1.00 is preferably satisfied in the present invention by this ST3 and the ratio [SX2] of the peak area for the structure in which the number of silicon-bonded $O_{1/2}$ is 2.0 (also referred to hereafter as the X2 structure) to the total peak area for the organosilicon polymer in a $^{29}$Si-NMR measurement of the tetrahydrofuran (THF)-insoluble matter of the toner particles.

Having ST3 be equal to or greater than SX2 provides an excellent balance between the charging performance and the durability due to the crosslinking structure of the siloxane structure. As a consequence, the environmental stability, storage stability, and development durability are even better and an excellent fogging and image density stability are also obtained in a variety of environments. The relationship ST3/SX2≥1.50 is more preferably satisfied and the relationship ST3/SX2≥2.0 is even more preferably satisfied.

The value of ST3/SX2 can be controlled through the type and amount of the organosilicon compound or compounds used to form the organosilicon polymer and through the reaction temperature, reaction time, reaction solvent, and pH for the hydrolysis, addition polymerization, and condensation polymerization during formation of the organosilicon polymer.

R in the substructure represented by formula (T3) is an alkyl group having from at least 1 to not more than 6 carbons or is the phenyl group. The variation in the amount of charging in different environments tends to be large when R has a high hydrophobicity. An alkyl group having from at least 1 to not more than 5 carbons, which provides a particularly good environmental stability, is preferred.

In an even more preferred embodiment of the present invention, R is an alkyl group having from at least 1 to not more than 3 carbons: this provides additional improvements in the charging performance and fogging prevention. When an excellent charging performance is obtained, the transferability is excellent and there is little untransferred toner, and as a consequence contamination of the drum, charging member, and transfer member is improved.

Preferred examples of hydrocarbon groups having from at least 1 to not more than 3 carbons are the methyl group, ethyl group, and propyl group. R is more preferably the methyl group from the standpoint of the environmental stability and storage stability.

The method known as the sol-gel method is a typical example for the production of the organosilicon polymer that is used in the present invention.

The sol-gel method is a gelation method in which a metal alkoxide M(OR)n (M: metal, O: oxygen, R: hydrocarbon, n: oxidation number of the metal) is used as a starting material and is hydrolyzed and condensation polymerized in a solvent with passage through a sol state. The sol-gel method is used in methods for the synthesis of glasses, ceramics, organic-inorganic hybrids, and nanocomposites. The use of this production method makes possible the production, at low temperatures and from the liquid phase, of functional materials in a variety of shapes, e.g., surface layers, fibers, bulk articles, fine particles, and so forth.

In specific terms, the organosilicon polymer present at the surface layer of the toner particles is preferably produced by the hydrolysis and condensation polymerization of a silicon compound that is typically an alkoxysilane.

Through the uniform disposition on the toner particle of a surface layer that contains this organosilicon polymer, a toner can be obtained—even without the fixing or attachment of inorganic fine particles as is done with conventional toners—that exhibits an improved environmental stability, is resistant to a reduction in toner performance during extended use, and exhibits an excellent storage stability.

Moreover, the sol-gel method, because it starts from a solution and forms a material by gelation of this solution, can produce a variety of microstructures and shapes. In particular, when the toner particles are produced in an aqueous medium, precipitation on the toner particle surface is readily effected due to the hydrophilicity provided by hydrophilic groups, such as the silanol group, in the organosilicon compound.

However, when the organosilicon compound has a high hydrophobicity (for example, when the hydrocarbon group in the organosilicon compound is a hydrocarbon group that has more than 6 carbons), this tends to facilitate the formation, on the surface of the toner particles, of aggregates that are not more than one-tenth of the weight-average particle diameter (μm) of the toner particles. When, on the other hand, the number of carbons in the hydrocarbon group in the organosilicon compound is 0, the charging stability of the toner deteriorates due to the weak hydrophobicity. The microstructure and shape here can be adjusted through, for example, the reaction temperature, reaction time, reaction solvent, and pH and through the type and amount of the organometal compound.

The toner particles in the present invention have a surface layer that contains an organosilicon polymer that has the substructure represented by formula (T3).

This organosilicon polymer is preferably an organosilicon polymer obtained by the polymerization of an organosilicon compound having the structure represented by the following formula (Z)

[C3]

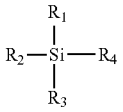

(Z)

(in formula (Z), $R_1$ represents an alkyl group having from at least 1 to not more than 6 carbons or the phenyl group, and $R_2$, $R_3$, and $R_4$ each independently represent a halogen atom, hydroxy group, acetoxy group, or alkoxy group).

The hydrophobicity can be raised by the alkyl group or phenyl group represented by $R_1$ and toner particles having an excellent environmental stability can then be obtained. $R_1$ is preferably an alkyl group having from at least 1 to not more than 6 carbons or the phenyl group. The variation in the amount of charging among different environments tends to be large when $R_1$ has a high hydrophobicity, and thus, considering the environmental stability, $R_1$ is more preferably an alkyl group having from at least 1 to not more than 3 carbons.

The methyl group, ethyl group, and propyl group are preferred examples of alkyl groups that have from at least 1 to not more than 3 carbons. The phenyl group is also a preferred example for $R_1$. An excellent charging performance and an excellent fogging prevention are obtained in this case. $R_1$ is more preferably the methyl group from the standpoint of the environmental stability and storage stability.

$R_2$, $R_3$, and $R_4$ are each independently a halogen atom, hydroxy group, acetoxy group, or alkoxy group (also referred to herebelow as the reactive group). These reactive groups form a crosslinked structure by hydrolysis, addition polymerization, and condensation polymerization, and a toner having an excellent resistance to member contamination and an excellent development durability can then be obtained. The alkoxy group is preferred from the standpoint of its gentle hydrolyzability at room temperature and the ability to deposit at and coat the toner particle surface, and the methoxy group and ethoxy group are more preferred. The hydrolysis, addition polymerization, and condensation polymerization of $R_2$, $R_3$, and $R_4$ can be controlled through the reaction temperature, reaction time, reaction solvent, and pH.

A single organosilicon compound (also referred to herebelow as the trifunctional silane) having three reactive groups ($R_2$, $R_3$, and $R_4$) in one molecule excluding $R_1$ in the formula (Z) given above, or a combination of a plurality thereof, may be used to obtain the organosilicon polymer used by the present invention.

The content of the organosilicon polymer in the present invention is preferably from at least 0.50 mass % to not more than 50.00 mass % in the toner particle and is more preferably from at least 0.75 mass % to not more than 40.00 mass % in the toner particle.

Formula (Z) can be exemplified by the following:

trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane;

trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane.

The T unit structure represented by formula (T3) in the organosilicon polymer used by the present invention is preferably at least 50 mole % of the organosilicon polymer and more preferably is at least 60 mole % of the organosilicon polymer. The environmental stability of the toner can be improved still further by having the content of the T unit structure represented by formula (T3) be at least 50 mole %.

To the extent that the effects of the present invention are not impaired, the present invention may use an organosilicon polymer obtained using the organosilicon compound having the T unit structure represented by formula (T3) in combination with an organosilicon compound having 4 reactive groups in the single molecule (tetrafunctional silane), an organosilicon compound having two reactive groups in the single molecule (difunctional silane), or an organosilicon compound having one reactive group (monofunctional silane). The co-usable organosilicon compounds can be exemplified by the following:

dimethyldiethoxysilane, tetraethoxysilane, hexamethyldisilazane, 3-glycidoxypropyltrimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltrimethoxysilane, 3-glycidoxypropylmethyldimethoxysilane, 3-glycidoxypropylmethyldiethoxysilane, hexamethyldisilane, tetraisocyanatosilane, and methyltriisocyanatosilane, and trifunctional vinylsilanes such as vinyltriisocyanatosilane, vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane;

trifunctional allylsilanes such as allyltrimethoxysilane, allyltriethoxysilane, allyltrichlorosilane, allyltriacetoxysilane, and allyltrihydroxysilane; and t-butyldimethylchlorosilane, t-butyldimethylmethoxysilane, t-butyldimethylethoxysilane, t-butyldiphenylchlorosilane, t-butyldiphenylmethoxysilane, t-butyldiphenylethoxysilane, chloro(decyl)dimethylsilane, methoxy(decyl)dimethylsilane, ethoxy(decyl)dimethylsilane, chlorodimethylphenylsilane, methoxydimethylphenylsilane, ethoxydimethylphenylsilane, chlorotrimethylsilane, methoxytrimethylsilane, ethoxytrimethylsilane, triphenylchlorosilane, triphenylmethoxysilane, triphenylethoxysilane, chloromethyl(dichloro)methylsilane, chloromethyl(dimethoxy)methylsilane, chloromethyl(diethoxy)methylsilane, di-tert-butyldichlorosilane, di-tert-butyldimethoxysilane, di-tert-butyldiethoxysilane, dibutyldichlorosilane, dibutyldimethoxysilane, dibutyldiethoxysilane, dichlorodecylmethylsilane, dimethoxydecylmethylsilane, diethoxydecylmethylsilane, dichlorodimethylsilane, dimethoxydimethylsilane, diethoxydimethylsilane, dichloro(methyl)-n-octylsilane, dimethoxy(methyl)-n-octylsilane, and diethoxy(methyl)-n-octylsilane.

It is known that the bonding status of the siloxane bonds that are produced generally varies in the sol-gel reaction as a function of the acidity of the reaction medium. Specifically, when the reaction medium is acidic, the hydrogen ion electrophilically adds to the oxygen in one reactive group (for example, the alkoxy group (—OR group)). The oxygen atom in a water molecule then coordinates to the silicon atom and conversion into the hydrosilyl group occurs by a substitution reaction. Assuming enough water is present, since one oxygen atom of the reaction group (for example, the alkoxy group (—OR group)) is attacked by one $H^+$, the substitution reaction to give the hydroxyl group will be slow when the $H^+$ content in the reaction medium is low. The condensation polymerization reaction therefore occurs before all of the reactive groups bonded in the silicon atom have hydrolyzed and a one-dimensional chain polymer or a two-dimensional polymer is then produced relatively easily.

When, on the other hand, the reaction medium is alkaline, the hydroxide ion adds to the silicon with passage through a pentacoordinate intermediate. Due to this, all of the reactive groups (for example, the alkoxy group (—OR group)) are readily eliminated and readily replaced by the silanol group. Particularly when a silicon compound is used that has three or more reactive groups in the same silicon atom, hydrolysis and condensation polymerization proceed three dimensionally and an organosilicon polymer is formed that has abundant three dimensional crosslinking structures. In addition, the reaction is also complete in a short period of time.

Accordingly, the sol-gel reaction for forming the organosilicon polymer is preferably carried out with the reaction medium in an alkaline state, and in specific terms the pH is preferably at least 8.0 when production is carried out in an aqueous medium. A stronger organosilicon polymer with an excellent durability can be formed by doing this. In addition, the sol-gel reaction is preferably run at a reaction temperature of at least 90° C. for a reaction time of at least 5 hours.

Carrying out this sol-gel reaction for the indicated reaction temperature and indicated time can inhibit the formation of coalesced particles as provided by bonding among the sol- or gel-state silane compound at toner particle surfaces.

The organosilicon compound described in the preceding may be used in combination with an organotitanium compound or an organoaluminum compound to the extent that the effects of the present invention are not impaired.

The organotitanium compound can be exemplified by the following:

titanium methoxide, titanium ethoxide, titanium n-propoxide, tetra-1-propoxytitanium, tetra-n-butoxytitanium, titanium isobutoxide, titanium butoxide dimer, titanium tetra-2-ethylhexoxide, titanium diisopropoxybis(acetylacetonate), titanium tetraacetylacetonate, titanium di-2-ethylhexoxybis(2-ethyl-3-hydroxyhexoxide), titanium diisopropoxybis(ethyl acetoacetate), tetrakis(2-ethylhexyloxy)titanium, di-i-propoxybis(acetylacetonato)titanium, titanium lactate, titanium methacrylate isopropoxide, triisopropoxytitanate, titanium methoxypropoxide, and titanium stearyl oxide.

The organoaluminum compound can be exemplified by the following:

aluminum(III) n-butoxide, aluminum(III) s-butoxide, aluminum(III) s-butoxide bis(ethyl acetoacetate), aluminum (III) t-butoxide, aluminum(III) di-s-butoxide ethyl acetoacetate, aluminum(III) diisopropoxide ethyl acetoacetate, aluminum(III) ethoxide, aluminum(III) ethoxyethoxyethoxide, aluminum hexafluoropentadionate, aluminum(III) 3-hydroxy-2-methyl-4-pyronate, aluminum(III) isopropoxide, aluminum 9-octadecenylacetoacetate diisopropoxide, aluminum(III) 2,4-pentanedionate, aluminum phenoxide, and aluminum(III) 2,2,6,6-tetramethyl-3,5-heptanedionate.

These compounds may be used individually or a plurality may be used. The amount of charging can be adjusted through the use of suitable combinations of these compounds and by changing the amount of their addition.

For the toner of the present invention, the silicon atom concentration dSi with reference to the sum of the silicon atom concentration dSi, the oxygen atom concentration dO, and the carbon atom concentration dC, i.e., dSi/[dSi+dO+dC], in the surface layer of the toner particles, as measured using electron spectroscopy for chemical analysis (ESCA) on the surface layer (outer layer, surfacemost layer) of the toner particle, is preferably at least 2.5 atom %, more preferably at least 5.0 atom %, and even more preferably at least 10.0 atom %.

ESCA performs elemental analysis of the surface layer that is present to a depth of several nanometers from the toner particle surface towards the center of the toner particle (center point of the long axis). A low surface free energy can be produced for the surface layer by having the silicon atom concentration (dSi/[dSi+dO+dC]) for the toner particle surface layer be at least 2.5 atom %. The flowability can be further improved and the occurrence of member contamination and fogging can be further inhibited by adjusting this silicon atom concentration to at least 2.5 atom %.

The silicon atom concentration (dSi/[dSi+dO+dC]) for the toner particle surface layer, on the other hand, is preferably not more than 33.3 atom % considering the charging performance. Not more than 28.6 atom % is more preferred.

The silicon atom concentration in the toner particle surface layer can be controlled through the structure of the R in formula (T3) and through the method of producing the toner particles, the reaction temperature, the reaction time, the reaction solvent, and the pH when the organosilicon polymer is formed. It can also be controlled through the content of the organosilicon polymer. In the present invention, the surface layer of the toner particle denotes the layer present to a depth of from at least 0.0 nm to not more than 10.0 nm in the direction of the center of the toner particle (the center of the long axis) from the surface of the toner particle.

For the toner of the present invention, the ratio [dSi/dC] of the silicon atom concentration dSi (atom %) to the carbon atom concentration dC (atom %), as measured using electron spectroscopy for chemical analysis (ESCA) on the surface layer of the toner particle, is preferably from at least 0.15 to not more than 5.00. A low surface free energy can be produced by having [dSi/dC] be in the indicated range, which has effects on the storage stability and the resistance to member contamination. In order to further enhance the storage stability and resistance to member contamination, [dSi/dC] is more preferably from at least 0.20 to not more than 4.00 and is even more preferably at least 0.30.

When the ratio [dSi/dC] of the silicon atom concentration dSi (atom %) to the carbon atom concentration dC (atom %) is less than 0.15, a relatively large amount of carbon is then present in the surface layer of the toner particle and a large surface free energy occurs, and as a consequence particle-to-particle aggregation and the affinity for apparatus members are strengthened and member contamination then tends to worsen. When, on the other hand, [dSi/dC] exceeds 5.00, the hydrophobicity due to the carbon atom is then too small and the environmental stability tends to worsen. This [dSi/dC] can be controlled through the structure of the R in formula (T3) as well as the method of producing the toner particles, the reaction temperature, the reaction time, the reaction solvent, and the pH when the organosilicon polymer is formed.

Making 16 equal divisions of the toner particle cross section in the observation of the toner particle cross section using a transmission electron microscope (TEM), using as the center the point of intersection of the long axis L in the toner particle cross section and the axis L90 that passes through the center of the long axis L and is orthogonal thereto, and letting the dividing axes directed from this center to the toner particle surface be An (n=1 to 32), the average thickness Dav. of the organosilicon polymer-containing surface layer of the toner particle for the 32 locations on these dividing axes is preferably from at least 5.0 nm to not more than 150.0 nm in the present invention. The organosilicon polymer-containing surface layer and the region other than the toner particle surface layer (known as the core region) are preferably in contact without gaps being present in the present invention. In other words, the coat layer of particulate masses as disclosed in Japanese Patent Application Laid-open No. 2001-75304 is preferably not present. This serves to inhibit the appearance of bleeding by the resin component, release agent, and so forth present to the interior from the toner particle surface layer and thus makes it possible to obtain a toner that has an excellent storage stability, an excellent environmental stability, and an excellent development durability.

Viewed from the standpoint of the storage stability, the average thickness Dav. of the organosilicon polymer-containing surface layer of the toner particle is more preferably from at least 7.5 nm to not more than 125.0 nm and is even more preferably from at least 10.0 nm to not more than 100.0 nm. Bleed by the resin component, release agent, and so forth in the toner particle readily occurs when the average thickness Dav. of the organosilicon polymer-containing surface layer of the toner particle is less than 5.0 nm. The surface properties of the toner particle will change as a result and the environmental stability and development durability will then tend to deteriorate. The low-temperature fixability will tend to deteriorate when the average thickness Dav. of the organosilicon polymer-containing surface layer of the toner particle exceeds 150.0 nm.

The average thickness Dav. of the organosilicon polymer-containing surface layer of the toner particle can be controlled through the method of producing the toner particles when the organosilicon polymer is formed, the number of carbons in the hydrocarbon group in formula (T3) and the number of hydrophilic groups in formula (T3), and the reaction temperature, reaction time, reaction solvent, and pH during the addition polymerization and condensation polymerization when the organosilicon polymer is formed. It can also be controlled through the content of the organosilicon polymer.

Making 16 equal divisions of the toner particle cross section in the observation of the toner particle cross section with a transmission electron microscope (TEM), using as the center the point of intersection between the long axis L in the toner particle cross section and the axis L90 that passes through the center of the long axis L and is orthogonal thereto, and letting the dividing axes directed from this center to the toner particle surface be An (n=1 to 32), the percentage of the number of dividing axes for which the thickness—on the individual dividing axes of the 32 that are present—of the organosilicon polymer-containing surface layer on the toner particle is not more than 5.0 nm (also referred to herebelow as the percentage of the silicon polymer-containing surface layer with a thickness≤5.0 nm) is preferably not more than 20.0%, more preferably not more than 10.0%, and even more preferably not more than 5.0% (refer to FIG. 1).

When the percentage of the silicon polymer-containing surface layer with a thickness≤5.0 nm is within the indicated range, the appearance of bleeding by the resin component, release agent, and so forth present to the interior from the organosilicon polymer-containing surface layer of the toner particle can be reduced and the environmental stability, storage stability, and development durability can be improved as a result. In addition, a toner with an excellent image density stability and an excellent fogging under different environments can be obtained when the percentage of the silicon polymer-containing surface layer with a thickness≤5.0 nm is not more than 20.0%.

The percentage of the silicon polymer-containing surface layer with a thickness≤5.0 nm can be controlled through the method of producing the toner particles when the organosilicon polymer is formed, the number of carbons in the hydrocarbon group in formula (T3) and the number of hydrophilic groups in formula (T3), and the reaction temperature, reaction time, reaction solvent, and pH during the addition polymerization and condensation polymerization when the organosilicon polymer is formed. It can also be controlled through the content of the organosilicon polymer.

Methods of producing the toner particles are described in the following.

Specific embodiments of the incorporation of the organosilicon polymer in the surface layer of the toner particles are described herebelow, but this should not be construed as limiting the present invention to these embodiments.

A first production method is an embodiment in which particles of a polymerizable monomer composition that contains an organosilicon compound for forming the organosilicon polymer and polymerizable monomer for forming the binder resin, are formed in an aqueous medium and the toner particles are obtained by polymerizing the polymerizable monomer (also referred to herebelow as the suspension polymerization method).

A second production method is an embodiment in which toner base particles are obtained in advance; the toner base particles are introduced into an aqueous medium; and a surface layer of the organosilicon polymer is formed on the toner base particles in the aqueous medium. The toner base particles may be obtained by the melt-kneading and pulverization of the binder resin or by the aggregation and assembly of binder resin particles in an aqueous medium. The toner base particles may also be obtained by preparing an organic phase dispersion solution by dissolving the binder resin in an organic solvent, suspending this organic phase dispersion solution in an aqueous medium, forming particles (granulation) and carrying out polymerization, and then removing the organic solvent.

A third production method is an embodiment in which an organic phase dispersion solution is prepared by dissolving, in an organic solvent, the binder resin and the organosilicon compound for forming the organosilicon polymer; suspending this organic phase dispersion solution in an aqueous medium; forming particles (granulation) and carrying out polymerization; and then removing the organic solvent.

A fourth production method is an embodiment in which the toner particles are formed by the aggregation and assembly in an aqueous medium of particles of the binder resin and sol- or gel-state particles that contain the organosilicon compound for forming the organosilicon polymer.

A fifth production method is an embodiment in which a solvent containing the organosilicon compound for forming the organosilicon polymer at the surface of the toner base particles, is sprayed by a spray drying method onto the surface of the toner base particles and the organosilicon polymer is formed at the surface layer of the toner particles by polymerizing or drying the surface with a hot air current and cooling. The toner base particles may be obtained by the melt-kneading and pulverization of the binder resin; or by the aggregation and assembly of binder resin particles in an aqueous medium; or by preparing an organic phase dispersion solution by dissolving the binder resin in an organic solvent, suspending this organic phase dispersion solution in an aqueous medium, forming particles (granulation) and carrying out polymerization, and then removing the organic solvent.

The toner particles produced by these production methods have an excellent environmental stability (particularly the charging performance in severe environments) due to the formation of the organosilicon polymer in the vicinity of the toner particle surface. In addition, the changes in the surface state of the toner particle that are caused by bleed of the resin present in the toner interior and by the optionally added release agent are inhibited even in severe environments.

The obtained toner particles or toner may be subjected in the present invention to a surface treatment using a hot air current. The execution of a surface treatment on the toner particles or toner using a hot air current promotes the condensation polymerization of the organosilicon polymer in the vicinity of the toner particle surface and can thereby improve the environmental stability and the development durability.

This surface treatment using a hot air current may be any means that uses a procedure that treats the toner particle surface or toner surface with a hot air current and cools the hot air current-treated toner particles or toner with a cold air current.

The apparatus for carrying out this surface treatment using a hot air current can be exemplified by the Hybridization System (Nara Machinery Co., Ltd.), Mechanofusion System (Hosokawa Micron Corporation), Faculty (Hosokawa Micron Corporation), and Meteorainbow MR Type (Nippon Pneumatic Mfd. Co., Ltd.).

The aqueous medium in these production methods can be exemplified by the following:

water; alcohols such as methanol, ethanol, and propanol; and their mixed solvents.

Among the production methods cited above, the suspension polymerization method, i.e., the first production method, is a preferred method for producing the toner particles of the present invention. With the suspension polymerization method, the organosilicon polymer readily undergoes a uniform precipitation at the toner particle surface and an excellent adherence between the surface layer and the interior is obtained, thus providing an excellent storage stability, environmental stability, and development durability. The suspension polymerization method is described further below.

A colorant, release agent, polar resin, and low-molecular weight resin may be added on an optional basis to the polymerizable monomer composition. After the completion of the polymerization step, the obtained particles are washed, recovered by filtration, and dried to obtain the toner particles. The temperature may be increased in the latter half of the polymerization step. Moreover, in order to remove unreacted polymerizable monomer and by-products, a portion of the dispersion medium may be distilled from the reaction system in the latter half of the polymerization step or after the completion of the reaction step.

The materials described below may be used not only in the suspension polymerization method, but are also usable in the other production methods referenced above.

The following vinylic polymerizable monomers are favorable examples of the polymerizable monomer in the suspension polymerization method: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone.

A polymerization initiator may be added to the polymerization of the polymerizable monomer. This polymerization initiator can be exemplified by the following:

azo and diazo polymerization initiators such as 2,2'-azobis (2,4-divaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile, and peroxide polymerization initiators such as benzoyl peroxide, methyl ethyl ketone peroxide, diisopropyl peroxydicarbonate, cumene hydroperoxide, 2,4-dichlorobenzoyl peroxide, and lauroyl peroxide. These polymerization initiators are preferably added at from at least 0.5 mass % to not more than 30.0 mass % with reference to the polymerizable monomer, and a single one may be used or a combination may be used.

A chain transfer agent may be added to the polymerization of the polymerizable monomer in order to control the molecular weight of the binder resin that is a constituent of the toner particles. The amount of addition for the chain transfer agent is preferably from at least 0.001 mass % to not more than 15.000 mass % of the polymerizable monomer.

A crosslinking agent may be added to the polymerization of the polymerizable monomer in order to control the molecular weight of the binder resin that is a constituent of the toner particles. This crosslinking agent can be exemplified by the following:

divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester-type diacrylates (MANDA, Nippon Kayaku Co., Ltd.), and crosslinking agents provided by converting these acrylates to the methacrylates.

Polyfunctional crosslinking agents can be exemplified by the following:

pentaerythritol triacrylate, trimethylolethane triacrylate, trimethylolpropane triacrylate, tetramethylolmethane tetraacrylate, oligoester acrylate and its methacrylate, 2,2-bis (4-methacryloxy.polyethoxyphenyl)propane, diacryl phthalate, triallylcyanurate, triallylisocyanurate, triallyl trimellitate, and diallyl chlorendate. The amount of addition of the crosslinking agent is preferably from at least 0.001 mass % to not more than 15.000 mass % with reference to the polymerizable monomer.

When the medium used for the polymerization of the polymerizable monomer is an aqueous medium, the following, for example, may be used as a dispersion stabilizer for the particles of the polymerizable monomer composition present in the aqueous medium:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic dispersion stabilizers such as polyvinyl alcohol, gelatin, methyl cellulose, methyl hydroxypropyl cellulose, ethyl cellulose, the sodium salt of carboxymethyl cellulose, and starch.

A commercial nonionic, anionic, or cationic surfactant may also be used. These surfactants can be exemplified by the following:

sodium dodecyl sulfate, sodium tetradecyl sulfate, sodium pentadecyl sulfate, sodium octyl sulfate, sodium oleate, sodium laurate, and potassium stearate.

When the aqueous medium is prepared using a sparingly water-soluble inorganic dispersion stabilizer, the amount of addition of this dispersion stabilizer in the present invention is preferably from at least 0.2 mass parts to not more than 2.0 mass parts per 100.0 mass parts of the polymerizable monomer. In addition, the aqueous medium is preferably prepared using from at least 300 mass parts to not more than 3,000 mass parts of water per 100 mass parts of the polymerizable monomer composition.

When an aqueous medium is prepared in which a sparingly water-soluble inorganic dispersing agent as described above is dispersed, a commercial dispersion stabilizer may be used as such in the present invention. In order to obtain a dispersion stabilizer having a small and uniform particle size distribution, a sparingly water-soluble inorganic dispersing agent may be produced in a solvent such as water using high-speed stirring. When, specifically, tricalcium phosphate is used as the dispersion stabilizer, a preferred dispersion stabilizer can be obtained by forming tricalcium phosphate fine particles by mixing an aqueous sodium phosphate solution with an aqueous calcium chloride solution under high-speed stirring.

The binder resin used in the toner particles is not particularly limited in the present invention, and the heretofore known binder resins may be used. Vinylic resins and polyester resins are preferred examples of the binder resin used in the toner particles. The vinylic resin is preferably produced by the polymerization of the vinylic polymerizable monomer already cited above. For example, vinylic resins provide an excellent environmental stability. Vinylic resins are also preferred because they provide an excellent surface uniformity, an excellent long-term storage stability, and an excellent precipitation behavior at the toner particle surface by the organosilicon polymer obtained by the polymerization of the organosilicon compound with the structure given by formula (Z).

The polyester resin, on the other hand, can be a polyester resin as provided by the condensation polymerization of the carboxylic acid component and alcohol component given as examples in the following.

The carboxylic acid component can be exemplified by terephthalic acid, isophthalic acid, phthalic acid, fumaric acid, maleic acid, cyclohexanedicarboxylic acid, and trimellitic acid.

The alcohol component can be exemplified by bisphenol A, hydrogenated bisphenol, the ethylene oxide adducts of bisphenol A, the propylene oxide adducts of bisphenol A, glycerol, trimethylolpropane, and pentaerythritol.

The polyester resin may be a polyester resin that contains the urea group.

The vinylic resin, polyester resin, and other binder resins, on the other hand, can be exemplified by the following resins and polymers:

homopolymers of styrene and its substituted species, such as polystyrene and polyvinyltoluene; styrenic copolymers, such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; and polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosins, terpene resins, phenolic resins, aliphatic hydrocarbon resins, alicyclic hydrocarbon resins, and aromatic petroleum resins. A single one or a mixture of these binder resins may be used.

The resin may have a polymerizable functional group in the toner of the present invention with the goal of ameliorating the viscosity changes in the toner at high temperatures. This polymerizable functional group can be exemplified by the vinyl group, isocyanate group, epoxy group, amino group, carboxylic acid group, and hydroxy group.

The toner particles in the present invention may contain a polar resin. Preferred examples of this polar resin are saturated polyester resins and unsaturated polyester resins.

Polyester resins obtained by the condensation polymerization of the following carboxylic acid component and alcohol component can be used as these polyester resins.

The carboxylic acid component can be exemplified by terephthalic acid, isophthalic acid, phthalic acid, fumaric acid, maleic acid, cyclohexanedicarboxylic acid, and trimellitic acid.

The alcohol component can be exemplified by bisphenol A, hydrogenated bisphenol, ethylene oxide adducts of bisphenol A, propylene oxide adducts of bisphenol A, glycerol, trimethylolpropane, and pentaerythritol.

This polyester resin may be a polyester resin that contains the urea group.

The weight-average molecular weight of the polar resin in the present invention is preferably from at least 4,000 to less than 100,000. The content of the polar resin, expressed with reference to the binder resin component present in the toner particle, is preferably from at least 3.0 mass % to not more than 70.0 mass %, more preferably from at least 3.0 mass % to not more than 50.0 mass %, and even more preferably from at least 5.0 mass % to not more than 30.0 mass %.

A release agent is preferably incorporated as a constituent material of the toner particles in the present invention. Release agents that can be used in the toner particles can be exemplified by petroleum waxes, such as paraffin waxes, microcrystalline waxes, and petrolatum, and their derivatives; montan wax and its derivatives; hydrocarbon waxes provided by the Fischer-Tropsch method and their derivatives; polyolefin waxes, such as polyethylene and polypropylene, and their derivatives; natural waxes, such as carnauba wax and candelilla wax, and their derivatives; higher aliphatic alcohols; fatty acids, such as stearic acid and palmitic acid, and their acid amides, esters, and ketones; hydrogenated castor oil and its derivatives; vegetable waxes; animal waxes; and silicone resins.

The derivatives here include the oxides, block copolymers with vinylic monomer, and graft modifications.

The content of the release agent, expressed per 100.0 mass parts of the binder resin or polymerizable monomer, is preferably from at least 5.0 mass parts to not more than 20.0 mass parts.

The toner particles in the present invention may contain a colorant. There are no particular limitations on this colorant, and known colorants as indicated in the following may be used.

Yellow pigments can be exemplified by the following: iron oxide yellow; condensed azo compounds such as Naples Yellow, Naphthol Yellow S, Hansa Yellow G, Hansa Yellow 10G, Benzidine Yellow G, Benzidine Yellow GR, Quinoline Yellow Lake, Permanent Yellow NCG, and Tartrazine Yellow Lake; as well as isoindolinone compounds, anthraquinone compounds, azo metal complexes, methine compounds, and arylamide compounds. Specific examples are as follows:

C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 109, C.I. Pigment Yellow 110, C.I. Pigment Yellow 111, C.I. Pigment Yellow 128, C.I. Pigment Yellow 129, C.I. Pigment Yellow 147, C.I. Pigment Yellow 155, C.I. Pigment Yellow 168, and C.I. Pigment Yellow 180.

Orange pigments can be exemplified by the following:

Permanent Orange GTR, Pyrazolone Orange, Vulcan Orange, Benzidine Orange G, Indathrene Brilliant Orange RK, and Indathrene Brilliant Orange GK.

Red pigments can be exemplified by iron oxide red; condensed azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, and Alizarine Lake; as well as diketopyrrolopyrrole compounds, anthraquinones, quinacridone compounds, basic dye lake compounds, naphthol compounds, benzimidazolone compounds, thioindigo compounds, and perylene compounds. Specific examples are as follows:

C.I. Pigment Red 2, C.I. Pigment Red 3, C.I. Pigment Red 5, C.I. Pigment Red 6, C.I. Pigment Red 7, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Blue pigments can be exemplified by Alkali Blue Lake; Victoria Blue Lake; copper phthalocyanine compounds and their derivatives, such as Phthalocyanine Blue, metal-free Phthalocyanine Blue, partially chlorinated Phthalocyanine Blue, Fast Sky Blue, and Indathrene Blue BG; anthraquinone compounds; and basic dye lake compounds. Specific examples are as follows:

C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Violet pigments can be exemplified by Fast Violet B and Methyl Violet Lake.

Green pigments can be exemplified by Pigment Green B, Malachite Green Lake, and Final Yellow Green G. White pigments can be exemplified by zinc oxide, titanium oxide, antimony white, and zinc sulfide.

Black pigments can be exemplified by carbon black, aniline black, nonmagnetic ferrite, magnetite, and pigment provided by color mixing to black using the previously described yellow colorants, red colorants, and blue colorants. These colorants may be used individually or a mixture thereof may be used; they may also be used in the form of the solid solution.

Depending on the particular toner production method, attention is desirably given to the polymerization-inhibiting activity and the dispersion medium transferability that the colorant may possess. As necessary, a surface modification may be carried out by treating the surface of the colorant with a substance that does not inhibit polymerization. In particular, dyes and carbon blacks frequently have a polymerization-inhibiting activity and care must be exercised in their use.

In a preferred method for treating a dye, the polymerizable monomer is preliminarily polymerized in the presence of the dye and the resulting colored polymer is added to the polymerizable monomer composition. For carbon blacks, on the other hand, the same treatment as for a dye may be carried out, or a treatment may be carried out with a substance (for example, an organosiloxane) that reacts with the surface functional groups on the carbon black.

The colorant content is preferably from at least 3.0 mass parts to not more than 15.0 mass parts per 100.0 mass parts of the binder resin or polymerizable monomer.

The toner particles may contain a charge control agent in the present invention. Known charge control agents may be used for this charge control agent. In particular, a charge control agent is preferred that provides a fast charging speed and that can stably maintain a constant or prescribed amount of charge. Moreover, when the toner particles are produced by a direct polymerization method, a charge control agent is particularly preferred that has a low polymerization-inhibiting activity and that has substantially no material soluble in aqueous media.

Charge control agents that control the toner particles to negative chargeability can be exemplified as follows:

organometal compounds and chelate compounds such as monoazo metal compounds, acetylacetone metal compounds, and metal compounds of aromatic oxycarboxylic acids, aromatic dicarboxylic acids, oxycarboxylic acids, and dicarboxylic acids. Otherwise, aromatic oxycarboxylic acids, aromatic monocarboxylic acids, and aromatic polycarboxylic acids and their metal salts, anhydrides, and esters, and phenol derivatives such as bisphenol may also be incorporated. Other examples are urea derivatives, metal-containing salicylic acid-type compounds, metal-containing naphthoic acid-type compounds, boron compounds, quaternary ammonium salts, and calixarene.

Charge control agents that control the toner particles to a positive chargeability, on the other hand, can be exemplified by the following:

nigrosine and nigrosine modifications by, for example, a fatty acid metal salt; guanidine compounds; imidazole compounds; quaternary ammonium salts such as tributylbenzylammonium 1-hydroxy-4-naphthosulfonate salt and tetrabutylammonium tetrafluoroborate; the onium salts, such as phosphonium salts, that are analogues of the preceding, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; and resin-type charge control agents.

A single one of these charge control agents may be used or a combination of two or more may be incorporated. Among these charge control agents, metal-containing salicylic acid-type compounds are preferred, and aluminum or zirconium is preferred for the metal therein. The most preferred charge control agent is an aluminum 3,5-di-tert-butylsalicylate compound.

A polymer having a sulfonic acid-type functional group is a preferred resin-type charge control agent. A polymer having a sulfonic acid-type functional group denotes a polymer or copolymer that has a sulfo group (sulfonic acid group), a sulfonate salt group, or a sulfonate ester group.

A polymeric compound having the sulfo group in side chain position is an example of a polymer or copolymer having a sulfo group, sulfonate salt group, or sulfonate ester group. A particularly preferred polymeric compound here is a styrene and/or styrene-(meth)acrylate ester copolymer that has a glass transition temperature (Tg) of from at least 40° C. to not more than 90° C. and that contains at least 2 mass % and preferably at least 5 mass %, as the copolymerization ratio, of a sulfo group-containing (meth)acrylamide-type monomer. The charging stability in high humidities is improved.

This sulfo group-containing (meth)acrylamide-type monomer is preferably given by the following formula (X) and can be specifically exemplified by 2-acrylamido-2-methylpropanesulfonic acid and 2-methacrylamido-2-methylpropanesulfonic acid.

[C4]

(X)

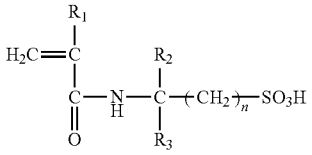

(In formula (X), $R_1$ represents the hydrogen atom or methyl group; $R_2$ and $R_3$ each independently represent the hydrogen atom or a $C_{1-10}$ alkyl group, alkenyl group, aryl group, or alkoxy group; and n represents an integer from at least 1 to not more than 10.)

This sulfo group-containing polymer can provide an even better charged state for the toner particles through its incorporation in the toner particles at from at least 0.1 mass parts to not more than 10.0 mass parts per 100 mass parts of the binder resin.

The amount of addition of these charge control agents is preferably from at least 0.01 mass parts to not more than 10.00 mass parts per 100.00 mass parts of the binder resin or polymerizable monomer.

With the goal of imparting various properties, the toner of the present invention can be a toner made by treating the toner particle surface with various organic fine particles or inorganic fine particles. Viewed in terms of the durability when added to the toner particles, a particle diameter that is not more than one-tenth of the weight-average particle diameter of the toner particles is preferred for the organic fine particles or inorganic fine particles.

The following can be used as the organic fine particles or inorganic fine particles.

(1) flowability-imparting agents: silica, alumina, titanium oxide, carbon black, and fluorinated carbon.

(2) polishes: metal oxides such as strontium titanate, cerium oxide, alumina, magnesium oxide, and chromium oxide; nitrides such as silicon nitride; carbides such as silicon carbide; and metal salts such as calcium sulfate, barium sulfate, and calcium carbonate.

(3) lubricants: fluororesin powders, such as from vinylidene fluoride or polytetrafluoroethylene, and metal salts of fatty acids, such as zinc stearate and calcium stearate.

(4) charge-control particles: metal oxides such as tin oxide, titanium oxide, zinc oxide, silica, and alumina, and carbon black.

The toner particle surface is treated with organic fine particles or inorganic fine particles in order to improve the flowability of the toner and provide a uniform toner charging. The use of organic fine particles or inorganic fine particles that have been subjected to a hydrophobic treatment is preferred because this can achieve improvements in the charging characteristics in high-humidity environments and adjustments in the toner charging performance. The treatment agent in the hydrophobic treatment of the organic fine particles or inorganic fine particles can be exemplified by unmodified silicone varnishes, variously modified silicone varnishes, unmodified silicone oils, variously modified silicone oils, silane compounds, silane coupling agents, other organosilicon compounds, and organotitanium compounds. A single one or a combination of these treatment agents may be used.

Among the preceding, inorganic fine particles that have been treated with a silicone oil are preferred. More preferably, the treatment with a silicone oil is carried out after or at the same time as a hydrophobic treatment of the inorganic fine particles with a coupling agent. Finely divided inorganic particles that have been subjected to a silicone oil treatment and a hydrophobic treatment are preferred because this can maintain a high level of toner charge even in high-humidity environments and can reduce selective development.

The amount of addition of the organic fine particles or inorganic fine particles, expressed per 100.00 mass parts of the toner particles, is preferably from at least 0.01 mass parts to not more than 10.00 mass parts, more preferably from at least 0.02 mass parts to not more than 5.00 mass parts, and even more preferably from at least 0.03 mass parts to not more than 1.00 mass part. By optimizing the amount of addition, member contamination is improved through the embedding of the organic fine particles or inorganic fine particles in the toner particle and/or through their release. A single type of organic fine particle or inorganic fine particle may be used, or a plurality may be used in combination.

The BET specific surface area of the organic fine particles or inorganic fine particles is preferably from at least 10 $m^2/g$ to not more than 450 $m^2/g$ in the present invention.

The BET specific surface area of the organic fine particles or inorganic fine particles can be determined by the adsorption of a low-temperature gas by a dynamic constant pressure procedure in accordance with the BET method (preferably a multipoint BET method). For example, using an instrument for measuring the specific surface area (product name: Gemini 2375 Ver. 5.0, from the Shimadzu Corporation), the BET specific surface area ($m^2/g$) can be calculated by a measurement using a multipoint BET method in which nitrogen gas is adsorbed to the sample surface.

The organic fine particles or inorganic fine particles may be tightly fixed or attached to the toner particle surface. External addition mixers for tightly fixing or attaching the organic fine particles or inorganic fine particles to the toner particle surface can be exemplified by the Henschel mixer, Mechanofusion, Cyclomix, Turbulizer, Flexomix, Hybridization, Mechano Hybrid, and Nobilta. The organic fine particles or inorganic fine particles can be firmly fixed or attached by speeding up the rotation peripheral velocity or lengthening the treatment time.

The properties of the toner are described in the following.

The toner of the present invention has a viscosity at 80° C., as measured by a constant-load extrusion-type capillary rheometer, preferably of from at least 1,000 Pa·s to not more than 40,000 Pa·s. An excellent low-temperature fixability is obtained for the toner by having this 80° C. viscosity be from at least 1,000 Pa·s to not more than 40,000 Pa·s. The 80° C. viscosity is more preferably from at least 2,000 Pa·s to not more than 20,000 Pa·s. This 80° C. viscosity can be adjusted in the present invention through the amount of addition of low molecular weight resin and through the type of monomer, amount of initiator, reaction temperature, and reaction time used during production of the binder resin.

The following method can be used to determine the value of the viscosity at 80° C. by measurement of the toner with a constant-load extrusion-type capillary rheometer.

The measurement is carried out under the following conditions using a Flowtester CFT-500D (Shimadzu Corporation) for the instrument.

sample: approximately 1.0 g of the toner is weighed out and the sample is prepared by molding this using a compression molder for 1 minute under a load of 100 $kg/cm^2$.

diameter of die orifice: 1.0 mm die length: 1.0 mm cylinder pressure: $9.807\times10^5$ (Pa)

measurement mode: rising temperature method ramp rate: 4.0° C./min

This method determines the viscosity (Pa·s) at 80° C. by measuring the viscosity (Pa·s) of the toner from at least 30° C. to not more than 200° C. This value is taken to be the 80° C. viscosity as measured by a constant-load extrusion-type capillary rheometer.

The weight-average particle diameter (D4) of the toner of the present invention is preferably from at least 4.0 μm to not more than 9.0 μm, more preferably from at least 5.0 μm to not more than 8.0 μm, and even more preferably from at least 5.0 μm to not more than 7.0 μm.

The glass transition temperature (Tg) of the toner of the present invention is preferably from at least 35° C. to not more than 100° C., more preferably from at least 40° C. to not more than 80° C., and even more preferably from at least 45° C. to not more than 70° C. Additional improvements in the transparency of the transmitted images for overhead projector films, the blocking resistance, and the low-temperature offset resistance can be obtained by having the glass-transition temperature be in the indicated range.

The content of the tetrahydrofuran-insoluble matter in the toner of the present invention, expressed with reference to the toner components but excluding the toner's colorant and inorganic fine particles, is preferably less than 50.0 mass % and is more preferably from at least 0.0 mass % to less than 45.0 mass % and even more preferably from at least 5.0 mass % to less than 40.0 mass %. The low-temperature fixability can be improved by having the content of THF-insoluble matter be less than 50.0 mass %.

This content of THF-insoluble matter in the toner denotes the mass percentage for the ultrahigh molecular weight polymer component (substantially the crosslinked polymer) that has become insoluble in THF solvent. In the present invention the content of the THF-insoluble matter in the toner is the value measured as follows.

1.0 g of the toner is weighed out (W1, g) and is introduced into an extraction thimble (for example, No. 86R from Toyo Roshi Kaisha, Ltd.) and loaded into a Soxhlet extractor. Extraction is carried out for 20 hours using 200 mL of THF as the solvent; the soluble component extracted by the solvent is concentrated and then vacuum dried for several hours at 40° C. and weighed as the THF-soluble resin component (W2, g). The mass of the components in the toner other than the resin component, such as the colorant, is designated (W3, g). The content of the THF-insoluble matter is obtained from the following formula.

$$\text{content of THF-insoluble matter(mass \%)}=\{(W1-(W3+W2))/(W1-W3)\}\times100$$

The content of the THF-insoluble matter in the toner can be adjusted through the degree of polymerization of the binder resin and through its degree of crosslinking.

The weight-average molecular weight (Mw) measured by gel permeation chromatography (GPC) for the tetrahydrofuran (THF)-soluble matter in the toner (this molecular weight is also referred to herebelow as the weight-average molecular weight of the toner) is preferably from at least 5,000 to not more than 50,000 in the present invention. Blocking resistance and development durability can be established, along with low-temperature fixability and a high image gloss, by having the weight-average molecular weight (Mw) of the toner be in the indicated range. The weight-average molecular weight (Mw) of the toner can be adjusted in the present invention through the amount of addition and the weight-average molecular weight (Mw) of the low molecular weight resin and through the reaction temperature, reaction time, amount of polymerization initiator, amount of chain transfer agent, and amount of crosslinking agent used during toner particle production.

The ratio [Mw/Mn] of the weight-average molecular weight (Mw) to the number-average molecular weight (Mn) in the molecular weight distribution measured on the tetrahydrofuran (THF)-soluble matter in the toner by gel permeation chromatography (GPC) is preferably from at least 5.0 to not more than 100.0 and is more preferably from at least 5.0 to not more than 30.0. A broad fixable temperature range can be generated by having [Mw/Mn] be in the indicated range.

(The Methods for Measuring the Properties of the Toner Particles and Toner)

(The Method of Preparing the Tetrahydrofuran (THF)-Insoluble Matter in the Toner Particles)

The tetrahydrofuran (THF)-insoluble matter in the toner particles was prepared as follows.

10.0 g of the toner particles was weighed out and was introduced into an extraction thimble (No. 86R from Toyo Roshi Kaisha, Ltd.) and loaded into a Soxhlet extractor. Extraction was carried out for 20 hours using 200 mL of THF as the solvent, and the filtration residue in the extraction thimble was vacuum dried for several hours at 40° C. to provide the THF-insoluble matter in the toner particles for submission to the NMR measurement.

In the case of a toner particle surface that has been treated with organic fine particles or inorganic fine particles as referenced above, toner particles are obtained in the present invention by removing the organic fine particles or inorganic fine particles using the following method.

160 g of sucrose (Kishida Chemical Co., Ltd.) is added to 100 mL of ion-exchanged water and is dissolved on a hot water bath to prepare a sucrose concentrate. A dispersion is prepared by introducing 31.0 g of this sucrose concentrate and 6 mL of Contaminon N (product name) (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) into a centrifugal separation tube. 1.0 g of the toner is added to this dispersion and any lumps in the toner are broken up with, for example, a spatula.

The centrifugal separation tube is shaken for 20 minutes at 350 spm (strokes per minute) with a shaker. After this shaking, the solution is transferred over to a glass tube (50 mL) for a swing rotor and separation is then carried out at 3500 rpm/30 minutes using a centrifugal separator. Upon visually confirming a thorough separation of the toner and the aqueous solution, the toner separated into the top layer is recovered with, for example, a spatula. The recovered toner is filtered using a vacuum filtration device and is then dried for at least 1 hour in a drier. The dried material is crushed with a spatula to obtain the toner particles.

(Identification of the Substructure Represented by Formula (T3))

The following method is used to identify the substructure represented by formula (T3) in the organosilicon polymer present in the toner particles.

The presence/absence of the alkyl group or phenyl group represented by R in formula (T3) was confirmed by $^{13}$C-NMR. In addition, the detailed structure of formula (T3) was identified using $^{1}$H-NMR, $^{13}$C-NMR, and $^{29}$Si-NMR. The instrumentation and measurement conditions used are given below.

(Measurement Conditions)

instrument: AVANCE III 500 from Bruker
probe: 4 mm MAS BB/1H
measurement temperature: room temperature
sample spinning rate: 6 kHz
sample: 150 mg of the measurement sample (THF-insoluble matter of the toner particles for submission to the NMR measurement) was introduced into a sample tube with a diameter of 4 mm.

The presence/absence of the alkyl group or phenyl group represented by R in formula (T3) was checked by this method. The formula (T3) structure was scored as "present" when a signal was confirmed.

($^{13}$C-NMR (Solid) Measurement Conditions)

measured nucleus frequency: 125.77 MHz
reference substance: glycine (external reference: 176.03 ppm)
observation width: 37.88 kHz
measurement method: CP/MAS
contact time: 1.75 ms
repeat time: 4 s
number of integrations: 2048 times
LB value: 50 Hz ($^{29}$Si-NMR (Solid) Measurement Method)

(Measurement Conditions)

instrument: AVANCE III 500 from Bruker
probe: 4 mm MAS BB/1H
measurement temperature: room temperature
sample spinning rate: 6 kHz
sample: 150 mg of the measurement sample (THF-insoluble matter of the toner particles for submission to the NMR measurement) is introduced into a sample tube with a diameter of 4 mm.
measured nucleus frequency: 99.36 MHz
reference standard: DSS (external reference: 1.534 ppm)
observation width: 29.76 kHz
measurement method: DD/MAS, CP/MAS
$^{29}$Si 90° pulse width: 4.00 μs @-1 dB
contact time: 1.75 ms to 10 ms
repeat time: 30 s (DD/MAS), 10 s (CP/MAS)
number of integrations: 2048 times
LB value: 50 Hz (Method for Calculating the Percentages, for the Organosilicon Polymer Present in the Toner Particles, of the Substructure Represented by Formula (T3) (the T3 Structure) and the Structure in which the Number of Silicon-Bonded $O_{1/2}$ is 2.0 (the X2 Structure))

(Method for Identifying and Quantitating the T3 Structure, X1 Structure, X2 Structure, X3 Structure, and X4 Structure)

The T3, X1, X2, X3, and X4 substructures can be identified by $^{1}$H-NMR, $^{13}$C-NMR, and $^{29}$Si-NMR.

After the $^{29}$Si-NMR measurement of the THF-insoluble matter in the toner particles, peak separation, by the curve fitting of multiple silane components having different substituents and bonding groups, into the X4 structure, in which the number of silicon-bonded $O_{1/2}$ is 4.0 and shown by general formula (X4) below, the X3 structure, in which the number of silicon-bonded $O_{1/2}$ is 3.0 and shown by general formula (X3) below, the X2 structure, in which the number of silicon-bonded $O_{1/2}$ is 2.0 and shown by general formula (X2) below, the X1 structure, in which the number of silicon-bonded $O_{1/2}$ is 1.0 and shown by general formula (X1) below, and the T unit structure shown by formula (T3), is performed for the toner particles and the mol % for each component is calculated from the area ratios for the individual peaks.

[C5]

(X4)

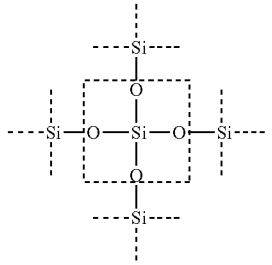

[C6]

(X3)

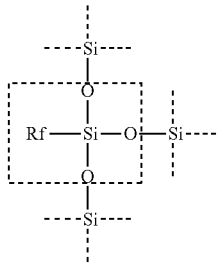

(the Rf in formula (X3) is a silicon-bonded organic group, halogen atom, hydroxy group, or alkoxy group)

[C7]

(X2)

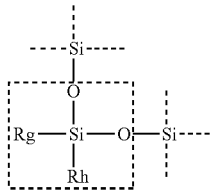

(the Rg and Rh in formula (X2) are a silicon-bonded organic group, halogen atom, hydroxy group, or alkoxy group)

[C8]

(X1)

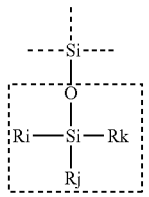

(the Ri, Rj, and Rk in formula (X1) is a silicon-bonded organic group, halogen atom, hydroxy group, or alkoxy group)

Figure 2:
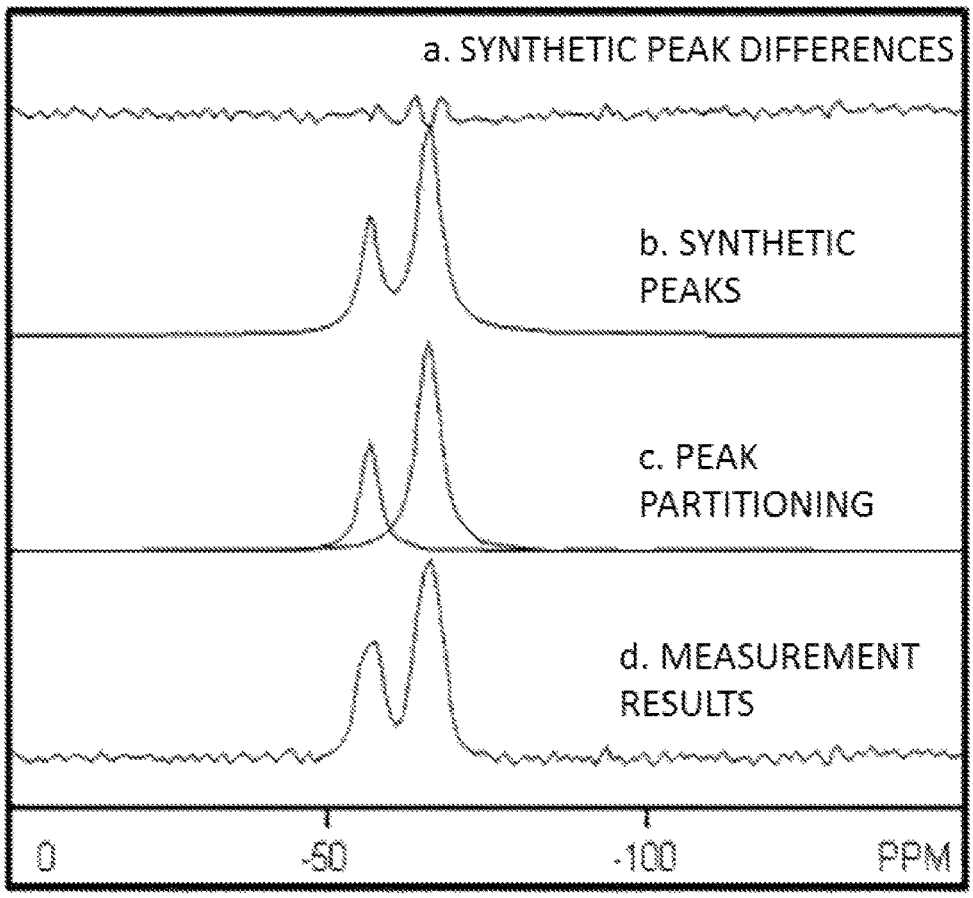
FIG. 2 is a $^{29}$Si-NMR measurement chart of the toner particle according to the present invention.

Curve fitting uses the EXcalibur for Windows (product name) version 4.2 (EX series) software for the JNM-EX400 from JEOL Ltd. The measurement data is read by clicking "1D Pro" from the menu icons. Curve fitting is performed by selecting "curve fitting function" from "Command" in the menu bar. An example is shown in FIG. 2. Peak partitioning is performed so as to minimize the peaks in the synthetic peak differences (a), which are the differences between the synthetic peaks (b) and the measurement results (d).

The area for structure X1, the area for structure X2, the area for structure X3, and the area for structure X4 are determined, and SX1, SX2, SX3, and SX4 are determined using the formulas given below.

In the present invention, the silane monomer was discriminated using the chemical shift value and the total peak area for the organosilicon polymer was taken to be the sum of the area for the X4 structure plus the area for the X3 structure plus the area for the X2 structure plus the area for the X1 structure with the monomer component removed from the total peak area in the $^{29}$Si-NMR measurement of the toner particles.

$$SX1+SX2+SX3+SX4=1.00$$

$$SX1=\{\text{area for the } X1 \text{ structure}/(\text{area for the } X1 \text{ structure}+\text{area for the } X2 \text{ structure}+\text{area for the } X3 \text{ structure}+\text{area for the } X4 \text{ structure})\}$$

$$SX2=\{\text{area for the } X2 \text{ structure}/(\text{area for the } X1 \text{ structure}+\text{area for the } X2 \text{ structure}+\text{area for the } X3 \text{ structure}+\text{area for the } X4 \text{ structure})\}$$

$$SX3=\{\text{area for the } X3 \text{ structure}/(\text{area for the } X1 \text{ structure}+\text{area for the } X2 \text{ structure}+\text{area for the } X3 \text{ structure}+\text{area for the } X4 \text{ structure})\}$$

$$SX4=\{\text{area for the } X4 \text{ structure}/(\text{area for the } X1 \text{ structure}+\text{area for the } X2 \text{ structure}+\text{area for the } X3 \text{ structure}+\text{area for the } X4 \text{ structure})\}$$

$$ST3=\{\text{area for the } T3 \text{ structure}/(\text{area for the } X1 \text{ structure}+\text{area for the } X2 \text{ structure}+\text{area for the } X3 \text{ structure}+\text{area for the } X4 \text{ structure})\}$$

The chemical shifts for silicon for the X1 structure, X2 structure, X3 structure, and X4 structure are shown below.

Example for the X1 structure (Ri=Rj=—$OC_2H_5$, Rk=—$CH_3$): −47 ppm

Example for the X2 structure (Rg=—$OC_2H_5$, Rh=—$CH_3$): −56 ppm

Example for the X3 structure (Rf=—$CH_3$): —65 ppm

The chemical shift value for the silicon in the case of the X4 structure is given below.

X4 structure: −108 ppm (Measurement of the Average Thickness Dav. Of the Organosilicon Polymer-Containing Surface Layer of the Toner Particles and Measurement of the Percentage of the Silicon Polymer-Containing Surface Layer with a Thickness≤5.0 Nm, as Measured by Observation of the Toner Particle Cross Section Using a Transmission Electron Microscope (TEM))

The following method was used to observe the toner particle cross section in the present invention.

In the specific method for observing the toner particle cross section, the toner particles are thoroughly dispersed in a normal temperature-curable epoxy resin followed by curing for 2 days in a 40° C. atmosphere. A thin-section sample is cut out from the resulting cured material using a microtome equipped with diamond blade. Using a transmission electron microscope (product name: Tecnai TF20XT electron microscope from FEI) (TEM), the toner particle cross section is observed at an amplification of 10,000× to 100,000×.

In the present invention, utilizing the difference between the atomic weight of the atoms in the resin used and the organosilicon compound used, observation is carried out utilizing the fact that a strong contrast is obtained with high atomic weights. Staining with ruthenium tetroxide and staining with osmium tetroxide are also used to generate contrast between materials. The distribution of each element in the toner particle can be observed by mapping the individual elements using the transmission electron microscope.

With regard to the particles used for this measurement, the circle-equivalent diameter Dtem was determined from the toner particle cross sections obtained from the TEM photomicrograph, and particles were used for which this value was within the band±10% of the weight-average particle diameter of the toner particles as determined by the method described below.

A bright-field image of the toner particle cross section is acquired as described above at an acceleration voltage of 200 kV using a transmission electron microscope (product name: Tecnai TF20XT electron microscope from FEI). Then, using an EELS detector (product name: GIF Tridiem from Gatan, Inc.), the presence of the organosilicon polymer in the surface layer is checked by acquiring the EF mapping image for the Si-K edge (99 eV) by the three-window method. Then, for one toner particle for which the circle-equivalent diameter Dtem falls in the band ±10% of the weight-average particle diameter, 16 equal divisions are made of the toner particle cross section, using as the center the point of intersection between the long axis L in the toner particle cross section and the axis L90 that passes through the center of the long axis L and is orthogonal thereto (refer to FIG. 1). The dividing axes directed from this center to the toner particle surface are designated An (n=1 to 32); the length of the dividing axis is designated RAn; and the thickness of the organosilicon polymer-containing surface layer of the toner particle is designated FRAn.

The average thickness Dav. of the organosilicon polymer-containing surface layer of the toner particle over the 32 locations on these dividing axes is determined. Also determined is the percentage of the number of dividing axes for which the thickness—on the individual dividing axes of the 32 that are present—of the organosilicon polymer-containing surface layer on the toner particle is not more than 5.0 nm.

Averaging in the present invention was carried out by performing the measurements on ten toner particles and calculating the average value per one toner particle.

(The Circle-Equivalent Diameter (Dtem) Determined from the Toner Particle Cross Section Obtained from the Transmission Electron Microscope (TEM) Photomicrograph)

The following method is used to determine the circle-equivalent diameter (Dtem) from the toner particle cross section obtained from the TEM photomicrograph. First, using the following formula, the circle-equivalent diameter (Dtem) is determined for one toner particle from the toner particle cross section obtained from the TEM photomicrograph.

$$(\text{circle-equivalent diameter } (Dtem) \text{ determined from the toner particle cross section obtained from the } TEM \text{ photomicrograph})=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

The circle-equivalent diameter is determined for ten toner particles and the average value per one particle is calculated and used for the circle-equivalent diameter (Dtem) determined from the toner particle cross section.

(The Average Thickness Dav. Of the Organosilicon Polymer-Containing Surface Layer of the Toner Particles)

The following method was used to determine the average thickness Dav. of the organosilicon polymer-containing surface layer of the toner particles.

The average thickness $D^{(n)}$ of the organosilicon polymer-containing surface layer for one toner particle was first determined using the following method.

$D^{(n)}$=(sum over the 32 locations of the thickness of the organosilicon polymer-containing surface layer on the axes)/32

This calculation was carried out on ten toner particles. The average value per one toner particle was calculated using the following formula from the obtained thicknesses $D^{(n)}$ of the organosilicon polymer-containing surface layer of the toner particles (n is an integer from 1 to 10), thus yielding the Dav. average thickness of the organosilicon polymer-containing surface layer of the toner particles.

$$Dav.=\{D^{(1)}+D^{(2)}+D^{(3)}+D^{(4)}+D^{(5)}+D^{(6)}+D^{(7)}+D^{(8)}+D^{(9)}+D^{(10)}\}/10$$

[The Percentage of the Organosilicon Polymer-Containing Surface Layer Having a Thickness FRAn for the Organosilicon Polymer-Containing Surface Layer of ≤5.0 nm]

The following method was used to determine the percentage of the organosilicon polymer-containing surface layer having a thickness FRAn for the organosilicon polymer-containing surface layer of 5.0 nm.

The percentage of the organosilicon polymer-containing surface layer having a thickness FRAn for the organosilicon polymer-containing surface layer of 5.0 nm was first determined based on the following formula for one toner particle.

(percentage of the organosilicon polymer-containing surface layer having a thickness *FRAn* for the organosilicon polymer-containing surface layer of 5.0 nm)=((number having a thickness *FRAn* for the organosilicon polymer-containing surface layer of ≤5.0 nm)/32)×100

This calculation was performed on ten toner particles. The average value was determined from the obtained percentages of the organosilicon polymer-containing surface layer having a thickness FRAn for the organosilicon polymer-containing surface layer of ≤5.0 nm, and this was used as the percentage of the organosilicon polymer-containing surface layer of the toner particle having a thickness FRAn for the organosilicon polymer-containing surface layer of ≤5.0 nm.

(Concentration (Atom %) of the Element Silicon Present in the Toner Particle Surface Layer)

The silicon atom concentration [dSi] (atom %), the carbon atom concentration [dC] (atom %), and the oxygen atom concentration [dO] (atom %) present in the toner particle surface layer was determined by carrying out surface composition analysis using electron spectroscopy for chemical analysis (ESCA). The ESCA instrumentation and measurement conditions in the present invention are as follows.

instrument used: Quantum 2000 from ULVAC-PHI, Inc.

ESCA instrument measurement conditions x-ray source: Al Kα x-ray: 100 μm, 25 W, 15 kV raster: 300 μm×200 μm pass energy: 58.70 eV, step size: 0.125 eV neutralization electron gun: 20 μA, 1V; Ar ion gun: 7 mA, 10 V number of sweeps: Si: 15 times, C: 10 times, O: 5 times The silicon atom concentration [dSi], carbon atom concentration [dC], and oxygen atom concentration [dO] (atom % in each case) present in the toner particle surface layer were calculated in the present invention, using the relative sensitivity factor provided by ULVAC-PHI, Inc., from the peak intensities measured for each element.

(Measurement of the Weight-Average Molecular Weight (Mw), Number-Average Molecular Weight (Mn), and Main Peak Molecular Weight (Mp) of the Toner (Particles) and Resins)

The weight-average molecular weight (Mw), number-average molecular weight (Mn), and main peak molecular weight (Mp) of the toner (particles) and resins are measured by gel permeation chromatography (GPC) using the following conditions.

(Measurement Conditions)

columns (from Showa Denko Kabushiki Kaisha): 7-column train of Shodex GPC KF-801, KF-802, KF-803, KF-804, KF-805, KF-806, and KF-807 (diameter=8.0 mm, length=30 cm)

eluent: tetrahydrofuran (THF)

temperature: 40° C.

flow rate: 0.6 mL/minute detector: RI sample concentration and amount: 10 μL of a 0.1 mass % sample (Sample Preparation)

0.04 g of the measurement target (toner (particles), various resins) is dispersed and dissolved in 20 mL tetrahydrofuran, followed by holding at quiescence for 24 hours and then filtration with a 0.2 μm filter (product name: MyShoriDisk H-25-2, from the Tosoh Corporation); the resulting filtrate is used as the sample.

A molecular weight calibration curve constructed using monodisperse polystyrene standard samples is used as the calibration curve. TSK Standard Polystyrene F-850, F-450, F-288, F-128, F-80, F-40, F-20, F-10, F-4, F-2, F-1, A-5000, A-2500, A-1000, and A-500 from the Tosoh Corporation are used as the standard polystyrene samples for calibration curve construction, at which time standard polystyrene samples at at least about 10 points are used.

In the construction of the molecular weight distribution by GPC, the measurement is begun on the high molecular weight side from the point at which the chromatogram begins to rise from the baseline, and on the low molecular weight side the measurement is carried out to a molecular weight of approximately 400.

(Measurement of the Glass Transition Temperature (Tg) and the Calorimetric Integral Value on the Toner (Particles) and Resins)

Figure 3:
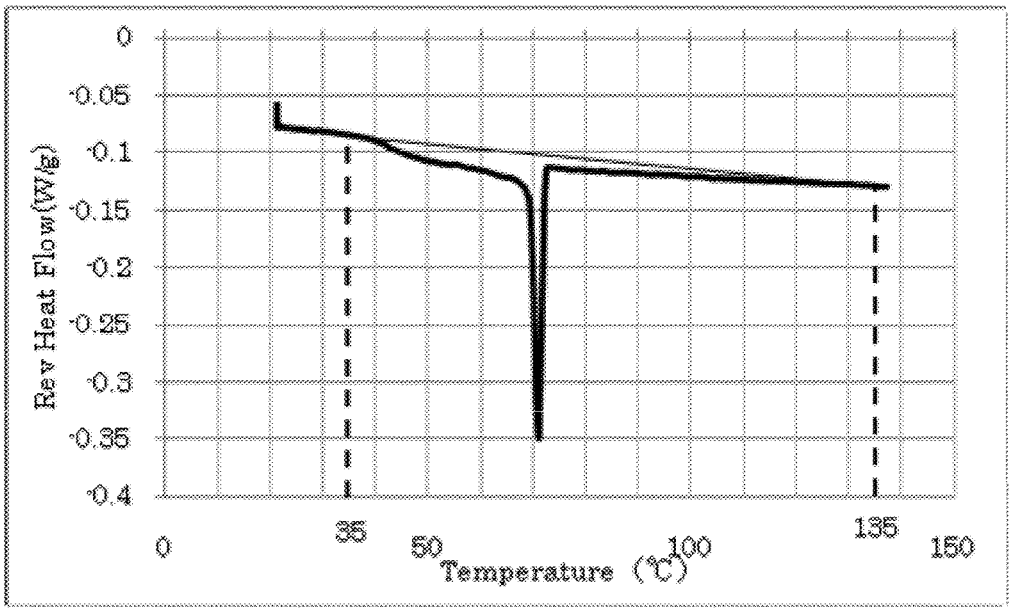
FIG. 3 is a diagram that shows the reversing heat flow curve obtained by DSC measurement of the toner according to the present invention.

The glass transition temperature (Tg) and the calorimetric integral value of the toner (particles) and resins is measured by the following procedure using a differential scanning calorimeter (DSC) M-DSC (product name: Q2000, TA Instruments). 3 mg of the sample to be measured (toner (particles), various resins) is exactly weighed out. It is introduced into an aluminum pan and the measurement is run at normal temperature and normal humidity at a ramp rate of 1° C./minute in the measurement temperature range from at least 20° C. to not more than 200° C. using an empty aluminum pan as the reference. This measurement is run at a frequency of 1/minute and a modulation amplitude of ±0.5° C. The glass transition temperature (Tg: ° C.) is calculated from the resulting reversing heat flow curve. Tg (° C.) is determined as the middle value of the intersections between the tangent to the curve generated by heat absorption and the baselines before and after heat absorption. The calorimetric integral value (J/g) per 1 g of toner (particles) represented by the peak area of the endothermic main peak is measured in the temperature ramp-up endothermic chart measured by DSC. FIG. 3 shows an example of the reversing flow curve obtained by DSC measurement of the toner.

The calorimetric integral value (J/g) is determined using the reversing flow curve obtained by the above-described measurement. This calculation is carried out using Universal Analysis 2000 for Windows (product name) 2000/XP Version 4.3A (TA Instruments) analytical software, and the calorimetric integral value (J/g) is determined using the Integral Peak Linear function from the region bounded by the endothermic curve and a straight line connecting the measurement points at 35° C. and 135° C.

(Measurement of the Weight-Average Particle Diameter (D4) and the Number-Average Particle Diameter (D1) of the Toner (Particles))

The weight-average particle diameter (D4) and the number-average particle diameter (D1) of the toner (particles) are calculated by analyzing the measurement data provided by measurement at 25,000 channels for the number of effective measurement channels, using a precision particle diameter distribution analyzer that employs the pore electrical resistance method and is equipped with a 100 μm aperture tube (product name: Coulter Counter Multisizer 3, from Beckman Coulter, Inc.) and using the dedicated software (product name: Beckman Coulter Multisizer 3 Version 3.51, from Beckman Coulter, Inc.) provided with the instrument to set the measurement conditions and perform measurement data analysis.

A solution of special-grade sodium chloride dissolved in ion-exchanged water and brought to a concentration of approximately 1 mass %, for example, ISOTON II (product name, from Beckman Coulter, Inc.), can be used for the aqueous electrolyte solution used for the measurement.

The dedicated software is set as follows prior to running the measurement and analysis.

On the "Change Standard Operating Method (SOM)" screen of the dedicated software, the total count number for the control mode is set to 50000 particles, the number of measurements is set to 1, and the value obtained using 10.0 μm standard particles (from Beckman Coulter, Inc.) is set for the Kd value. The threshold value and noise level are automatically set by pressing the threshold value/noise level measurement button. The current is set to 1600 μA, the gain is set to 2, the electrolyte solution is set to ISOTON II (product name), and flush aperture tube after measurement is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the dedicated software.

(2) Approximately 30 mL of the above-described aqueous electrolyte solution is introduced into a glass 100-mL flat-bottom beaker. To this is added the following as a dispersing agent: approximately 0.3 mL of a dilution prepared by diluting Contaminon N (product name) (a 10 mass % aqueous solution of a neutral pH 7 detergent for cleaning precision measurement instrumentation, comprising a non-ionic surfactant, an anionic surfactant, and an organic builder, from Wako Pure Chemical Industries, Ltd.) approximately 3-fold on a mass basis with ion-exchanged water.

(3) A prescribed amount of ion-exchanged water is introduced into the water tank of an ultrasound disperser (product name: Ultrasonic Dispersion System Tetora 150, Nikkaki Bios Co., Ltd.) that has an output of 120 W and is equipped with two oscillators oscillating at 50 kHz and configured with a phase shift of 180°, and approximately 2 mL of the above-described Contaminon N (product name) is added to this water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner (particles) is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. but no more than 40° C.

(6) Using a pipette, the aqueous electrolyte solution from (5) containing dispersed toner (particles) is added dropwise into the roundbottom beaker of (1) that is installed in the sample stand and the measurement concentration is adjusted to approximately 5%. The measurement is run until the number of particles measured reaches 50000.

(7) The measurement data is analyzed by the dedicated software provided with the instrument to calculate the weight-average particle diameter (D4). When the dedicated software is set to graph/volume %, the "average diameter" on the analysis/volume statistics (arithmetic average) screen is the weight-average particle diameter (D4); when the dedicated software is set to graph/number %, the "average diameter" on the "analysis/number statistics (arithmetic average)" screen is the number-average particle diameter (D1).

(Method of Measuring the Average Circularity of the Toner (Particles))

The average circularity of the toner (particles) is measured using the "FPIA-3000" (Sysmex Corporation), a flow particle image analyzer, using the measurement and analysis conditions from the calibration process.

To 20 mL of ion-exchanged water is added, as a dispersing agent, a suitable amount of an alkylbenzenesulfonate surfactant, followed by the addition of 0.02 g of the measurement sample, and a dispersion treatment is carried out for 2 minutes using a benchtop ultrasonic cleaner/disperser that has an oscillation frequency of 50 kHz and an electrical output of 150 W (product name: VS-150, from Velvo-Clear Co., Ltd.) to provide a dispersion for submission to measurement. Cooling is carried out as appropriate during this treatment so as to provide a dispersion temperature of at least 10° C. and not more than 40° C.

The previously cited flow particle image analyzer fitted with a standard objective lens (10×)) is used for the measurement, and "PSE-900A" (Sysmex Corporation) particle sheath is used for the sheath solution. The dispersion prepared according to the procedure described above is introduced into the flow particle image analyzer and 3,000 of the toner (particles) are measured according to total count mode in HPF measurement mode. The average circularity of the toner (particles) is determined with the binarization threshold value during particle analysis set at 85% and the analyzed particle diameter limited to a circle-equivalent diameter of from at least 1.98 μm to not more than 19.92 μm.

For this measurement, automatic focal point adjustment is performed prior to the start of the measurement using reference latex particles (for example, a dilution with ion-exchanged water of 5100A (product name) from Duke Scientific). After this, focal point adjustment is preferably performed every two hours after the start of measurement.

When the modal circularity in the toner (particles) circularity distribution is from at least 0.98 to not more than 1.00, this indicates that much of the toner (particles) has a near-spherical shape. The reduction in the attachment force by the toner (particles) to the photosensitive member caused by, e.g., the image force, Van der Waals forces, and so forth, then becomes significantly more substantial and a high transfer efficiency is produced, making this preferred.

Here, the modal circularity denotes the circularity of the partition interval in the circularity frequency distribution that has the highest frequency when the circularity from 0.40 to 1.00 is divided into 61 intervals using an increment of 0.01—i.e., equal to or greater than 0.40 and less than 0.41, equal to or greater than 0.41 and less than 0.42, . . . equal to or greater than 0.99 and less than 1.00, and 1.00—and the individual measured particle circularities are allocated into these partition intervals.

EXAMPLES

The present invention is described in additional detail through the examples provided below, but the present invention is not limited by these examples. The parts in the blends and mixtures in the following denote mass parts unless specifically indicated otherwise.

An example of the production of a charge control resin used by the present invention will be described.

(Production Example for Charge Control Resin 1)

250 mass parts of methanol, 150 mass parts of 2-butanone, and 100 mass parts of 2-propanol as solvents and 88 mass parts of styrene, 6.0 mass parts of 2-ethylhexyl acrylate, and 6.0 mass parts of 2-acrylamido-2-methylpropanesulfonic acid as monomers were added to a reactor fitted with a reflux condenser, a stirrer, a thermometer, a nitrogen introduction tube, a dropping apparatus, and a pressure-reduction apparatus, and heating under reflux at normal pressure was carried out while stirring. A solution of 1.2 mass parts of the polymerization initiator 2,2'-azobisisobutyronitrile diluted in 20 mass parts of 2-butanone was added dropwise over 30 minutes and stirring was continued for 5 hours. A solution of 1.0 mass part of 2,2'-azobisisobutyronitrile diluted with 20 mass parts of 2-butanone was also added dropwise over 30 minutes and the polymerization was completed by stirring for an additional 5 hours under reflux at normal pressure.

Then, after the polymerization solvent had been distilled off under reduced pressure, the resulting polymer was coarsely pulverized to 100 μm and below using a cutter mill with a 150 mesh screen attached and was then finely pulverized with a jet mill. These fine particles were classified with a 250 mesh screen to fractionate and obtain particles of 60 μm and below. These particles were then dissolved by the addition of sufficient methyl ethyl ketone to provide a concentration of 10%, and reprecipitation was carried out by gradually introducing the resulting solution into methanol in an amount 20 times that of the methyl ethyl ketone. The resulting precipitate was washed with methanol that was one-half the amount used for the reprecipitation, and the filtered particles were vacuum dried for 48 hours at 35° C.

After this vacuum drying, the particles were redissolved by the addition of methyl ethyl ketone to provide a concentration of 10%, and reprecipitation was performed by the gradual introduction of the resulting solution into n-hexane that was 20 times the amount of the methyl ethyl ketone. The resulting precipitated material was washed with n-hexane that was one-half the amount used for reprecipitation, and the filtered particles were vacuum dried for 48 hours at 35° C. The thusly obtained charge control resin had a Tg of approximately 82° C., a main peak molecular weight (Mp) of 19,600, a number-average molecular weight (Mn) of 11,700, a weight-average molecular weight (Mw) of 20,600, and an acid value of 17.4 mg KOH/g. The obtained resin is designated charge control resin 1.

(Polyester Resin (1) Production Example)

terephthalic acid: 11.1 mol bisphenol A-2 mol propylene oxide adduct: 11.0 mol (PO-BPA)

These monomers were introduced into an autoclave along with an esterification catalyst; the autoclave was fitted with a pressure reduction apparatus, a water separator, a nitrogen gas introduction apparatus, a temperature measurement apparatus, and a stirring apparatus; and a polyester resin (1) was obtained by running a reaction, while reducing the pressure, at 210° C. according to a typical method under a nitrogen atmosphere until the Tg reached 66° C. The weight-average molecular weight (Mw) was 7,100 and the number-average molecular weight (Mn) was 3,030.

(Polyester Resin (2) Production Example)

(Synthesis of Isocyanate Group-containing Prepolymer)

| | |
|---|---|
| bisphenol A-2 mol ethylene oxide adduct | 730 mass parts |
| phthalic acid | 295 mass parts |
| dibutyltin oxide | 3.0 mass parts |

An isocyanate group-containing polyester was obtained by reaction for 7 hours at 220° C. with stirring; additional reaction for 5 hours under reduced pressure; cooling to 80° C.; and reaction for 2 hours with 190 mass parts of isophorone diisocyanate in ethyl acetate. 25 mass parts of the isocyanate group-containing polyester resin and 1 mass part of isophoronediamine were reacted for 2 hours at 50° C. to obtain a polyester resin (2) in which the major component was a urea group-containing polyester. The resulting polyester resin (2) had a weight-average molecular weight (Mw) of 23,300, a number-average molecular weight (Mn) of 3,010, and a peak molecular weight of 7,300.

(Toner Particle 1 Production Example)

700 mass parts of ion-exchanged water, 1000 mass parts of a 0.1 mol/L aqueous $Na_3PO_4$ solution, and 24.0 mass parts of a 1.0 mol/L aqueous HCl solution were introduced into a four-neck vessel fitted with a reflux condenser, a stirrer, a thermometer, and a nitrogen introduction tube and were held at 60° C. while stirring at 12,000 rpm with a TK-Homomixer high-speed stirrer. To this was gradually added 85 mass parts of a 1.0 mol/L aqueous $CaCl_2$ solution to produce an aqueous dispersion medium containing $Ca_3(PO_4)_2$ as a finely divided sparingly water-soluble dispersion stabilizer.

| | |
|---|---|
| styrene | 70.0 mass parts |
| n-butyl acrylate | 30.0 mass parts |
| methyltriethoxysilane | 10.0 mass parts |
| copper phthalocyanine pigment (Pigment Blue 15:3) (P.B. 15:3) | 6.5 mass parts |
| polyester resin (1) | 4.0 mass parts |
| charge control agent 1 (aluminum compound of 3,5-di-tert-butylsalicylic acid) | 0.5 mass parts |
| charge control resin 1 | 0.4 mass parts |
| release agent (behenyl behenate, melting point: 72.1° C.) | 10.0 mass parts |

A polymerizable monomer composition 1 was obtained by dispersing these materials for 3 hours with an attritor, and this polymerizable monomer composition 1 was held for 20 minutes at 60° C. Then, the polymerizable monomer composition 1, to which 16.0 mass parts (50% toluene solution) of t-butyl peroxypivalate had been added as a polymerization initiator for polymerizable monomer composition 1, was introduced into an aqueous medium and was granulated for 10 minutes while maintaining the rotation rate of the high-speed stirrer at 12,000 rpm. After this, the high-speed stirrer was changed out for a propeller-type stirrer; the internal temperature was raised to 70° C.; and a reaction was run for 5 hours while slowly stirring. The pH of the aqueous medium at this time was 5.1. The pH was then brought to 8.0 by the addition of 10.0 mass parts of a 1.0 mol/L aqueous sodium hydroxide solution, and the temperature in the vessel was raised to 90° C. and holding was carried out for 7.5 hours. After this, the pH was brought to 5.1 by the addition of 4.0 mass parts of 10% hydrochloric acid and 50 mass parts of ion-exchanged water. 300 mass parts of ion-exchanged water was then added and the reflux condenser was detached and a distillation apparatus was attached. Distillation was performed for 5 hours at a temperature in the vessel of 100° C. to obtain a polymer slurry 1. The distilled-out fraction was 300 mass parts. After cooling to 30° C., the dispersion stabilizer was removed by the addition of dilute hydrochloric acid to the vessel containing the polymer slurry 1. Filtration, washing, and drying then yielded toner particles having a weight-average particle diameter of 5.6 μm. These toner particles were designated toner particle 1. The formulation and conditions for toner particle 1 are shown in Table 1, while the properties of toner particle 1 are shown in Table 5. Silicon mapping was performed in the TEM observation of toner particle 1, and the uniform presence of silicon atoms at the surface layer was found, thus confirming that a coat layer formed by attachment among particulate masses was not present. The organosilicon polymer-containing surface layer was also similarly checked by silicon mapping in the examples and comparative examples that follow.

(Toner Particle 2 Production Example)

A toner particle 2 was obtained proceeding as in the Toner Particle 1 Production Example, but changing the 10.0 mass parts of methyltriethoxysilane used in the Toner Particle 1 Production Example over to 10.0 mass parts of phenyltrimethoxysilane. The formulation and conditions for toner particle 2 are shown in Table 1, while the properties of toner particle 2 are shown in Table 5. Silicon mapping was performed in the TEM observation of toner particle 2, and the uniform presence of silicon atoms at the surface layer was found, thus confirming that a coat layer formed by attachment among particulate masses was not present.

(Toner Particle 3 Production Example)

A toner particle 3 was obtained proceeding as in the Toner Particle 1 Production Example, but changing the 10.0 mass parts of methyltriethoxysilane used in the Toner Particle 1 Production Example over to 10.0 mass parts of ethyltrimethoxysilane. The formulation and conditions for toner particle 3 are shown in Table 1, while the properties of toner particle 3 are shown in Table 5. Silicon mapping was performed in the TEM observation of toner particle 3, and the uniform presence of silicon atoms at the surface layer was found, thus confirming that a coat layer formed by attachment among particulate masses was not present.

(Toner Particle 4 Production Example)

A toner particle 4 was obtained proceeding as in the Toner Particle 1 Production Example, but changing the 10.0 mass parts of methyltriethoxysilane used in the Toner Particle 1 Production Example over to 10.0 mass parts of n-propyltriethoxysilane. The formulation and conditions for toner particle 4 are shown in Table 1, while the properties of toner particle 4 are shown in Table 5. Silicon mapping was performed in the TEM observation of toner particle 4, and the uniform presence of silicon atoms at the surface layer was found, thus confirming that a coat layer formed by attachment among particulate masses was not present.

(Toner Particle 5 Production Example)

A toner particle 5 was obtained proceeding as in the Toner Particle 1 Production Example, but changing the 10.0 mass parts of methyltriethoxysilane used in the Toner Particle 1 Production Example over to 10.0 mass parts of n-butyltriethoxysilane. The formulation and conditions for toner particle 5 are shown in Table 1, while the properties of toner particle 5 are shown in Table 5. Silicon mapping was performed in the TEM observation of toner particle 5, and the uniform presence of silicon atoms at the surface layer was found, thus confirming that a coat layer formed by attachment among particulate masses was not present.

(Toner Particle 6 Production Example)

A toner particle 6 was obtained proceeding as in the Toner Particle 1 Production Example, but in this case changing the 10.0 mass parts of methyltriethoxysilane used in the Toner Particle 1 Production Example over to 7.0 mass parts of methyltriethoxysilane and 3.0 mass parts of vinyltrichlorosilane and adding 2.0 mass parts of a 1.0 mol/L aqueous sodium hydroxide solution immediately after the introduction into the aqueous medium of the polymerizable monomer composition 1 to which 16.0 mass parts (50% toluene solution) of t-butyl peroxypivalate had been added as polymerization initiator, granulating for 10 minutes while maintaining the rotation rate for the high-speed stirrer at 12,000 rpm, and adjusting the pH to 5.1. The formulation and conditions for toner particle 6 are shown in Table 1, while the properties of toner particle 6 are shown in Table 5. Silicon mapping was performed in the TEM observation of toner particle 6, and the uniform presence of silicon atoms at the surface layer was found, thus confirming that a coat layer formed by attachment among particulate masses was not present.

(Toner Particle 7 Production Example)

A toner particle 7 was obtained proceeding as in the Toner Particle 1 Production Example, but changing the 10.0 mass parts of methyltriethoxysilane used in the Toner Particle 1 Production Example over to 10.0 mass parts of methyltrimethoxysilane. The formulation and conditions for toner particle 7 are shown in Table 1, while the properties of toner particle 7 are shown in Table 5. Silicon mapping was performed in the TEM observation of toner particle 7, and the uniform presence of silicon atoms at the surface layer was found, thus confirming that a coat layer formed by attachment among particulate masses was not present.

(Toner Particle 8 Production Example)

A toner particle 8 was obtained proceeding as in the Toner Particle 1 Production Example, but changing the 10.0 mass parts of methyltriethoxysilane used in the Toner Particle 1 Production Example over to 10.0 mass parts of methyltriisopropoxysilane. The formulation and conditions for toner particle 8 are shown in Table 1, while the properties of toner particle 8 are shown in Table 5. Silicon mapping was performed in the TEM observation of toner particle 8, and the uniform presence of silicon atoms at the surface layer was found, thus confirming that a coat layer formed by attachment among particulate masses was not present.

(Toner Particle 9 Production Example)

A toner particle 9 was obtained proceeding as in the Toner Particle 1 Production Example, but changing 10.0 mass parts of the methyltriethoxysilane used in the Toner Particle 1 Production Example over to 7.5 mass parts of methyldiethoxychlorosilane and carrying out adjustment to pH 5.1 with 1.5 mass parts of a 1.0 N aqueous NaOH solution. The formulation and conditions for toner particle 9 are shown in Table 1, while the properties of toner particle 9 are shown in Table 5. Silicon mapping was performed in the TEM observation of toner particle 9, and the uniform presence of silicon atoms at the surface layer was found, thus confirming that a coat layer formed by attachment among particulate masses was not present.

(Toner Particle 10 Production Example)

A toner particle 10 was obtained proceeding as in the Toner Particle 1 Production Example, but changing the 10.0 mass parts of methyltriethoxysilane used in the Toner Particle 1 Production Example over to 30.0 mass parts of methyltriethoxysilane. The formulation and conditions for toner particle 10 are shown in Table 1, while the properties of toner particle 10 are shown in Table 5. Silicon mapping was performed in the TEM observation of toner particle 10, and the uniform presence of silicon atoms at the surface layer was found, thus confirming that a coat layer formed by attachment among particulate masses was not present.

(Toner Particle 11 Production Example)

A toner particle 11 was obtained proceeding as in the Toner Particle 1 Production Example, but changing the 10.0 mass parts of methyltriethoxysilane used in the Toner Particle 1 Production Example over to 5.4 mass parts of methyltriethoxysilane. The formulation and conditions for toner particle 11 are shown in Table 2, while the properties of toner particle 11 are shown in Table 6. Silicon mapping was performed in the TEM observation of toner particle 11, and the uniform presence of silicon atoms at the surface layer was found, thus confirming that a coat layer formed by attachment among particulate masses was not present.

(Toner Particle 12 Production Example)

A toner particle 12 was obtained proceeding as in the Toner Particle 1 Production Example, but changing the 10.0 mass parts of methyltriethoxysilane used in the Toner Particle 1 Production Example over to 4.5 mass parts of methyltriethoxysilane. The formulation and conditions for toner particle 12 are shown in Table 2, while the properties of toner particle 12 are shown in Table 6. Silicon mapping was performed in the TEM observation of toner particle 12, and the uniform presence of silicon atoms at the surface layer was found, thus confirming that a coat layer formed by attachment among particulate masses was not present.

(Toner Particle 13 Production Example)

A toner particle 13 was obtained proceeding as in the Toner Particle 1 Production Example, but changing the 10.0 mass parts of methyltriethoxysilane used in the Toner Particle 1 Production Example over to 4.0 mass parts of methyltriethoxysilane. The formulation and conditions for toner particle 13 are shown in Table 2, while the properties of toner particle 13 are shown in Table 6. Silicon mapping was performed in the TEM observation of toner particle 13, and the uniform presence of silicon atoms at the surface layer was found, thus confirming that a coat layer formed by attachment among particulate masses was not present.

(Toner Particle 14 Production Example)

A toner particle 14 was obtained proceeding as in the Toner Particle 1 Production Example, but changing the 10.0 mass parts of methyltriethoxysilane used in the Toner Particle 1 Production Example over to 3.5 mass parts of methyltriethoxysilane. The formulation and conditions for toner particle 14 are shown in Table 2, while the properties of toner particle 14 are shown in Table 6. Silicon mapping was performed in the TEM observation of toner particle 14, and the uniform presence of silicon atoms at the surface layer was found, thus confirming that a coat layer formed by attachment among particulate masses was not present.

(Toner Particle 15 Production Example)

A toner particle 15 was obtained proceeding as in the Toner Particle 1 Production Example, but making the following changes in the Toner Particle 1 Production Example: the pH of the aqueous dispersion was changed to 4.1 by changing—at the point of the addition of 24.0 mass parts of the 1.0 mol/L aqueous HCl solution in the preparation of the aqueous dispersion medium—the 24.0 mass parts to the addition of 30.0 mass parts; at the point of establishing a pH of 8.0 by the addition of 10.0 mass parts of the 1.0 mol/L aqueous sodium hydroxide solution, this 10.0 mass parts was changed to 0.0 mass parts; and at the point of establishing a pH of 5.1 by the addition of 4.0 mass parts of the 10% hydrochloric acid and 50 mass parts ion-exchanged water, this 4.0 mass parts of 10% hydrochloric acid was changed to 0.0 mass parts. The formulation and conditions for toner particle 15 are shown in Table 2, while the properties of toner particle 15 are shown in Table 6. Silicon mapping was performed in the TEM observation of toner particle 15, and the uniform presence of silicon atoms at the surface layer was found, thus confirming that a coat layer formed by attachment among particulate masses was not present.

(Toner Particle 16 Production Example)

A toner particle 16 was obtained proceeding as in the Toner Particle 1 Production Example, but making the following changes in the Toner Particle 1 Production Example: at the point of establishing a pH of 8.0 by the addition of 10.0 mass parts of the 1.0 mol/L aqueous sodium hydroxide solution, this 10.0 mass parts of the 1.0 mol/L aqueous sodium hydroxide solution was changed to 20.0 mass parts of the 1.0 mol/L aqueous sodium hydroxide solution and the pH of 8.0 was thus changed to a pH of 10.2; and the pH was adjusted to 5.1 by the addition of hydrochloric acid after the completion of reaction 2. The formulation and conditions for toner particle 16 are shown in Table 2, while the properties of toner particle 16 are shown in Table 6. Silicon mapping was performed in the TEM observation of toner particle 16, and the uniform presence of silicon atoms at the surface layer was found, thus confirming that a coat layer formed by attachment among particulate masses was not present.

(Toner Particle 17 Production Example)

A toner particle 17 was obtained proceeding as in the Toner Particle 1 Production Example, but making the following changes in the Toner Particle 1 Production Example: at the point of establishing a pH of 8.0 by the addition of 10.0 mass parts of the 1.0 mol/L aqueous sodium hydroxide solution, this 10.0 mass parts of the 1.0 mol/L aqueous sodium hydroxide solution was changed to 15.0 mass parts of the 1.0 mol/L aqueous sodium hydroxide solution and the pH of 8.0 was thus changed to a pH of 9.0; and the pH was adjusted to 5.1 by the addition of hydrochloric acid after the completion of reaction 2. The formulation and conditions for toner particle 17 are shown in Table 2, while the properties of toner particle 17 are shown in Table 6. Silicon mapping was performed in the TEM observation of toner particle 17, and the uniform presence of silicon atoms at the surface layer was found, thus confirming that a coat layer formed by attachment among particulate masses was not present.

(Toner Particle 18 Production Example)

A toner particle 18 was obtained proceeding as in the Toner Particle 1 Production Example, but changing the 10.0 mass parts of methyltriethoxysilane used in the Toner Particle 1 Production Example over to 5.0 mass parts of methyltriethoxysilane and 5.0 mass parts of ethyltriethoxysilane. The formulation and conditions for toner particle 18 are shown in Table 2, while the properties of toner particle 18 are shown in Table 6. Silicon mapping was performed in the TEM observation of toner particle 18, and the uniform presence of silicon atoms at the surface layer was found, thus confirming that a coat layer formed by attachment among particulate masses was not present.

(Toner Particle 19 Production Example)

A toner particle 19 was obtained proceeding as in the Toner Particle 1 Production Example, but changing the 10.0 mass parts of methyltriethoxysilane used in the Toner Particle 1 Production Example over to 7.5 mass parts of methyltriethoxysilane and 2.5 mass parts of tetraethoxysilane. The formulation and conditions for toner particle 19 are shown in Table 2, while the properties of toner particle 19 are shown in Table 6. Silicon mapping was performed in the TEM observation of toner particle 19, and the uniform presence of silicon atoms at the surface layer was found, thus confirming that a coat layer formed by attachment among particulate masses was not present.

(Toner Particle 20 Production Example)

A toner particle 20 was obtained proceeding as in the Toner Particle 1 Production Example, but changing the 10.0 mass parts of methyltriethoxysilane used in the Toner Particle 1 Production Example over to 5.0 mass parts of methyltriethoxysilane and 5.0 mass parts of methyltrimethoxysilane. The formulation and conditions for toner particle 20 are shown in Table 2, while the properties of toner particle 20 are shown in Table 6. Silicon mapping was performed in the TEM observation of toner particle 20, and the uniform presence of silicon atoms at the surface layer was found, thus confirming that a coat layer formed by attachment among particulate masses was not present.

(Toner Particle 21 Production Example)

A toner particle 21 was obtained proceeding as in the Toner Particle 1 Production Example, except that raising the temperature to 95° C. and holding for 10 hours was used rather than the temperature elevation to 90° C. and holding for 7.5 hours used in the Toner Particle 1 Production Example. The formulation and conditions for toner particle 21 are shown in Table 3, while the properties of toner particle 21 are shown in Table 7. Silicon mapping was performed in the TEM observation of toner particle 21, and the uniform presence of silicon atoms at the surface layer was found, thus confirming that a coat layer formed by attachment among particulate masses was not present.

(Toner Particle 22 Production Example)

A toner particle 22 was obtained proceeding as in the Toner Particle 1 Production Example, except that raising the temperature to 100° C. and holding for 10 hours was used rather than the temperature elevation to 90° C. and holding for 7.5 hours used in the Toner Particle 1 Production Example. The formulation and conditions for toner particle 22 are shown in Table 3, while the properties of toner particle 22 are shown in Table 7. Silicon mapping was performed in the TEM observation of toner particle 22, and the uniform presence of silicon atoms at the surface layer was found, thus confirming that a coat layer formed by attachment among particulate masses was not present.

(Toner Particle 23 Production Example)

(Production of Toner Base Particle 23)

| | |
|---|---|
| polyester resin (1) | 60.0 mass parts |
| polyester resin (2) | 40.0 mass parts |
| copper phthalocyanine pigment (Pigment Blue 15:3) | 6.5 mass parts |
| charge control agent 1 (aluminum compound of 3,5-di-tert-butylsalicylic acid) | 0.5 mass parts |
| charge control resin 1 | 0.6 mass parts |
| release agent (behenyl behenate, melting point: 72.1° C.) | 10.0 mass parts |

These materials were mixed with a Henschel mixer and then melt-kneaded at 135° C. using a twin-screw kneading extruder. After the kneadate had been cooled, it was coarsely pulverized with a cutter mill and then pulverized with a jet airflow-based pulverizer and classified using an air classifier to yield the toner base particle 23 having a weight-average particle diameter of 5.6 μm.

(Production of Toner Particle 23)

700 mass parts of ion-exchanged water, 1000 mass parts of a 0.1 mol/L aqueous $Na_3PO_4$ solution, and 24.0 mass parts of a 1.0 mol/L aqueous HCl solution were introduced into a four-neck vessel fitted with a Liebig reflux condenser and were held at 60° C. while stirring at 12,000 rpm with a TK-Homomixer high-speed stirrer. To this was gradually added 85 mass parts of a 1.0 mol/L aqueous $CaCl_2$ solution to produce an aqueous dispersion medium containing $Ca_3(PO_4)_2$ as a finely divided sparingly water-soluble dispersion stabilizer.

100.0 mass parts of the toner base particle 23 and 10.0 mass parts of methyltriethoxysilane were then mixed in a Henschel mixer, followed by the introduction of the toner material while stirring at 5,000 rpm with the TK-Homomixer and stirring for 5 minutes.

This mixture was then held for 5 hours at 70° C. The pH was 5.1. The pH was then brought to 8.0 by the addition of 10.0 mass parts of a 1.0 mol/L aqueous sodium hydroxide solution, after which the temperature was raised to 90° C. and holding was carried out for 7.5 hours. After this, the pH was brought to 5.1 by the addition of 4.0 mass parts of 10% hydrochloric acid and 50 mass parts of ion-exchanged water. 300 mass parts of ion-exchanged water was added and the reflux condenser was detached and a distillation apparatus was attached. Distillation was performed for 5 hours at a temperature in the vessel of 100° C. to obtain a polymer slurry 23. The distilled-out fraction was 320 mass parts. The dispersion stabilizer was removed by the addition of dilute hydrochloric acid to the vessel containing the polymer slurry 23. Filtration, washing, and drying then yielded toner particles having a weight-average particle diameter of 5.6 μm. These toner particles were designated toner particle 23. The formulation and conditions for toner particle 23 are shown in Table 3, while the properties of toner particle 23 are shown in Table 7. Silicon mapping was performed in the TEM observation of toner particle 23, and the uniform presence of silicon atoms at the surface layer was found, thus confirming that a coat layer formed by attachment among particulate masses was not present.

(Toner Particle 24 Production Example)

| | |
|---|---|
| polyester resin (1) | 60.0 mass parts |
| polyester resin (2) | 40.0 mass parts |
| copper phthalocyanine pigment (Pigment Blue 15:3) | 6.5 mass parts |
| charge control agent 1 (aluminum compound of 3,5-di-tert-butylsalicylic acid) | 0.5 mass parts |
| charge control resin 1 | 0.4 mass parts |
| methyltriethoxysilane | 10.0 mass parts |
| release agent (behenyl behenate, melting point: 72.1° C.) | 10.0 mass parts |

A solution was prepared by dissolving these materials in 400 mass parts toluene.

700 mass parts of ion-exchanged water, 1000 mass parts of a 0.1 mol/L aqueous $Na_3PO_4$ solution, and 24.0 mass parts of a 1.0 mol/L aqueous HCl solution were introduced into a four-neck vessel fitted with a Liebig reflux condenser and were held at 60° C. while stirring at 12,000 rpm with a TK-Homomixer high-speed stirrer. To this was gradually added 85 mass parts of a 1.0 mol/L aqueous $CaCl_2$ solution to produce an aqueous dispersion medium containing $Ca_3(PO_4)_2$ as a finely divided sparingly water-soluble dispersion stabilizer.

100 mass parts of the aforementioned solution was then introduced while stirring at 12,000 rpm with the TK-Homomixer and stirring was carried out for 5 minutes. This mixture was then held for 5 hours at 70° C. The pH was 5.1. The pH was then brought to 8.0 by the addition of 10.0 mass parts of a 1.0 mol/L aqueous sodium hydroxide solution, after which the temperature was raised to 90° C. and holding was carried out for 7.5 hours. After this, the pH was brought to 5.1 by the addition of 4.0 mass parts of 10% hydrochloric acid and 50 mass parts of ion-exchanged water. 300 mass parts of ion-exchanged water was added and the reflux condenser was detached and a distillation apparatus was attached. Distillation was performed for 5 hours at a temperature in the vessel of 100° C. to obtain a polymer slurry 24. The distilled-out fraction was 320 mass parts. The dispersion stabilizer was removed by the addition of dilute hydrochloric acid to the vessel containing the polymer slurry 24. Filtration, washing, and drying then yielded toner particles having a weight-average particle diameter of 5.6 μm. These toner particles were designated toner particle 24. The formulation and conditions for toner particle 24 are shown in Table 3, while the properties of toner particle 24 are shown in Table 7. Silicon mapping was performed in the TEM observation of toner particle 24, and the uniform presence of silicon atoms at the surface layer was found, thus confirming that a coat layer formed by attachment among particulate masses was not present.

(Toner Particle 25 Production Example)

(Synthesis of Amorphous Polyester Resin (1))

| | |
|---|---|
| bisphenol A/2 mol ethylene oxide adduct | 9 mol parts |
| bisphenol A/2 mol propylene oxide adduct | 95 mol parts |
| terephthalic acid | 50 mol parts |

-continued

| | |
|---|---|
| fumaric acid | 30 mol parts |
| dodecenylsuccinic acid | 25 mol parts |

These monomers were introduced into a flask fitted with a stirring apparatus, a nitrogen introduction tube, a temperature sensor, and a rectification column; the temperature was raised to 195° C. in 1 hour; and it was confirmed that the reaction system interior was being uniformly stirred. 1.0 mass % of tin distearate, considered with reference to the total mass of these monomers, was added. While distilling out the produced water, the temperature was raised over 5 hours from 195° C. to 250° C. and a dehydration condensation reaction was run for an additional 2 hours at 250° C. As a result, an amorphous polyester resin (1) was obtained that had a glass transition temperature of 60.2° C., an acid value of 13.8 mg KOH/g, a hydroxyl value of 28.2 mg KOH/g, a weight-average molecular weight of 14,200, a number-average molecular weight of 4,100, and a softening point of 111° C.

(Synthesis of Amorphous Polyester Resin (2))

| | |
|---|---|
| bisphenol A/2 mol ethylene oxide adduct (2 mol adduct with both terminals substituted) | 48 mol parts |
| bisphenol A/2 mol propylene oxide adduct (2 mol adduct with both terminals substituted) | 48 mol parts |
| terephthalic acid | 65 mol parts |
| dodecenylsuccinic acid | 30 mol parts |

These monomers were introduced into a flask fitted with a stirring apparatus, a nitrogen introduction tube, a temperature sensor, and a rectification column; the temperature was raised to 195° C. in 1 hour; and it was confirmed that the reaction system interior was being uniformly stirred. 0.7 mass % of tin distearate, considered with reference to the total mass of these monomers, was added. While distilling out the produced water, the temperature was raised over 5 hours from 195° C. to 240° C. and a dehydration condensation reaction was run for an additional 2 hours at 240° C. The temperature was then reduced to 190° C.; 5 mol parts trimellitic anhydride was gradually introduced; and the reaction was continued for 1 hour at 190° C. As a result, an amorphous polyester resin (2) was obtained that had a glass transition temperature of 55.2° C., an acid value of 14.3 mg KOH/g, a hydroxyl value of 24.1 mg KOH/g, a weight-average molecular weight of 53,600, a number-average molecular weight of 6,000, and a softening point of 108° C.

(Production of Resin Particle Dispersion (1))

| | |
|---|---|
| amorphous polyester resin (1) | 100 mass parts |
| methyl ethyl ketone | 50 mass parts |
| isopropyl alcohol | 20 mass parts |

The methyl ethyl ketone and isopropyl alcohol were introduced into a vessel. This was followed by the gradual introduction of the indicated resin and stirring; complete dissolution was carried out to obtain a solution of the amorphous polyester resin (1). The vessel holding this amorphous polyester solution was brought to 65° C., and, while stirring, a 10% aqueous ammonia solution was gradually added dropwise to provide a total of 5 mass parts and 230 mass parts of ion-exchanged water was additionally gradually added dropwise at the rate of 10 mL/minute to bring about phase inversion emulsification. Solvent removal was then performed under reduced pressure on an evaporator to obtain a resin particle dispersion (1) of the amorphous polyester resin (1). The volume-average particle diameter of the resin particles was 135 nm. The resin particle solids fraction was brought to 20% by adjusting with ion-exchanged water.

(Production of Resin Particle Dispersion (2))

| | |
|---|---|
| amorphous polyester resin (2) | 100 mass parts |
| methyl ethyl ketone | 50 mass parts |
| isopropyl alcohol | 20 mass parts |

The methyl ethyl ketone and isopropyl alcohol were introduced into a vessel. This was followed by the gradual introduction of the indicated resin and stirring; complete dissolution was carried out to obtain a solution of the amorphous polyester resin (2). The vessel holding this solution of the amorphous polyester resin (2) was brought to 40° C., and, while stirring, a 10% aqueous ammonia solution was gradually added dropwise to provide a total of 3.5 mass parts and 230 mass parts of ion-exchanged water was additionally gradually added dropwise at the rate of 10 mL/minute to bring about phase inversion emulsification. Solvent removal was then performed under reduced pressure to obtain a resin particle dispersion (2) of the amorphous polyester resin (2). The volume-average particle diameter of the resin particles was 155 nm. The resin particle solids fraction was brought to 20% by adjusting with ion-exchanged water.

(Production of a Sol-gel Solution of the Resin Particle Dispersion (1))

20.0 mass parts of methyltriethoxysilane was added to 100 mass parts of the resin particle dispersion (1) (solids fraction=20.0 mass parts) and, while stirring, holding was carried out for 1 hour at 70° C. followed by raising the temperature at a ramp rate of 20° C./1 hour and holding for 3 hours at 95° C. This was followed by cooling to obtain a sol-gel solution of the resin particle dispersion (1), in which the resin fine particles were coated by a sol-gel. The volume-average particle diameter of the resin particles was 210 nm. The resin particle solids fraction was brought to 20% by adjusting with ion-exchanged water. This sol-gel solution of the resin particle dispersion (1) was stored at or below 10° C. while stirring and was used within 48 hours after preparation. The particle surface preferably resides in the state of a high-viscosity sol or gel because this provides an excellent adhesiveness among the particles.

(Production of Colorant Particle Dispersion 1)

| | |
|---|---|
| copper phthalocyanine (Pigment Blue 15:3) | 45 mass parts |
| Neogen RK (ionic surfactant) (Dai-ichi Kogyo Seiyaku Co., Ltd.) | 5 mass parts |
| ion-exchanged water | 190 mass parts |

These components were mixed and were dispersed for 10 minutes using an homogenizer (Ultra-Turrax from IKA) and were then subjected to dispersion processing for 20 minutes at a pressure of 250 MPa using an Altimizer (countercurrent collision wet-type pulverizer: from Sugino Machine Limited) to obtain a colorant particle dispersion 1 having a solids fraction of 20% and a volume-average particle diameter for the colorant particles of 120 nm.

(Production of a Release Agent Particle Dispersion)

| | |
|---|---|
| olefin wax (melting point: 84° C.) | 60 mass parts |
| Neogen RK (ionic surfactant) (Dai-ichi Kogyo Seiyaku Co., Ltd.) | 2.0 mass parts |
| ion-exchanged water | 240 mass parts |

The preceding were heated to 100° C. and thoroughly dispersed in an Ultra-Turrax T50 from IKA and subsequently subjected to dispersion processing, using a pressure ejection-type Gaulin homogenizer, for 1 hour heated to 115° C. to obtain a release agent particle dispersion having a solids fraction of 20% and a volume-average particle diameter of 160 nm.

(Toner Particle 25 Production)

| | |
|---|---|
| resin particle dispersion (1) | 100 mass parts |
| resin particle dispersion (2) | 300 mass parts |
| sol-gel solution of resin particle dispersion (1) | 300 mass parts |
| colorant particle dispersion 1 | 50 mass parts |
| release agent particle dispersion | 50 mass parts |

After the introduction of 2.2 mass parts of Neogen RK ionic surfactant, the materials listed above were stirred in a flask. The pH was subsequently brought to 3.7 by the dropwise addition of a 1 mol/L aqueous nitric acid solution and 0.35 mass parts of polyaluminum sulfate was then added and dispersion was carried out using an Ultra-Turrax from IKA. Heating to 50° C. was performed while stirring the flask on a hot oil bath. After holding for 40 minutes at 50° C., 300 mass parts of the sol-gel solution of resin particle dispersion (1) mixture was gently added. The pH within the system was subsequently brought to 7.0 by the addition of a 1 mol/L aqueous sodium hydroxide solution; the stainless steel flask was sealed; and while stirring gradual heating to 90° C. was carried out and holding for 5 hours at 90° C. was performed. Holding for 7.5 hours at 95° C. was also performed. 2.0 mass parts of Neogen RK ionic surfactant was then added and a reaction was run for 5 hours at 100° C. After the completion of the reaction, a 320 mass part fraction was recovered at 85° C. by reduced-pressure distillation. This was followed by cooling, filtration, and drying. Redispersion in 5 L of 40° C. ion-exchanged water was carried out and stirring with a stirring blade (300 rpm) for 15 minutes and then filtration were performed.

This washing by redispersion and filtration was repeated, and washing was ended when the electrical conductivity reached 6.0 μS/cm or less to yield the toner particle 25. The formulation and conditions for toner particle 25 are shown in Table 3, while the properties of toner particle 25 are shown in Table 7. Silicon mapping was performed in the TEM observation of toner particle 25, and the uniform presence of silicon atoms at the surface layer was found, thus confirming that a coat layer formed by attachment among particulate masses was not present.

(Toner Particle 26 Production Example)

While stirring in a Henschel mixer, 100.0 mass parts of toner base particle 23 was sprayed and mixed to uniformity with 3.5 mass parts of an organosilicon polymer solution that had been prepared by reacting 10.0 mass parts toluene, 5.0 mass parts ethanol, 5.0 mass parts water, and 10.0 mass parts methyltriethoxysilane for 5 hours at 90° C.

Drying and polymerization were carried out by circulating the particles for 30 minutes in a fluidized-bed drier at an inlet temperature of 90° C. and an outlet temperature of 45° C. Proceeding in the same manner, the resulting treated toner was sprayed in a Henschel mixer with 3.5 mass parts of the aforementioned organosilicon polymer solution per 100 mass parts of the treated toner, and circulation within a fluidized-bed drier was performed for 30 minutes at an inlet temperature of 90° C. and an outlet temperature of 45° C.

The same spraying with the organosilicon polymer solution and drying was repeated for a total of 10 times to obtain the toner particle 26. Silicon mapping was performed in the TEM observation of toner particle 26, and the uniform presence of silicon atoms at the surface layer was found, thus confirming that a coat layer formed by attachment among particulate masses was not present.

(Toner Particle 27 Production Example)

A toner particle 27 was obtained proceeding as in the Toner Particle 1 Production Example, but changing the 6.5 mass parts of copper phthalocyanine used in the Toner Particle 1 Production Example to 10.0 mass parts of carbon black. The formulation and conditions for toner particle 27 are shown in Table 3, while the properties of toner particle 27 are shown in Table 7. Silicon mapping was performed in the TEM observation of toner particle 27, and the uniform presence of silicon atoms at the surface layer was found, thus confirming that a coat layer formed by attachment among particulate masses was not present.

(Toner Particle 28 Production Example)

A toner particle 28 was obtained proceeding as in the Toner Particle 1 Production Example, but changing the 70.0 mass parts of styrene used in the Toner Particle 1 Production Example to 60.0 mass parts, changing the 30.0 mass parts of n-butyl acrylate to 40.0 mass parts, and adding 1.0 mass part of titanium tetra-normal-propoxide. The formulation and conditions for toner particle 28 are shown in Table 3, while the properties of toner particle 28 are shown in Table 7. Silicon mapping was performed in the TEM observation of toner particle 28, and the uniform presence of silicon atoms at the surface layer was found, thus confirming that a coat layer formed by attachment among particulate masses was not present.

(Toner Particle 29 Production Example)

A toner particle 29 was obtained proceeding as in the Toner Particle 1 Production Example, but changing the 6.5 mass parts of copper phthalocyanine (Pigment Blue 15:3) used in the Toner Particle 1 Production Example to 8.0 mass parts of Pigment Red 122 (P.R. 122). The formulation and conditions for toner particle 29 are shown in Table 3, while the properties of toner particle 29 are shown in Table 7. Silicon mapping was performed in the TEM observation of toner particle 29, and the uniform presence of silicon atoms at the surface layer was found, thus confirming that a coat layer formed by attachment among particulate masses was not present.

(Toner Particle 30 Production Example)

A toner particle 30 was obtained proceeding as in the Toner Particle 1 Production Example, but changing the 6.5 mass parts of copper phthalocyanine (Pigment Blue 15:3) used in the Toner Particle 1 Production Example to 6.0 mass parts of Pigment Yellow 155 (P.Y. 155). The formulation and conditions for toner particle 30 are shown in Table 3, while the properties of toner particle 30 are shown in Table 7. Silicon mapping was performed in the TEM observation of toner particle 30, and the uniform presence of silicon atoms at the surface layer was found, thus confirming that a coat layer formed by attachment among particulate masses was not present.

(Comparative Toner Particle 1 Production Example)

A comparative toner particle 1 was obtained proceeding as in the Toner Particle 1 Production Example, but changing the 10.0 mass parts of methyltriethoxysilane used in the Toner Particle 1 Production Example over to 1.0 mass part of methyltriethoxysilane. The formulation and conditions for comparative toner particle 1 are shown in Table 4, while the properties of comparative toner particle 1 are shown in Table 8. Silicon mapping was performed in the TEM observation of comparative toner particle 1, and few silicon atoms were found to be present at the surface layer.

(Comparative Toner Particle 2 Production Example)

A comparative toner particle 2 was obtained proceeding as in the Comparative Toner Particle 1 Production Example, but changing the 1.0 mass part of methyltriethoxysilane used in the Comparative Toner Particle 1 Production Example over to 10.0 mass parts of tetraethoxysilane. The formulation and conditions for comparative toner particle 2 are shown in Table 4, while the properties of comparative toner particle 2 are shown in Table 8. Silicon mapping was performed in the TEM observation of comparative toner particle 2, and silicon atoms were found to be present at the surface layer, but not uniformly.

(Comparative Toner Particle 3 Production Example)

A comparative toner particle 3 was obtained proceeding as in the Comparative Toner Particle 1 Production Example, but changing the 1.0 mass part of methyltriethoxysilane used in the Comparative Toner Particle 1 Production Example over to 10.0 mass parts of 3-methacryloxypropyltriethoxysilane. The formulation and conditions for comparative toner particle 3 are shown in Table 4, while the properties of comparative toner particle 3 are shown in Table 8. Silicon mapping was performed in the TEM observation of comparative toner particle 3, and few silicon atoms were found to be present at the surface layer.

(Comparative Toner Particle 4 Production Example)

A comparative toner particle 4 was obtained proceeding as in the Comparative Toner Particle 1 Production Example, but making the following changes: the 1.0 mass part of methyltriethoxysilane used in the Comparative Toner Particle 1 Production Example was changed over to 10.0 mass parts of 3-methacryloxypropyltriethoxysilane; at the point of raising the temperature in the vessel to 90° C. and holding for 7.5 hours, the temperature of 90° C. was changed to 70° C.; and at the point of raising the internal temperature to 100° C., the internal temperature was changed to 70° C. The formulation and conditions for comparative toner particle 4 are shown in Table 4, while the properties of comparative toner particle 4 are shown in Table 8. Silicon mapping was performed in the TEM observation of comparative toner particle 4, and few silicon atoms were found to be present at the surface layer.

(Comparative Toner Particle 5 Production Example)

A comparative toner particle 5 was obtained proceeding as in the Comparative Toner Particle 1 Production Example, but making the following changes: the 1.0 mass part of methyltriethoxysilane used in the Comparative Toner Particle 1 Production Example was changed over to 10.0 mass parts of 3-methacryloxypropyltriethoxysilane; at the point of raising the temperature in the vessel to 70° C., the internal temperature was changed to 80° C.; at the point of raising the temperature in the vessel to 90° C. and holding for 7.5 hours, the temperature was changed to 80° C.; and at the point of raising the internal temperature to 100° C., the internal temperature was changed to 80° C. The formulation and conditions for comparative toner particle 5 are shown in Table 4, while the properties of comparative toner particle 5 are shown in Table 8. Silicon mapping was performed in the TEM observation of comparative toner particle 5, and few silicon atoms were found to be present at the surface layer.

(Comparative Toner Particle 6 Production Example)

A comparative toner particle 6 was obtained proceeding as in the Comparative Toner Particle 1 Production Example, but changing the 1.0 mass part of methyltriethoxysilane used in the Comparative Toner Particle 1 Production Example over to 3.1 mass parts of 3-methacryloxypropyltriethoxysilane. The formulation and conditions for comparative toner particle 6 are shown in Table 4, while the properties of comparative toner particle 6 are shown in Table 8. Silicon mapping was performed in the TEM observation of comparative toner particle 6, and few silicon atoms were found to be present at the surface layer.

(Comparative Toner Particle 7 Production Example)

A comparative toner particle 7 was obtained proceeding as in the Comparative Toner Particle 1 Production Example, but making the following changes: the 1.0 mass part of methyltriethoxysilane used in the Comparative Toner Particle 1 Production Example was changed over to 2.0 mass parts of methyltriethoxysilane; at the point of raising the temperature in the vessel to 90° C., the internal temperature was changed to 70° C.; and at the point of raising the temperature in the vessel to 100° C., the internal temperature was changed to 70° C. The formulation and conditions for comparative toner particle 7 are shown in Table 4, while the properties of comparative toner particle 7 are shown in Table 8. Silicon mapping was performed in the TEM observation of comparative toner particle 7, and few silicon atoms were found to be present at the surface layer.

(Comparative Toner Particle 8 Production Example)

A comparative toner particle 8 was obtained proceeding as in the Comparative Toner Particle 1 Production Example, but making the following changes: the 1.0 mass part of methyltriethoxysilane used in the Comparative Toner Particle 1 Production Example was changed over to 2.0 mass parts of methyltriethoxysilane; at the point of raising the temperature in the vessel to 70° C., the internal temperature was changed to 55° C.; at the point of raising the temperature in the vessel to 90° C., the internal temperature was changed to 70° C.; and at the point of raising the temperature in the vessel to 100° C., the temperature was changed to 70° C. The formulation and conditions for comparative toner particle 8 are shown in Table 4, while the properties of comparative toner particle 8 are shown in Table 8. Silicon mapping was performed in the TEM observation of comparative toner particle 8, and few silicon atoms were found to be present at the surface layer.

(Comparative Toner Particle 9 Production Example)

A comparative toner particle 9 was obtained proceeding as in the Comparative Toner Particle 1 Production Example, but changing the 1.0 mass part of methyltriethoxysilane used in the Comparative Toner Particle 1 Production Example over to 11.0 mass parts of aminopropyltrimethoxysilane. The formulation and conditions for comparative toner particle 9 are shown in Table 4, while the properties of comparative toner particle 9 are shown in Table 8. Silicon mapping was performed in the TEM observation of comparative toner particle 9, and few silicon atoms were found to be present at the surface layer.

(Comparative Toner Particle 10 Production Example)

A comparative toner particle 10 was obtained proceeding as in the Comparative Toner Particle 1 Production Example, but changing the 1.0 mass part of methyltriethoxysilane used in the Comparative Toner Particle 1 Production Example over to 0.0 mass parts. The formulation and conditions for comparative toner particle 10 are shown in Table 4, while the properties of comparative toner particle 10 are shown in Table 8. While silicon mapping was performed in the TEM observation of comparative toner particle 10, silicon atoms were not present at the surface layer.

(Comparative Toner Particle 11 Production Example)

900 mass parts of ion-exchanged water and 95 mass parts of a polyvinyl alcohol were added to a four-neck flask fitted with a TK-Homomixer high-speed stirrer, and an aqueous dispersion medium was made by heating to 55° C. while stirring at 1300 rpm.

(Composition of the Monomer Dispersion)

| | |
|---|---|
| styrene | 70.0 mass parts |
| n-butyl acrylate | 30.0 mass parts |
| carbon black | 10.0 mass parts |
| release agent (behenyl behenate, melting point: 72.1° C.) | 10.0 mass parts |

These materials were dispersed for 3 hours with an attritor, followed by the addition of 14.0 mass parts of the polymerization initiator t-butyl peroxypivalate to produce a monomer dispersion.

The obtained monomer dispersion was introduced into the dispersion medium in the four-neck flask, and granulation was performed for 10 minutes while maintaining the rotation rate indicated above. A polymerization was then run while stirring at 50 rpm for 1 hour at 55° C., then 4 hours at 65° C., and then 5 hours at 80° C. After the completion of this polymerization, the slurry was cooled and the dispersing agent was removed by repeatedly washing with pure water. A black toner base particle was obtained by additional washing and drying. Its weight-average particle diameter was 5.7 μm.

3 mass parts of a 0.3 mass % sodium dodecylbenzenesulfonate solution was introduced into a solution prepared by mixing 2 mass parts isoamyl acetate and 4.0 mass parts tetraethoxysilane and 0.5 mass parts methyltriethoxysilane as silicon compounds, and stirring using an ultrasound homogenizer was then performed to produce a silane mixed solution A of isoamyl acetate, tetraethoxysilane, and methyltriethoxysilane.

A black toner particle dispersion A was prepared by the addition of 1.0 mass part of the black toner base particle to 30 mass parts of a 0.3 mass % aqueous sodium dodecylbenzenesulfonate solution. The silane mixed solution A was then introduced into the black toner particle dispersion A; 5 mass parts of a 30 mass % aqueous $NH_4OH$ solution was subsequently introduced; and a reaction was run by stirring for 15 hours at room temperature (25° C.). The resulting reaction product was washed with ethanol and then washed with pure water and the particles were filtered off and dried to obtain a comparative toner particle 11. The weight-average particle diameter of the obtained toner particles was 5.6 μm. When silicon mapping was performed in the TEM observation of comparative toner particle 11, it was confirmed that few silicon atoms were present and were present in a coat layer formed by attachment among particulate masses.

(Toner 1 Production Example)

The following were mixed with 100 mass parts of toner particle 1 using a Henschel mixer (Mitsui Mining Co., Ltd., now Nippon Coke & Engineering Co., Ltd.), and the obtained toner was designated toner 1: 0.1 mass parts of an aluminum oxide that had a specific surface area by the BET method of 50 $m^2/g$ and 0.3 mass parts of a hydrophobic silica that had a specific surface area by the BET method of 200 $m^2/g$ and that had been provided by a hydrophobic treatment of its surface with 3.0 mass % of hexamethyldisilazane and 3 mass % of 100 cps silicone oil.

(Toner 2 to 30 Production Examples)

Toners 2 to 30 were obtained proceeding as in the Toner 1 Production Example, but using toner particles 2 to 30 in place of the toner particle 1 used in the Toner 1 Production Example.

(Comparative Toner 1 to 11 Production Examples)

Comparative toners 1 to 11 were obtained proceeding as in the Toner 1 Production Example, but using comparative toner particles 1 to 11 in place of the toner particle 1 used in the Toner 1 Production Example.

(Evaluation of the Properties of Toner 1 after Washing)

160 g of sucrose (Kishida Chemical Co., Ltd.) was added to 100 mL of ion-exchanged water and was dissolved on a hot water bath to prepare a sucrose concentrate. A dispersion was prepared by introducing 31.0 g of this sucrose concentrate and 6 mL of Contaminon N (product name) (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) into a centrifugal separation tube. 1.0 g of the toner was added to this dispersion and any lumps in the toner were broken up with, for example, a spatula.

The centrifugal separation tube was shaken for 20 minutes at 350 spm (strokes per minute) with a shaker. After this shaking, the solution was transferred over to a glass tube (50 mL) for a swing rotor and separation was then carried out at 3500 rpm/30 minutes using a centrifugal separator. Upon visually confirming a thorough separation of the toner and the aqueous solution, the toner separated into the top layer was recovered with, for example, a spatula. The recovered toner was filtered using a vacuum filtration device and was then dried for at least 1 hour in a drier. The dried material was crushed with a spatula to obtain washed toner particle 1.

When the obtained washed toner particle 1 was dried and its properties were measured, the results for washed toner particle 1 were about the same as the results for the toner properties for toner particle 1.

(Evaluation of the Properties of Toners 2 to 30 after Washing and Evaluation of the Properties of Comparative Toners 1 to 11 after Washing)

The properties after washing were evaluated proceeding as for the evaluation of the properties of toner 1 post-washing, but using toner N(N=2 to 30) or comparative toner M (M=1 to 11) in place of toner 1. For each of washed toner particle N and washed comparative toner particle M, the results were about the same as the results (Tables 5 to 8) for the toner properties for toner particle N and comparative toner particle M, respectively.

Example 1

The following evaluations were carried out using toner 1. The results of these evaluations are given in Table 13.

(Evaluation of the Environmental Stability and Development Durability)

Figure 4:
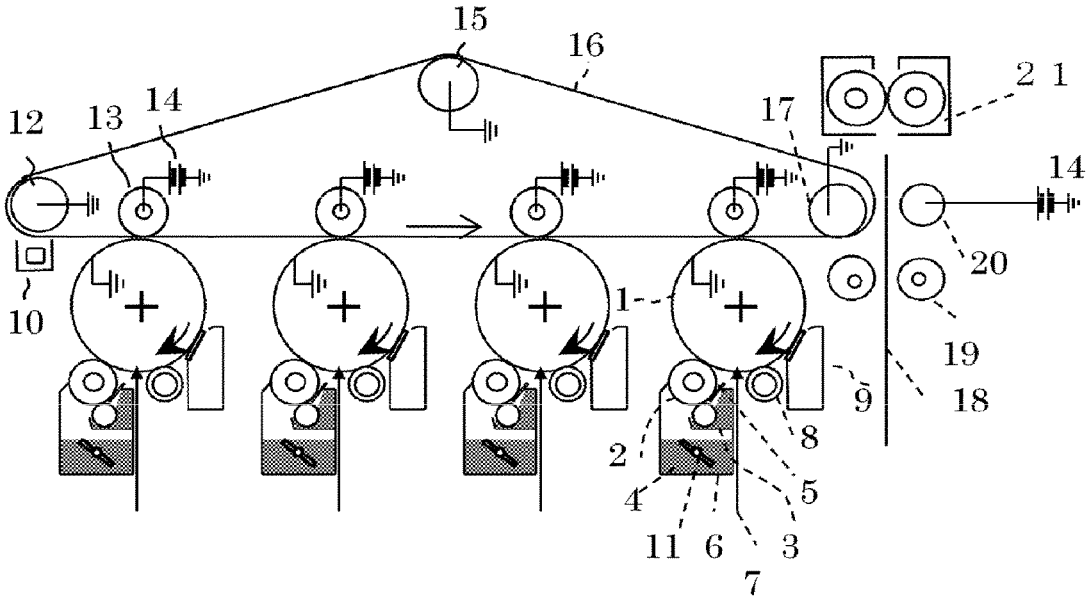
FIG. 4 is a schematic structural diagram that shows an example of an image-forming apparatus used by the present invention.

220 g of toner 1 was filled into a toner cartridge from an LBP9600C, a tandem mode laser printer from Canon, Inc., having the structure as shown in FIG. 4.

In FIG. 4, 1 represents a photosensitive member, 2 represents a developing roller, 3 represents a toner supplying roller, 4 represents a toner, 5 represents a regulating blade, 6 represents a developing assembly, 7 represents a laser light, 8 represents a charging assembly, 9 represents a cleaning assembly, 10 represents a charging assembly for cleaning, 11 represents a stirring blade, 12 represents a driver roller, 13 represents a transfer roller, 14 represents a bias supply, 15 represents a tension roller, 16 represents a transfer and transport belt, 17 represents a driven roller, 18 represents a paper, 19 represents a paper supplying roller, 20 represents an attracting roller, and 21 represents a fixing apparatus.

This toner cartridge was held for 24 hours in a low temperature, low humidity environment L/L (temperature=10° C./humidity=15% RH), a normal temperature, normal humidity environment N/N (25° C./50% RH), or a high temperature, high humidity environment H/H (32.5° C./85% RH). After standing for 24 hours in the particular environment, the toner cartridge was installed in the LBP9600C and 1,000 prints of an image with a print percentage of 35.0% were made on widthwise A4 paper, and the following were evaluated: the solid image density (toner laid-on amount=0.40 mg/cm$^2$) and fogging, both initially and after the output of the 1,000 prints, and member contamination (filming, development stripes, toner fusion to the drum) after the output of the 1,000 prints.

In addition, 220 g of toner 1 was filled into a toner cartridge from an LBP9600C, a tandem mode laser printer from Canon, Inc., having the structure as shown in FIG. 4, and this toner cartridge was held for 168 hours in a severe environment (40° C./90% RH). This was followed by standing for 24 hours at a superhigh temperature and high humidity SHH (35.0° C./85% RH), after which 1,000 prints of an image with a print percentage of 35.0% were made and the following were evaluated: the initial solid image density (toner laid-on amount=0.40 mg/cm$^2$) and fogging, and member contamination (filming, development stripes, toner fusion to the drum) after the output of the 1,000 prints.

(Measurement of the Triboelectric Charge Quantity of the Toner Particles and Toners)

The triboelectric charge quantity of the toner particles and toners was determined using the following method.

The toner particles or toner and a standard carrier for a negative polarity toner (product name: N-01, from The Imaging Society of Japan) were first held for the prescribed period of time in the following environments, respectively.

Holding was carried out for 24 hours at a low temperature and low humidity (10° C./15% RH), 24 hours at normal temperature and normal humidity (25° C./50% RH), 24 hours at a high temperature and high humidity (32.5° C./85% RH), or 168 hours in a severe environment (40° C./90% RH) followed by 24 hours at a superhigh temperature and high humidity (35.0° C./85% RH). After this holding, a two-component developer was prepared by mixing the toner particles or toner and the standard carrier for 120 seconds in the particular environment using a Turbula mixer so as to bring the mass of the toner particle or toner to 5 mass %.

After this mixing, the two-component developer was then introduced in a normal temperature, normal humidity (25° C./50% RH) environment within 1 minute after the mixing into a metal container fitted at the bottom with an electroconductive screen having an aperture of 20 μm; suctioning with a suctioning device was carried out; and the difference in mass pre-versus-post-suctioning and the potential accumulated at a capacitor connected to the container were measured. The suction pressure used here was 4.0 kPa. The triboelectric charge quantity for the toner particles or toner was calculated using the following formula from the difference in mass pre-versus-post-suctioning, the accumulated potential, and the capacitance of the capacitor.

The standard carrier for a negative polarity toner (product name: N-01, from The Imaging Society of Japan) used in this measurement passed through a 250 mesh.

$$Q=(A\times B)/(W1-W2)$$

Q (mC/kg): triboelectric charge quantity for the toner particles or toner

A (μF): capacitance of the capacitor

B (V): potential difference accumulated at the capacitor

W1−W2 (kg): difference in mass pre-versus-post-suctioning (Evaluation of the Image Density)

For the image density, using a MacBeth densitometer (product name: RD-914, MacBeth Corporation) equipped with an SPI auxiliary filter, the image density was measured, both initially and after the output of 1,000 prints in a durability test, in the fixed image area of a solid image that was output in the previously described environment of a low temperature and low humidity (L/L) (10° C./15% RH) after holding for 24 hours, a normal temperature and normal humidity (N/N) (25° C./50% RH) after holding for 24 hours, a high temperature and high humidity (H/H) (32.5° C./85% RH) after holding for 24 hours, or a superhigh temperature and high humidity (35.0° C./85% RH) after holding for 24 hours after 168 hours in a severe environment (40° C./90% RH).

The following evaluation criteria are used for the image density. 70 g/m$^2$ A4 size was used for the transfer paper, and printing was done in the A4 width direction.

A: at least 1.45
B: at least 1.40 but less than 1.45
C: at least 1.30 but less than 1.40
D: at least 1.25 but less than 1.30
E: at least 1.20 but less than 1.25
F: less than 1.20

(Evaluation of the Fogging)

The fogging density (%) was calculated—both initially for an image with a 0% print percentage and for the 0% print percentage image after the output of 1,000 prints in a durability test—from the difference between the whiteness of the white background region of the output image and the whiteness of the transfer paper; the whiteness was measured using a "Reflectometer" (Tokyo Denshoku Co., Ltd.). This fogging density was evaluated as the image fogging using the following criteria. 70 g/m$^2$ A4 size was used for the transfer paper, and printing was done in the A4 width direction.

A: less than 1.0%
B: at least 1.0% but less than 1.5%
C: at least 1.5% but less than 2.0%
D: at least 2.0% but less than 2.5%
E: at least 2.5% but less than 3.0%
F: at least 3.0%

(Evaluation of Member Contamination)

After 1,000 prints had been output in a durability test, a mixed image was output, in which the front half was output as a halftone image (toner laid-on amount=0.25 mg/cm$^2$) and the back half was a solid image (toner laid-on amount=0.40 mg/cm$^2$), and an evaluation of member contamination was done using the following criteria. 70 g/m$^2$ A4 size was used for the transfer paper, and printing was done in the A4 width direction.

A: Vertical streaks in the discharge direction and points with different densities are not seen on the development roller or on the image in the halftone region or on the image in the solid region.

B: While 1 or 2 fine, circumferential streaks at the two ends of the development roller are present, or 1 to 3 melt-adhered masses are present on the photosensitive drum, vertical streaks in the discharge direction and points with different densities are not seen on the image in the halftone region or the image in the solid region.

C: While 3 to 5 fine, circumferential streaks at the two ends of the development roller are present, or 3 to 5 melt-adhered masses are present on the photosensitive drum, only a few vertical streaks in the discharge direction and/or points with different densities are seen on the image in the halftone region or the image in the solid region. However, these are at a level that can be erased by image processing.

D: 6 to 20 fine, circumferential streaks at the two ends of the development roller are present, or 6 to 20 melt-adhered masses are present on the photosensitive drum, and points with different densities and/or several fine streaks are also seen on the image in the halftone region or the image in the solid region. These are not erased by image processing.

E: At least 21 streaks and/or points with different densities are seen on the development roller and on the image in the halftone region. These are not erased by image processing.

(Evaluation of the Low-temperature Fixability (Cold Offset End Temperature))

The fixing unit of an LBP9600C laser printer from Canon, Inc., was modified to make its fixation temperature adjustable. Using the thusly modified LBP9600C, an unfixed toner image with a toner laid-on amount of 0.40 mg/cm$^2$ was oillessly hot-pressed to an image-receiving paper at a process speed of 230 mm/sec to form a fixed image on the image-receiving paper.

With regard to the fixability, the fixed image was rubbed 10 times under of load of 75 g/cm$^2$ using a Kimwipe (product name: S-200, Nippon Paper Crecia Co., Ltd.), and the cold offset end temperature was designated to be the temperature at which the percentage decline in the density pre-versus-post-rubbing was less than 5%. This evaluation was run at normal temperature and normal humidity (25° C./50% RH).

(Evaluation of the Storage Stability)

(Evaluation of the Storability)

10 g of toner 1 was placed in a 100 mL glass bottle and was held for 15 days at a temperature of 50° C. and a humidity of 20%, after which a visual evaluation was performed.

A: no change
B: aggregates are present, but are quickly broken up
C: break up-resistant aggregates are produced
D: flowability is absent
E: pronounced caking is produced (Evaluation of the Long-Term Storability)

10 g of toner 1 was placed in a 100 mL glass bottle and was held for 3 months at a temperature of 45° C. and a humidity of 95%, after which a visual evaluation was performed.

A: no change
B: aggregates are present, but are quickly broken up
C: break up-resistant aggregates are produced
D: flowability is absent
E: pronounced caking is produced Examples 2 to 30

The same evaluations as in Example 1 were performed using toners 2 to 30 in place of the toner 1 used in Example 1. These results are given in Tables 13, 14, and 15.

Comparative Examples 1 to 11

The same evaluations as in Example 1 were performed using comparative toners 1 to 11 in place of the toner 1 used in Example 1. These results are given in Table 16.

Example 31

The same evaluations as in Example 1 were performed using toner particle 1 in place of the toner 1 used in Example 1. These results are given in Table 15. The evaluation results for toner particle 1 were not inferior to the results for toner 1.

Example 32

240 g of toner 1 (cyan) was filled using a toner cartridge from an LBP9600C, a tandem mode laser printer from Canon, Inc., having the structure as shown in FIG. 4. 240 g of each of toner 27 (black), toner 29 (magenta), and toner 30 (yellow) was similarly filled into a separate toner cartridge for the LBP9600C. Such a four-color cartridge set was held for 24 hours in a low temperature, low humidity environment L/L (10° C./15% RH), a normal temperature, normal humidity environment N/N (25° C./50% RH), or a high temperature, high humidity environment H/H (32.5° C./85% RH). After standing for 24 hours in the particular environment, the cyan, black, magenta, and yellow cartridges were set in the LBP9600C and 1,000 prints of an image with a print percentage of 35.0% were made on widthwise A4 paper and the following were evaluated: the solid image density and fogging, both initially and after the output of the 1,000 prints, and member contamination (filming, development stripes, melt adhesion of toner to the photosensitive drum) after the output of the 1,000 prints. As a result, excellent results were obtained that were unproblematic from a practical standpoint.

In addition, 240 g of toner 1 (cyan) was filled using a toner cartridge from an LBP9600C, a tandem mode laser printer from Canon, Inc., having the structure as shown in FIG. 4. 240 g of each of toner 27 (black), toner 29 (magenta), and toner 30 (yellow) was similarly filled into a separate toner cartridge for the LBP9600C. This four-color cartridge set was held for 168 hours in a severe environment (40° C./90% RH). This was followed by standing for 24 hours at a superhigh temperature and high humidity SHH (35.0° C./85% RH), after which the cyan, black, magenta, and yellow cartridges were set in the LBP9600C and 1,000 prints of an image with a print percentage of 35.0% were made and the following were evaluated: the initial solid image density and fogging, and member contamination (filming, development stripes, melt adhesion of the toner to the photosensitive drum) after the output of the 1,000 prints. As a result, excellent results were obtained that were unproblematic from a practical standpoint.

TABLE 1

| | | | example 1 | example 2 | example 3 | example 4 | example 5 | example 6 | example 7 | example 8 | example 9 | example 10 |
|---|---|---|---|---|---|---|---|---|---|---|---|---|
| toner particle | | | toner particle 1 | toner particle 2 | toner particle 3 | toner particle 4 | toner particle 5 | toner particle 6 | toner particle 7 | toner particle 8 | toner particle 9 | toner particle 10 |
| monomer | styrene | mass parts | 70.0 | 70.0 | 70.0 | 70.0 | 70.0 | 70.0 | 70.0 | 70.0 | 70.0 | 70.0 |
| | n-butyl acrylate | mass parts | 30.0 | 30.0 | 30.0 | 30.0 | 30.0 | 30.0 | 30.0 | 30.0 | 30.0 | 30.0 |
| | divinyl benzene | mass parts | 0.0 | 0.0 | 0.0 | 0.0 | 0.0 | 0.0 | 0.0 | 0.0 | 0.0 | 0.0 |
| | silane | silane 1 | methyl triethoxy silane | phenyl trimethoxy silane | ethyl triethoxy silane | n-propyl triethoxy silane | n-butyl triethoxy silane | methyl triethoxy silane | methyl trimethoxy silane | methyl triisopropoxy silane | methyl diethoxy chlorosilane | methyl triethoxy silane |
| | | silane 1 mass part | 10.0 | 10.0 | 10.0 | 10.0 | 10.0 | 7.0 | 10.0 | 10.0 | 7.5 | 30.0 |
| | | silane 2 | — | — | — | — | — | vinyl trichloro silane | | — | — | — |
| | | silane 2 mass parts | — | — | — | — | — | 3.0 | | — | — | — |
| polyester resin | | type | (1) | (1) | (1) | (1) | (1) | (1) | (1) | (1) | (1) | (1) |
| | | mass parts | 4.0 | 4.0 | 4.0 | 4.0 | 4.0 | 4.0 | 4.0 | 4.0 | 4.0 | 4.0 |
| release agent | | type | behenyl behenate | behenyl behenate | behenyl behenate | behenyl behenate | behenyl behenate | behenyl behenate | behenyl behenate | behenyl behenate | behenyl behenate | behenyl behenate |
| | | mass parts | 10.0 | 10.0 | 10.0 | 10.0 | 10.0 | 10.0 | 10.0 | 10.0 | 10.0 | 10.0 |
| | | melting point (° C.) | 72.1 | 72.1 | 72.1 | 72.1 | 72.1 | 72.1 | 72.1 | 72.1 | 72.1 | 72.1 |
| | | heat absorption (J/g) | 210.3 | 210.3 | 210.3 | 210.3 | 210.3 | 210.3 | 210.3 | 210.3 | 210.3 | 210.3 |
| colorant | | type of colorant | copper phthalocyanine | copper phthalocyanine | copper phthalocyanine | copper phthalocyanine | copper phthalocyanine | copper phthalocyanine | copper phthalocyanine | copper phthalocyanine | copper phthalocyanine | copper phthalocyanine |
| | | mass parts | 6.5 | 6.5 | 6.5 | 6.5 | 6.5 | 6.5 | 6.5 | 6.5 | 6.5 | 6.5 |

TABLE 1-continued

| | | | example 1 | example 2 | example 3 | example 4 | example 5 | example 6 | example 7 | example 8 | example 9 | example 10 |
|---|---|---|---|---|---|---|---|---|---|---|---|---|
| charge control resin 1 | | mass parts | 0.4 | 0.4 | 0.4 | 0.4 | 0.4 | 0.4 | 0.4 | 0.4 | 0.4 | 0.4 |
| charge control agent 1 | | mass parts | 0.5 | 0.5 | 0.5 | 0.5 | 0.5 | 0.5 | 0.5 | 0.5 | 0.5 | 0.5 |
| oil-soluble initiator | type | | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate | t-butyl peroxy pivalate |
| | amount of addition | mass parts | 16.0 | 16.0 | 16.0 | 16.0 | 16.0 | 16.0 | 16.0 | 16.0 | 16.0 | 16.0 |
| polymerization conditions | reaction 1 | temperature | 70 | 70 | 70 | 70 | 70 | 70 | 70 | 70 | 70 | 70 |
| | | holding time (hr) | 5 h | 5 h | 5 h | 5 h | 5 h | 5 h | 5 h | 5 h | 5 h | 5 h |
| | | pH | 5.1 | 5.1 | 5.1 | 5.1 | 5.1 | 5.1 | 5.1 | 5.1 | 5.1 | 5.1 |
| | reaction 2 | temperature | 90 | 90 | 90 | 90 | 90 | 90 | 90 | 90 | 90 | 90 |
| | | holding time (hr) | 7.5 h | 7.5 h | 7.5 h | 7.5 h | 7.5 h | 7.5 h | 7.5 h | 7.5 h | 7.5 h | 7.5 h |
| | | pH | 8.0 | 8.0 | 8.0 | 8.0 | 8.0 | 8.0 | 8.0 | 8.0 | 8.0 | 8.0 |
| | reaction 3 | temperature | 100 | 100 | 100 | 100 | 100 | 100 | 100 | 100 | 100 | 100 |
| | | holding time (hr) | 5 h | 5 h | 5 h | 5 h | 5 h | 5 h | 5 h | 5 h | 5 h | 5 h |
| | | pH | 5.1 | 5.1 | 5.1 | 5.1 | 5.1 | 5.1 | 5.1 | 5.1 | 5.1 | 5.1 |

TABLE 2

| | | | example 11 | example 12 | example 13 | example 14 | example 15 | example 16 |
|---|---|---|---|---|---|---|---|---|
| | | | toner particle | | | | | |
| | | | toner particle 11 | toner particle 12 | toner particle 13 | toner particle 14 | toner particle 15 | toner particle 16 |
| monomer | styrene | mass parts | 70.0 | 70.0 | 70.0 | 70.0 | 70.0 | 70.0 |
| | n-butyl acrylate | mass parts | 30.0 | 30.0 | 30.0 | 30.0 | 30.0 | 30.0 |
| | divinyl benzene | mass parts | 0.0 | 0.0 | 0.0 | 0.0 | 0.0 | 0.0 |
| | silane | silane 1 | methyl triethoxy silane | methyl triethoxy silane | methyl triethoxy silane | methyl triethoxy silane | methyl triethoxy silane | methyl triethoxy silane |
| | | silane 1 mass part | 5.4 | 4.5 | 4.0 | 3.5 | 10.0 | 10.0 |
| | | silane 2 | — | — | — | | | |
| | | silane 2 mass parts | — | — | — | | | |
| polyester resin | | type | (1) | (1) | (1) | (1) | (1) | (1) |
| | | mass parts | 4.0 | 4.0 | 4.0 | 4.0 | 4.0 | 4.0 |
| release agent | | type | behenyl behenate | behenyl behenate | behenyl behenate | behenyl behenate | behenyl behenate | behenyl behenate |
| | | mass parts | 10.0 | 10.0 | 10.0 | 10.0 | 10.0 | 10.0 |
| | | melting point (° C.) | 72.1 | 72.1 | 72.1 | 72.1 | 72.1 | 72.1 |
| | | heat absorption (J/g) | 210.3 | 210.3 | 210.3 | 210.3 | 210.3 | 210.3 |
| colorant | | type of colorant | copper phthalo-cyanine | copper phthalo-cyanine | copper phthalo-cyanine | copper phthalo-cyanine | copper phthalo-cyanine | copper phthalo-cyanine |
| | | mass parts | 6.5 | 6.5 | 6.5 | 6.5 | 6.5 | 6.5 |
| charge control resin 1 | | mass parts | 0.4 | 0.4 | 0.4 | 0.4 | 0.4 | 0.4 |
| charge control agent 1 | | mass parts | 0.5 | 0.5 | 0.5 | 0.5 | 0.5 | 0.5 |
| oil-soluble initiator | type | | t-butyl peroxy-pivalate | t-butyl peroxy-pivalate | t-butyl peroxy-pivalate | t-butyl peroxy-pivalate | t-butyl peroxy-pivalate | t-butyl peroxy-pivalate |
| | amount of addition | mass parts | 16.0 | 16.0 | 16.0 | 16.0 | 16.0 | 16.0 |
| polymerization conditions | reaction 1 | temperature | 70 | 70 | 70 | 70 | 70 | 70 |
| | | holding time (hr) | 5 h | 5 h | 5 h | 5 h | 5 h | 5 h |
| | | pH | 5.1 | 5.1 | 5.1 | 5.1 | 4.1 | 5.1 |
| | reaction 2 | temperature | 90 | 90 | 90 | 90 | 90 | 90 |
| | | holding time (hr) | 7.5 h | 7.5 h | 7.5 h | 7.5 h | 7.5 h | 7.5 h |
| | | pH | 8.0 | 8.0 | 8.0 | 8.0 | 4.1 | 10.2 |
| | reaction 3 | temperature | 100 | 100 | 100 | 100 | 100 | 100 |
| | | holding time (hr) | 5 h | 5 h | 5 h | 5 h | 5 h | 5 h |
| | | pH | 5.1 | 5.1 | 5.1 | 5.1 | 4.1 | 5.1 |

| | | | | example 17 | example 18 | example 19 | example 20 |
|---|---|---|---|---|---|---|---|
| | | | | toner particle | | | |
| | | | | toner particle 17 | toner particle 18 | toner particle 19 | toner particle 20 |
| monomer | styrene | mass parts | | 70.0 | 70.0 | 70.0 | 70.0 |
| | n-butyl acrylate | mass parts | | 30.0 | 30.0 | 30.0 | 30.0 |
| | divinyl benzene | mass parts | | 0.0 | 0.0 | 0.0 | 0.0 |
| | silane | silane 1 | | methyl triethoxy silane | methyl triethoxy silane | methyl triethoxy silane | methyl triethoxy silane |
| | | silane 1 mass part | | 10.0 | 5.0 | 7.5 | 5.0 |
| | | silane 2 | | — | ethyl triethoxy silane | tetra ethoxy silane | methyl trimethoxy silane |
| | | silane 2 mass parts | | — | 5.0 | 2.5 | 5.0 |
| polyester resin | | type | | (1) | (1) | (1) | (1) |
| | | mass parts | | 4.0 | 4.0 | 4.0 | 4.0 |
| release agent | | type | | behenyl behenate | behenyl behenate | behenyl behenate | behenyl behenate |
| | | mass parts | | 10.0 | 10.0 | 10.0 | 10.0 |
| | | melting | | 72.1 | 72.1 | 72.1 | 72.1 |

TABLE 2-continued

| | | | | | | | |
|---|---|---|---|---|---|---|---|
| | | | point (° C.) | | | | |
| | | | heat absorption (J/g) | 210.3 | 210.3 | 210.3 | 210.3 |
| | colorant | | type of colorant | copper phthalo-cyanine | copper phthalo-cyanine | copper phthalo-cyanine | copper phthalo-cyanine |
| | | | mass parts | 6.5 | 6.5 | 6.5 | 6.5 |
| | charge control resin 1 | | mass parts | 0.4 | 0.4 | 0.4 | 0.4 |
| | charge control agent 1 | | mass parts | 0.5 | 0.5 | 0.5 | 0.5 |
| | oil-soluble initiator | type | | t-butyl peroxy-pivalate | t-butyl peroxy-pivalate | t-butyl peroxy-pivalate | t-butyl peroxy-pivalate |
| | | amount of addition | mass parts | 16.0 | 16.0 | 16.0 | 16.0 |
| | polymerization conditions | reaction 1 | temperature | 70 | 70 | 70 | 70 |
| | | | holding time (hr) | 5 h | 5 h | 5 h | 5 h |
| | | | pH | 5.1 | 5.1 | 5.1 | 5.1 |
| | | reaction 2 | temperature | 90 | 90 | 90 | 90 |
| | | | holding time (hr) | 7.5 h | 7.5 h | 7.5 h | 7.5 h |
| | | | pH | 9.0 | 8.0 | 8.0 | 8.0 |
| | | reaction 3 | temperature | 100 | 100 | 100 | 100 |
| | | | holding time (hr) | 5 h | 5 h | 5 h | 5 h |
| | | | pH | 5.1 | 5.1 | 5.1 | 5.1 |

TABLE 3

| | | | example 21 | example 22 | example 23 | example 24 | example 25 | example 26 |
|---|---|---|---|---|---|---|---|---|
| | | | toner particle | | | | | |
| | | | toner particle 21 | toner particle 22 | toner particle 23 | toner particle 24 | toner particle 25 | toner particle 26 |
| monomer | styrene | mass parts | 70.0 | 70.0 | described in text | described in text | described in text | described in text |
| | n-butyl acrylate | mass parts | 30.0 | 30.0 | | | | |
| | divinyl benzene | mass parts | 0.0 | 0.0 | | | | |
| | silane | silane 1 | methyl triethoxy silane | methyl triethoxy silane | | | | |
| | | silane 1 mass part | 10.0 | 10.0 | | | | |
| | | silane 2 | | — | | | | |
| | | silane 2 mass parts | | — | | | | |
| polyester resin | | type | (1) | (1) | | | | |
| | | mass parts | 4.0 | 4.0 | | | | |
| release agent | | type | behenyl behenate | behenyl behenate | | | | |
| | | mass parts | 10.0 | 10.0 | | | | |
| | | melting point (° C.) | 72.1 | 72.1 | | | | |
| | | heat absorption (J/g) | 210.3 | 210.3 | | | | |
| colorant | | type of colorant | copper phthalo-cyanine | copper phthalo-cyanine | | | | |
| | | mass parts | 6.5 | 6.5 | | | | |
| charge control resin 1 | | mass parts | 0.4 | 0.4 | | | | |
| charge control agent 1 | | mass parts | 0.5 | 0.5 | | | | |
| oil-soluble initiator | type | | t-butyl peroxy-pivalate | t-butyl peroxy-pivalate | | | | |
| | amount of addition | mass parts | 16.0 | 16.0 | | | | |
| polymerization conditions | reaction 1 | temperature | 70 | 70 | | | | |
| | | holding time (hr) | 5 h | 5 h | | | | |
| | | pH | 5.1 | 5.1 | | | | |

TABLE 3-continued

| | | | |
|---|---|---|---|
| reaction 2 | temperature | 95 | 100 |
| | holding time (hr) | 10 h | 10 h |
| | pH | 8.0 | 8.0 |
| reaction 3 | temperature | 100 | 100 |
| | holding time (hr) | 5 h | 5 h |
| | pH | 5.1 | 5.1 |

| | | | | example 27 | example 28 | example 29 | example 30 |
|---|---|---|---|---|---|---|---|
| | | | | toner particle | | | |
| | | | | toner particle 27 | toner particle 28 | toner particle 29 | toner particle 30 |
| monomer | styrene | | mass parts | 70.0 | 60.0 | 70.0 | 70.0 |
| | n-butyl acrylate | | mass parts | 30.0 | 40.0 | 30.0 | 30.0 |
| | divinyl benzene | | mass parts | 0.0 | 0.0 | 0.0 | 0.0 |
| | silane | | silane 1 | methyl triethoxy silane | methyl triethoxy silane | methyl triethoxy silane | methyl triethoxy silane |
| | | | silane 1 mass part | 10.0 | 10.0 | 10.0 | 10.0 |
| | | | silane 2 | | titanium tetra-normal-propoxide | | |
| | | | silane 2 mass parts | | 1.0 | | |
| polyester resin | | | type | (1) | (1) | (1) | (1) |
| | | | mass parts | 4.0 | 4.0 | 4.0 | 4.0 |
| release agent | | | type | behenyl behenate | behenyl behenate | behenyl behenate | behenyl behenate |
| | | | mass parts | 10.0 | 10.0 | 10.0 | 10.0 |
| | | | melting point (° C.) | 72.1 | 72.1 | 72.1 | 72.1 |
| | | | heat absorption (J/g) | 210.3 | 210.3 | 210.3 | 210.3 |
| colorant | | | type of colorant | carbon black | copper phthalo-cyanine | P.R.122 | P.Y.155 |
| | | | mass parts | 10.0 | 6.5 | 8.0 | 6.0 |
| charge control resin 1 | | | mass parts | 0.4 | 0.4 | 0.4 | 0.4 |
| charge control agent 1 | | | mass parts | 0.5 | 0.5 | 0.5 | 0.5 |
| oil-soluble initiator | type | | | t-butyl peroxy-pivalate | t-butyl peroxy-pivalate | t-butyl peroxy-pivalate | t-butyl peroxy-pivalate |
| | amount of addition | | mass parts | 16.0 | 16.0 | 16.0 | 16.0 |
| polymerization conditions | reaction 1 | | temperature | 70 | 70 | 70 | 70 |
| | | | holding time (hr) | 5 h | 5 h | 5 h | 5 h |
| | | | pH | 5.1 | 5.1 | 5.1 | 5.1 |
| | reaction 2 | | temperature | 90 | 90 | 90 | 90 |
| | | | holding time (hr) | 7.5 h | 7.5 h | 7.5 h | 7.5 h |
| | | | pH | 8.0 | 8.0 | 8.0 | 8.0 |
| | reaction 3 | | temperature | 100 | 100 | 100 | 100 |
| | | | holding time (hr) | 5 h | 5 h | 5 h | 5 h |
| | | | pH | 5.1 | 5.1 | 5.1 | 5.1 |

TABLE 4

| | | | comparative example 1 | comparative example 2 | comparative example 3 | comparative example 4 | comparative example 5 | comparative example 6 |
|---|---|---|---|---|---|---|---|---|
| | | | toner particle | | | | | |
| | | | comparative toner particle 1 | comparative toner particle 2 | comparative toner particle 3 | comparative toner particle 4 | comparative toner particle 5 | comparative toner particle 6 |
| monomer | styrene | mass parts | 70.0 | 70.0 | 70.0 | 70.0 | 70.0 | 70.0 |
| | n-butyl | mass parts | 30.0 | 30.0 | 30.0 | 30.0 | 30.0 | 30.0 |

TABLE 4-continued

| | | | | | | | | |
|---|---|---|---|---|---|---|---|---|
| | acrylate | | | | | | | |
| | divinyl benzene | mass parts | 0.0 | 0.0 | 0.0 | 0.0 | 0.0 | 0.0 |
| | silane | silane 1 | methyl triethoxy silane | tetra ethoxy silane | 3-methacryloxy propyl triethoxy silane | 3-methacryloxy propyl triethoxy silane | 3-methacryloxy propyl triethoxy silane | 3-methacryloxy propyl triethoxy silane |
| | | silane 1 mass part | 1.0 | 10.0 | 10.0 | 10.0 | 10.0 | 3.1 |
| | | silane 2 | — | — | — | — | — | — |
| | | silane 2 mass parts | — | — | — | — | — | — |
| polyester resin | | type | (1) | (1) | (1) | (1) | (1) | (1) |
| | | mass parts | 4.0 | 4.0 | 4.0 | 4.0 | 4.0 | 4.0 |
| release agent | | type | behenyl behenate | behenyl behenate | behenyl behenate | behenyl behenate | behenyl behenate | behenyl behenate |
| | | mass parts | 10.0 | 10.0 | 10.0 | 10.0 | 10.0 | 10.0 |
| | | melting point (° C.) | 72.1 | 72.1 | 72.1 | 72.1 | 72.1 | 72.1 |
| | | heat absorption (J/g) | 210.3 | 210.3 | 210.3 | 210.3 | 210.3 | 210.3 |
| colorant | | type of colorant | copper phthalo-cyanine | copper phthalo-cyanine | copper phthalo-cyanine | copper phthalo-cyanine | copper phthalo-cyanine | copper phthalo-cyanine |
| | | mass parts | 6.5 | 6.5 | 6.5 | 6.5 | 6.5 | 6.5 |
| charge control resin 1 | | mass parts | 0.4 | 0.4 | 0.4 | 0.4 | 0.4 | 0.4 |
| charge control agent 1 | | mass parts | 0.5 | 0.5 | 0.5 | 0.5 | 0.5 | 0.5 |
| oil-soluble initiator | type | | t-butyl peroxy-pivalate | t-butyl peroxy-pivalate | t-butyl peroxy-pivalate | t-butyl peroxy-pivalate | t-butyl peroxy-pivalate | t-butyl peroxy-pivalate |
| | amount of addition | mass parts | 16.0 | 16.0 | 16.0 | 16.0 | 16.0 | 16.0 |
| polymerization conditions | reaction 1 | temperature | 70 | 70 | 70 | 70 | 80 | 70 |
| | | holding time (hr) | 5 h | 5 h | 5 h | 5 h | 5 h | 5 h |
| | | pH | 5.1 | 5.1 | 5.1 | 5.1 | 5.1 | 5.1 |
| | reaction 2 | temperature | 90 | 90 | 90 | 70 | 80 | 90 |
| | | holding time (hr) | 7.5 h | 7.5 h | 7.5 h | 7.5 h | 7.5 h | 7.5 h |
| | | pH | 8.0 | 8.0 | 8.0 | 8.0 | 8.0 | 8.0 |
| | reaction 3 | temperature | 100 | 100 | 100 | 70 | 80 | 100 |
| | | holding time (hr) | 5 h | 5 h | 5 h | 5 h | 5 h | 5 h |
| | | pH | 5.1 | 5.1 | 5.1 | 5.1 | 5.1 | 5.1 |

| | | | | comparative example 7 | comparative example 8 | comparative example 9 | comparative example 10 | comparative example 11 |
|---|---|---|---|---|---|---|---|---|
| | | | | toner particle | | | | |
| | | | | comparative toner particle 7 | comparative toner particle 8 | comparative toner particle 9 | comparative toner particle 10 | comparative toner particle 11 |
| | monomer | styrene | mass parts | 70.0 | 70.0 | 70.0 | 70.0 | described in text |
| | | n-butyl acrylate | mass parts | 30.0 | 30.0 | 30.0 | 30.0 | |
| | | divinyl benzene | mass parts | 0.0 | 0.0 | 0.0 | 0.0 | |
| | | silane | silane 1 | methyl triethoxy silane | methyl triethoxy silane | aminopropyl trimethoxy silane | — | |
| | | | silane 1 mass part | 2.0 | 2.0 | 11.0 | 0.0 | |
| | | | silane 2 | — | — | — | — | |
| | | | silane 2 mass parts | — | — | — | — | |
| | polyester resin | | type | (1) | (1) | (1) | (1) | |
| | | | mass parts | 4.0 | 4.0 | 4.0 | 4.0 | |
| | release agent | | type | behenyl behenate | behenyl behenate | behenyl behenate | behenyl behenate | |
| | | | mass parts | 10.0 | 10.0 | 10.0 | 10.0 | |
| | | | melting point (° C.) | 72.1 | 72.1 | 72.1 | 72.1 | |
| | | | heat absorption (J/g) | 210.3 | 210.3 | 210.3 | 210.3 | |
| | colorant | | type of colorant | copper phthalo- | copper phthalo- | copper phthalo- | copper phthalo- | |

TABLE 4-continued

| | | | | | | |
|---|---|---|---|---|---|---|
| | | | cyanine | cyanine | cyanine | cyanine |
| | | mass parts | 6.5 | 6.5 | 6.5 | 6.5 |
| charge control resin 1 | | mass parts | 0.4 | 0.4 | 0.4 | 0.4 |
| charge control agent 1 | | mass parts | 0.5 | 0.5 | 0.5 | 0.5 |
| oil-soluble initiator | type | | t-butyl peroxy-pivalate | t-butyl peroxy-pivalate | t-butyl peroxy-pivalate | t-butyl peroxy-pivalate |
| | amount of addition | mass parts | 16.0 | 16.0 | 16.0 | 16.0 |
| polymerization conditions | reaction 1 | temperature | 70 | 55 | 70 | 70 |
| | | holding time (hr) | 5 h | 5 h | 5 h | 5 h |
| | | pH | 5.1 | 5.1 | 5.1 | 5.1 |
| | reaction 2 | temperature | 70 | 70 | 90 | 90 |
| | | holding time (hr) | 7.5 h | 7.5 h | 7.5 h | 7.5 h |
| | | pH | 8.0 | 8.0 | 8.0 | 8.0 |
| | reaction 3 | temperature | 70 | 70 | 100 | 100 |
| | | holding time (hr) | 5 h | 5 h | 5 h | 5 h |
| | | pH | 5.1 | 5.1 | 5.1 | 5.1 |

TABLE 5

| | | | example 1 | example 2 | example 3 | example 4 | example 5 | example 6 |
|---|---|---|---|---|---|---|---|---|
| | | | toner particle | | | | | |
| | | | toner particle 1 | toner particle 2 | toner particle 3 | toner particle 4 | toner particle 5 | toner particle 6 |
| toner properties | THF-insoluble matter (%) | | 0.8 | 9.4 | 1.2 | 1.2 | 1.3 | 29.7 |
| | average circularity | | 0.981 | 0.976 | 0.983 | 0.982 | 0.982 | 0.981 |
| | modal circularity | | 1.00 | 1.00 | 1.00 | 1.00 | 1.00 | 1.00 |
| | toner particle weight-average molecular weight | | 24200 | 24100 | 24300 | 24300 | 24500 | 27800 |
| | weight-average molecular weight/number-average molecular weight for the toner particle | | 8.4 | 8.6 | 8.4 | 8.6 | 8.1 | 12.1 |
| | circle-equivalent diameter Dtem (μm) determined from the toner cross-sectional area | | 5.7 | 5.7 | 5.7 | 5.7 | 5.7 | 5.7 |
| | weight-average particle diameter (μm) | | 5.6 | 5.6 | 5.6 | 5.6 | 5.6 | 5.7 |
| | number-average particle diameter (μm) | | 5.3 | 5.3 | 5.3 | 5.3 | 5.3 | 5.3 |
| | endothermic main peak temperature (° C.) | | 70.4 | 70.4 | 70.4 | 70.4 | 70.4 | 70.3 |
| | calorimetric integral value (J/g) | | 22.3 | 22.1 | 22.1 | 22.1 | 22.1 | 22.3 |
| | glass transition temperature (° C.) | | 49.6 | 50.4 | 51.2 | 52.0 | 52.1 | 48.6 |
| | Flowtester | 80° C. viscosity (Pa · s) | 14100 | 17400 | 15200 | 15100 | 14100 | 16400 |

| | | | example 7 | example 8 | example 9 | example 10 |
|---|---|---|---|---|---|---|
| | | | toner particle | | | |
| | | | toner particle 7 | toner particle 8 | toner particle 9 | toner particle 10 |
| toner properties | THF-insoluble matter (%) | | 1.3 | 1.3 | 1.4 | 1.2 |
| | average circularity | | 0.983 | 0.982 | 0.982 | 0.982 |
| | modal circularity | | 1.00 | 1.00 | 1.00 | 1.00 |
| | toner particle weight-average molecular weight | | 23900 | 26100 | 25100 | 22100 |
| | weight-average molecular | | 8.2 | 8.1 | 8.3 | 8.1 |

TABLE 5-continued

| | | | | | |
|---|---|---|---|---|---|
| weight/number-average molecular weight for the toner particle | | | | | |
| circle-equivalent diameter Dtem (μm) determined from the toner cross-sectional area | | 5.7 | 5.7 | 5.7 | 5.7 |
| weight-average particle diameter (μm) | | 5.6 | 5.6 | 5.6 | 5.6 |
| number-average particle diameter (μm) | | 5.3 | 5.3 | 5.3 | 5.3 |
| endothermic main peak temperature (° C.) | | 70.3 | 70.4 | 70.3 | 70.4 |
| calorimetric integral value (J/g) | | 22.2 | 22.1 | 22.3 | 22.2 |
| glass transition temperature (° C.) | | 51.7 | 49.6 | 49.9 | 50.2 |
| Flowtester | 80° C. viscosity (Pa · s) | 14300 | 14200 | 14200 | 12200 |

TABLE 6

| | | | example 11 | example 12 | example 13 | example 14 | example 15 | example 16 |
|---|---|---|---|---|---|---|---|---|
| | | | toner particle | | | | | |
| | | | toner particle 11 | toner particle 12 | toner particle 13 | toner particle 14 | toner particle 15 | toner particle 16 |
| toner properties | THF-insoluble matter (%) | | 1.3 | 1.3 | 1.2 | 1.2 | 1.4 | 1.5 |
| | average circularity | | 0.981 | 0.982 | 0.981 | 0.981 | 0.982 | 0.982 |
| | modal circularity | | 1.00 | 1.00 | 1.00 | 1.00 | 1.00 | 1.00 |
| | toner particle weight-average molecular weight | | 24700 | 24500 | 23200 | 24100 | 23100 | 22600 |
| | weight-average molecular weight/number-average molecular weight for the toner particle | | 8.4 | 8.6 | 8.4 | 8.0 | 8.2 | 8.1 |
| | circle-equivalent diameter Dtem (μm) determined from the toner cross-sectional area | | 5.8 | 5.7 | 5.7 | 5.7 | 5.7 | 5.6 |
| | weight-average particle diameter (μm) | | 5.6 | 5.6 | 5.6 | 5.6 | 5.6 | 5.6 |
| | number-average particle diameter (μm) | | 5.3 | 5.3 | 5.3 | 5.3 | 5.4 | 5.4 |
| | endothermic main peak temperature (° C.) | | 70.4 | 70.4 | 70.4 | 70.4 | 70.4 | 70.4 |
| | calorimetric integral value (J/g) | | 22.1 | 22.3 | 22.3 | 22.4 | 22.3 | 22.1 |
| | glass transition temperature (° C.) | | 45.2 | 54.1 | 52.0 | 49.2 | 49.9 | 49.9 |
| | Flowtester | 80° C. viscosity (Pa · s) | 12400 | 12800 | 15000 | 15200 | 14000 | 14200 |

| | | | example 17 | example 18 | example 19 | example 20 |
|---|---|---|---|---|---|---|
| | | | toner particle | | | |
| | | | toner particle 17 | toner particle 18 | toner particle 19 | toner particle 20 |
| toner properties | THF-insoluble matter (%) | | 1.2 | 1.2 | 1.3 | 1.1 |
| | average circularity | | 0.982 | 0.981 | 0.981 | 0.982 |
| | modal circularity | | 1.00 | 1.00 | 1.00 | 1.00 |
| | toner particle weight-average molecular weight | | 22800 | 23100 | 24000 | 23900 |
| | weight-average | | 8.1 | 8.2 | 8.3 | 8.4 |

TABLE 6-continued

| | | | | | |
|---|---|---|---|---|---|
| molecular weight/number-average molecular weight for the toner particle | | | | | |
| circle-equivalent diameter Dtem (μm) determined from the toner cross-sectional area | 5.7 | 5.7 | 5.7 | 5.7 | |
| weight-average particle diameter (μm) | 5.7 | 5.7 | 5.7 | 5.6 | |
| number-average particle diameter (μm) | 5.3 | 5.3 | 5.3 | 5.3 | |
| endothermic main peak temperature (° C.) | 70.4 | 70.4 | 70.4 | 70.3 | |
| calorimetric integral value (J/g) | 22.3 | 22.1 | 22.3 | 22.4 | |
| glass transition temperature (° C.) | 49.8 | 49.9 | 50.1 | 50.8 | |
| Flowtester | 80° C. viscosity (Pa · s) | 14300 | 14500 | 12700 | 14100 |

TABLE 7

| | | | example 21 | example 22 | example 23 | example 24 | example 25 | example 26 |
|---|---|---|---|---|---|---|---|---|
| | | | toner particle | | | | | |
| | | | toner particle 21 | toner particle 22 | toner particle 23 | toner particle 24 | toner particle 25 | toner particle 26 |
| toner properties | THF-insoluble matter (%) | | 1.6 | 1.2 | 1.1 | 1.2 | 0.8 | 1.1 |
| | average circularity | | 0.983 | 0.981 | 0.973 | 0.971 | 0.964 | 0.981 |
| | modal circularity | | 1.00 | 1.00 | 0.98 | 0.98 | 0.97 | 1.00 |
| | toner particle weight-average molecular weight | | 20000 | 18700 | 13100 | 13200 | 52200 | 34000 |
| | weight-average molecular weight/number-average molecular weight for the toner particle | | 8.2 | 8.0 | 8.6 | 8.1 | 8.0 | 8.3 |
| | circle-equivalent diameter Dtem (μm) determined from the toner cross-sectional area | | 5.7 | 5.6 | 5.6 | 5.6 | 5.7 | 5.7 |
| | weight-average particle diameter (μm) | | 5.6 | 5.6 | 5.6 | 5.6 | 5.6 | 5.6 |
| | number-average particle diameter (μm) | | 5.3 | 5.4 | 5.3 | 5.3 | 5.3 | 5.4 |
| | endothermic main peak temperature (° C.) | | 70.3 | 70.3 | 70.4 | 70.4 | 70.4 | 70.4 |
| | calorimetric integral value (J/g) | | 22.1 | 22.4 | 22.5 | 22.1 | 22.4 | 22.3 |
| | glass transition temperature (° C.) | | 48.4 | 48.6 | 49.7 | 49.3 | 49.3 | 49.7 |
| | Flowtester | 80° C. viscosity (Pa · s) | 12200 | 11800 | 11200 | 21900 | 14200 | 14200 |

| | | | example 27 | example 28 | example 29 | example 30 |
|---|---|---|---|---|---|---|
| | | | toner particle | | | |
| | | | toner particle 27 | toner particle 28 | toner particle 29 | toner particle 30 |
| toner properties | THF-insoluble matter (%) | | 1.1 | 1.0 | 1.1 | 1.0 |
| | average circularity | | 0.980 | 0.980 | 0.980 | 0.980 |
| | modal circularity | | 1.00 | 1.00 | 1.00 | 1.00 |
| | toner particle weight-average molecular weight | | 19300 | 29800 | 28200 | 22300 |

TABLE 7-continued

| | | | | | |
|---|---|---|---|---|---|
| | weight-average molecular weight/number-average molecular weight for the toner particle | 8.1 | 8.1 | 8.2 | 8.3 |
| | circle-equivalent diameter Dtem (μm) determined from the toner cross-sectional area | 5.6 | 5.6 | 5.7 | 5.7 |
| | weight-average particle diameter (μm) | 5.6 | 5.6 | 5.6 | 5.6 |
| | number-average particle diameter (μm) | 5.3 | 5.4 | 5.4 | 5.3 |
| | endothermic main peak temperature (° C.) | 70.3 | 70.4 | 70.5 | 70.6 |
| | calorimetric integral value (J/g) | 22.5 | 22.2 | 22.6 | 22.1 |
| | glass transition temperature (° C.) | 48.9 | 40.1 | 50.6 | 49.4 |
| | Flowtester 80° C. viscosity (Pa · s) | 14500 | 14300 | 16200 | 13900 |

TABLE 8

| | | comparative example 1 | comparative example 2 | comparative example 3 | comparative example 4 | comparative example 5 | comparative example 6 |
|---|---|---|---|---|---|---|---|
| | | toner particle | | | | | |
| | | comparative toner particle 1 | comparative toner particle 2 | comparative toner particle 3 | comparative toner particle 4 | comparative toner particle 5 | comparative toner particle 6 |
| toner properties | THF-insoluble matter (%) | 1.2 | 1.2 | 11.0 | 10.4 | 11.2 | 11.0 |
| | average circularity | 0.923 | 0.982 | 0.982 | 0.984 | 0.983 | 0.982 |
| | modal circularity | 1.00 | 1.00 | 1.00 | 1.00 | 1.00 | 1.00 |
| | toner particle weight-average molecular weight | 24300 | 24200 | 25200 | 25000 | 25000 | 25100 |
| | weight-average molecular weight/number-average molecular weight for the toner particle | 8.1 | 8.2 | 11.0 | 11.8 | 11.2 | 11.0 |
| | circle-equivalent diameter Dtem (μm) determined from the toner cross-sectional area | 5.7 | 5.7 | 5.7 | 5.7 | 5.7 | 5.7 |
| | weight-average particle diameter (μm) | 5.7 | 5.6 | 5.7 | 5.6 | 5.6 | 5.7 |
| | number-average particle diameter (μm) | 5.3 | 5.3 | 5.4 | 5.3 | 5.4 | 5.3 |
| | endothermic main peak temperature (° C.) | 70.4 | 70.4 | 70.4 | 70.4 | 70.4 | 70.3 |
| | calorimetric integral value (J/g) | 22.6 | 22.6 | 22.5 | 22.6 | 22.6 | 22.6 |
| | glass transition temperature (° C.) | 50.2 | 50.3 | 48.7 | 48.6 | 48.3 | 48.6 |
| | Flowtester 80° C. viscosity (Pa · s) | 15200 | 15400 | 16100 | 16200 | 16100 | 16000 |

TABLE 8-continued

| | | | comparative example 7 | comparative example 8 | comparative example 9 toner particle | comparative example 10 | comparative example 11 |
|---|---|---|---|---|---|---|---|
| | | | comparative toner particle 7 | comparative toner particle 8 | comparative toner particle 9 | comparative toner particle 10 | comparative toner particle 11 |
| toner properties | THF-insoluble matter (%) | | 11.3 | 10.1 | 1.1 | 1.2 | 1.1 |
| | average circularity | | 0.983 | 0.983 | 0.981 | 0.981 | 0.981 |
| | modal circularity | | 1.00 | 1.00 | 1.00 | 1.00 | 1.00 |
| | toner particle weight-average molecular weight | | 25200 | 28100 | 23100 | 25100 | 25200 |
| | weight-average molecular weight/number-average molecular weight for the toner particle | | 10.8 | 11.4 | 8.4 | 8.1 | 8.0 |
| | circle-equivalent diameter Dtem (μm) determined from the toner cross-sectional area | | 5.7 | 5.7 | 5.7 | 5.7 | 5.7 |
| | weight-average particle diameter (μm) | | 5.6 | 5.7 | 5.6 | 5.7 | 5.6 |
| | number-average particle diameter (μm) | | 5.3 | 5.3 | 5.3 | 5.3 | 5.3 |
| | endothermic main peak temperature (° C.) | | 70.3 | 70.4 | 70.3 | 70.4 | 70.3 |
| | calorimetric integral value (J/g) | | 22.5 | 22.6 | 22.6 | 22.7 | 22.3 |
| | glass transition temperature (° C.) | | 48.8 | 47.6 | 46.1 | 50.2 | 47.9 |
| | Flowtester | 80° C. viscosity (Pa · s) | 16000 | 15700 | 15200 | 14900 | 14900 |

TABLE 9

| | toner particle No. | | | | | | | | | |
|---|---|---|---|---|---|---|---|---|---|---|
| | toner particle 1 | toner particle 2 | toner particle 3 | toner particle 4 | toner particle 5 | toner particle 6 | toner particle 7 | toner particle 8 | toner particle 9 | toner particle 10 |
| formula (T3) structure | present | present | present | present | present | present | present | present | present | present |
| R1 in formula (Z) | methyl group | phenyl group | ethyl group | n-propyl group | n-butyl group | methyl group, vinyl group | methyl group | methyl group | methyl group | methyl group |
| number of carbons in R1 in formula (Z) | 1 | 6 | 2 | 3 | 4 | 1 and 2 | 1 | 1 | 1 | 1 |
| R2, R3, R4 in formula (Z) | ethoxy group | methoxy group | ethoxy group | ethoxy group | ethoxy group | ethoxy group | methoxy group | isopropoxy group | chloro group, ethoxy group | ethoxy group |
| ST3 | 0.70 | 0.42 | 0.60 | 0.51 | 0.42 | 0.44 | 0.70 | 0.71 | 0.72 | 0.70 |
| ST3/SX2 | 2.34 | 2.36 | 2.10 | 1.82 | 1.45 | 2.14 | 2.34 | 2.36 | 2.34 | 2.36 |
| (dSi/[dSi + dO + dC]) (atom %) | 23.40 | 7.60 | 16.80 | 16.40 | 11.40 | 15.80 | 16.80 | 16.70 | 16.30 | 24.20 |
| [dSi/dC] | 0.54 | 0.52 | 0.51 | 0.51 | 0.51 | 0.51 | 0.52 | 0.53 | 0.52 | 0.67 |
| average thickness of the surface layer Dav. (nm) | 30.2 | 5.4 | 8.2 | 7.1 | 6.1 | 28.6 | 31.2 | 32.0 | 28.1 | 84.3 |
| percentage of the surface layer with a thickness ≤5.0 nm (%) | 4.5 | 79.7 | 8.2 | 21.2 | 73.2 | 7.8 | 4.3 | 4.6 | 20.8 | 0.0 |

TABLE 9-continued

| | toner particle No. | | | | | | | | | |
|---|---|---|---|---|---|---|---|---|---|---|
| | toner particle 1 | toner particle 2 | toner particle 3 | toner particle 4 | toner particle 5 | toner particle 6 | toner particle 7 | toner particle 8 | toner particle 9 | toner particle 10 |
| production method | first production method | first production method | first production method | first production method | first production method | first production method | first production method | first production method | first production method | first production method |

TABLE 10

| | toner particle No. | | | | | | | | | |
|---|---|---|---|---|---|---|---|---|---|---|
| | toner particle 11 | toner particle 12 | toner particle 13 | toner particle 14 | toner particle 15 | toner particle 16 | toner particle 17 | toner particle 18 | toner particle 19 | toner particle 20 |
| formula (T3) structure | present | present | present | present | present | present | present | present | present | present |
| R1 in formula (Z) | methyl group | methyl group | methyl group | methyl group | methyl group | methyl group | methyl group | methyl group, ethyl group | methyl group | methyl group |
| number of carbons in R1 in formula (Z) | 1 | 1 | 1 | 1 | 1 | 1 | 1 | 1 and 2 | 1 | 1 |
| R2, R3, R4 in formula (Z) | ethoxy group | ethoxy group | ethoxy group | ethoxy group | ethoxy group | ethoxy group | ethoxy group | ethoxy group, ethoxy group | ethoxy group, ethoxy group | ethoxy group, methoxy group |
| ST3 | 0.70 | 0.71 | 0.69 | 0.70 | 0.69 | 0.70 | 0.69 | 0.65 | 0.42 | 0.70 |
| ST3/SX2 | 2.34 | 2.30 | 2.20 | 2.20 | 0.95 | 2.64 | 2.43 | 2.04 | 3.21 | 2.27 |
| (dSi/[dSi + dO + dC]) (atom %) | 22.10 | 22.40 | 20.40 | 21.20 | 23.40 | 23.20 | 23.60 | 18.20 | 16.80 | 23.40 |
| [dSi/dC] | 0.40 | 0.32 | 0.28 | 0.21 | 0.51 | 0.51 | 0.50 | 0.57 | 0.46 | 0.52 |
| average thickness of the surface layer Dav. (nm) | 20.4 | 19.8 | 10.5 | 8.4 | 23.2 | 35.4 | 31.6 | 23.1 | 19.5 | 33.4 |
| percentage of the surface layer with a thickness ≤5.0 nm (%) | 15.6 | 13.4 | 18.6 | 20.8 | 18.6 | 0.0 | 3.4 | 22.5 | 8.6 | 4.6 |
| production method | first production method | first production method | first production method | first production method | first production method | first production method | first production method | first production method | first production method | first production method |

TABLE 11

| | toner particle No. | | | | | | | | | |
|---|---|---|---|---|---|---|---|---|---|---|
| | toner particle 21 | toner particle 22 | toner particle 23 | toner particle 24 | toner particle 25 | toner particle 26 | toner particle 27 | toner particle 28 | toner particle 29 | toner particle 30 |
| formula (T3) structure | present | present | present | present | present | present | present | present | present | present |
| R1 in formula (Z) | methyl group | methyl group | methyl group | methyl group | methyl group | methyl group | methyl group | methyl group | methyl group | methyl group |
| number of carbons in R1 in formula (Z) | 1 | 1 | 1 | 1 | 1 | 1 | 1 | 1 | 1 | 1 |
| R2, R3, R4 in formula (Z) | ethoxy group | ethoxy group | ethoxy group | ethoxy group | ethoxy group | ethoxy group | ethoxy group | ethoxy group | ethoxy group | ethoxy group |
| ST3 | 0.70 | 0.70 | 0.70 | 0.70 | 0.70 | 0.70 | 0.70 | 0.69 | 0.70 | 0.70 |
| ST3/SX2 | 3.42 | 3.76 | 2.31 | 2.36 | 2.15 | 2.23 | 2.26 | 2.33 | 2.35 | 2.35 |
| (dSi/[dSi + dO + dC]) (atom %) | 23.20 | 22.80 | 19.80 | 19.40 | 19.30 | 19.70 | 23.10 | 22.40 | 22.90 | 22.60 |

TABLE 11-continued

| | toner particle No. | | | | | | | | | |
|---|---|---|---|---|---|---|---|---|---|---|
| | toner particle 21 | toner particle 22 | toner particle 23 | toner particle 24 | toner particle 25 | toner particle 26 | toner particle 27 | toner particle 28 | toner particle 29 | toner particle 30 |
| [dSi/dC] | 0.52 | 0.52 | 0.54 | 0.54 | 0.54 | 0.54 | 0.54 | 0.52 | 0.54 | 0.54 |
| average thickness of the surface layer Dav. (nm) | 30.1 | 30.3 | 34.2 | 34.2 | 34.1 | 34.2 | 29.8 | 33.4 | 30.2 | 30.1 |
| percentage of the surface layer with a thickness ≤5.0 nm (%) | 0.0 | 0.0 | 22.4 | 4.6 | 4.8 | 29.2 | 4.7 | 4.6 | 4.8 | 4.7 |
| production method | first production method | second production method | third production method | fourth production method | fifth production method | first production method | first production method | first production method | first production method | first production method |

TABLE 12

| | toner particle No. | | | | | |
|---|---|---|---|---|---|---|
| | comparative toner particle 1 | comparative toner particle 2 | comparative toner particle 3 | comparative toner particle 4 | comparative toner particle 5 | comparative toner particle 6 |
| formula (T3) structure | present | absent | absent | absent | absent | absent |
| R1 in formula (Z) | methyl group | none | 3-methacryloxy propyl group | 3-methacryloxy propyl group | 3-methacryloxy propyl group | 3-methacryloxy propyl group |
| number of carbons in R1 in formula (Z) | 1 | 0 | 7 | 7 | 7 | 7 |
| R2, R3, R4 in formula (Z) | ethoxy group | ethoxy group | methoxy group | methoxy group | methoxy group | methoxy group |
| ST3 | 0.38 | 0.00 | 0.00 | 0.00 | 0.00 | 0.00 |
| ST3/SX2 | 2.10 | 0.00 | 0.00 | 0.00 | 0.00 | 0.00 |
| (dSi/[dSi + dO + dC]) (atom %) | 4.90 | 4.70 | 8.70 | 4.20 | 8.20 | 3.80 |
| [dSi/dC] | 0.13 | 0.34 | 0.03 | 0.02 | 0.02 | 0.01 |
| average thickness of the surface layer Dav. (nm) | 4.5 | 4.7 | 3.4 | 2.3 | 3.5 | 2.2 |
| percentage of the surface layer with a thickness ≤5.0 nm (%) | 74.2 | 50.0 | 94.4 | 100.0 | 96.7 | 100.0 |
| production method | first production method | first production method | first production method | first production method | first production method | first production method |

| | toner particle No. | | | | |
|---|---|---|---|---|---|
| | comparative toner particle 7 | comparative toner particle 8 | comparative toner particle 9 | comparative toner particle 10 | comparative toner particle 11 |
| formula (T3) structure | present | present | absent | absent | present |
| R1 in formula (Z) | methyl group | methyl group | aminopropyl trimethoxy group | — | methyl group |
| number of carbons in R1 in formula (Z) | 1 | 1 | 3 | — | 1 |
| R2, R3, R4 in formula (Z) | ethoxy group | ethoxy group | methoxy group | — | ethoxy group |
| ST3 | 0.37 | 0.21 | 0.00 | 0.00 | 0.30 |
| ST3/SX2 | 2.10 | 2.10 | 0.00 | 0.00 | 2.10 |
| (dSi/[dSi + dO + dC]) (atom %) | 2.30 | 2.00 | 22.40 | 0.00 | 2.60 |

TABLE 12-continued

| | | | | | |
|---|---|---|---|---|---|
| [dSi/dC] | 0.09 | 0.08 | 0.01 | 0.00 | 0.09 |
| average thickness of the surface layer Dav. (nm) | 4.7 | 1.3 | 24.0 | 0.0 | 2.4 |
| percentage of the surface layer with a thickness ≤5.0 nm (%) | 96.7 | 81.4 | 24.0 | 0.0 | 96.8 |
| production method | first production method | first production method | first production method | first production method | — |

TABLE 13

| | | | | Example 1 toner 1 | | Example 2 toner 2 | | Example 3 toner 3 | | Example 4 toner 4 | | Example 5 toner 5 | | Example 6 toner 6 | |
|---|---|---|---|---|---|---|---|---|---|---|---|---|---|---|---|
| heat resistance | storability (50° C./15 days) | | | A | | A | | A | | B | | C | | A | |
| | long-term storability (45° C./95% 3 months) | | | A | | B | | B | | B | | C | | A | |
| environmental stability | NN | initial | tribo (μC/g) | −44.2 | | −43.2 | | −43.1 | | −41.0 | | −39.4 | | −40.8 | |
| | | | NN fogging | 0.1 | A | 0.1 | A | 0.1 | A | 0.1 | A | 0.1 | A | 0.1 | A |
| | | | density | 1.55 | A | 1.54 | A | 1.55 | A | 1.54 | A | 1.53 | A | 1.55 | A |
| | | after 1,000 print | NN fogging | 0.1 | A | 0.2 | A | 0.1 | A | 0.2 | A | 0.2 | A | 0.1 | A |
| | | | density | 1.55 | A | 1.53 | A | 1.53 | A | 1.52 | A | 1.50 | A | 1.54 | A |
| | | durability test | member contamination | A | | A | | A | | A | | A | | A | |
| | LL | initial | tribo (μC/g) | −45.5 | | −45.5 | | −45.4 | | −41.8 | | −41.8 | | −44.9 | |
| | | | LL fogging | 0.1 | A | 0.2 | A | 0.2 | A | 0.2 | A | 0.2 | A | 0.2 | A |
| | | | density | 1.54 | A | 1.53 | A | 1.54 | A | 1.53 | A | 1.52 | A | 1.52 | A |
| | | after 1,000 print | LL fogging | 0.1 | A | 0.2 | A | 0.3 | A | 0.3 | A | 0.3 | A | 0.3 | A |
| | | | density | 1.53 | A | 1.52 | A | 1.52 | A | 1.49 | A | 1.48 | A | 1.50 | A |
| | | durability test | member contamination | A | | A | | A | | A | | A | | A | |
| | HH | initial | tribo (μC/g) | −42.1 | | −41.2 | | −41.1 | | −40.1 | | −37.8 | | −38.4 | |
| | | | HH fogging | 0.2 | A | 0.3 | A | 0.3 | A | 0.4 | A | 0.5 | A | 0.3 | A |
| | | | density | 1.54 | A | 1.47 | A | 1.53 | A | 1.52 | A | 1.50 | A | 1.48 | A |
| | | after 1,000 print | HH fogging | 0.2 | A | 0.4 | A | 0.3 | A | 0.5 | A | 0.6 | A | 0.5 | A |
| | | | density | 1.52 | A | 1.46 | A | 1.52 | A | 1.50 | A | 1.48 | A | 1.46 | A |
| | | durability test | member contamination | A | | A | | A | | A | | A | | A | |
| | SHH after standing for 168 hours in a severe environment | initial | tribo (μC/g) | −41.1 | | −40.2 | | −40.3 | | −39.5 | | −36.9 | | −36.2 | |
| | | | SHH fogging | 0.2 | A | 0.5 | A | 0.6 | A | 0.8 | A | 1.4 | B | 0.4 | A |
| | | | density | 1.52 | A | 1.46 | A | 1.44 | B | 1.42 | B | 1.38 | C | 1.47 | A |
| | | after 1,000 print | SHH fogging | 0.3 | A | 0.6 | A | 0.9 | A | 1.1 | B | 1.6 | C | 0.5 | A |
| | | | density | 1.50 | A | 1.45 | A | 1.39 | C | 1.36 | C | 1.34 | C | 1.45 | A |
| | | durability test | member contamination | A | | B | | A | | B | | B | | A | |
| cold offset end temperature (° C.) | | | | 105 | | 105 | | 105 | | 105 | | 105 | | 105 | |

| | | | | Example 7 toner 7 | | Example 8 toner 8 | | Example 9 toner 9 | | Example 10 toner 10 | |
|---|---|---|---|---|---|---|---|---|---|---|---|
| heat resistance | storability (50° C./15 days) | | | A | | A | | A | | A | |
| | long-term storability (45° C./95% 3 months) | | | A | | A | | B | | A | |
| environmental stability | NN | initial | tribo (μC/g) | −44.2 | | −44.1 | | −41.0 | | −46.2 | |
| | | | NN fogging | 0.1 | A | 0.1 | A | 0.3 | A | 0.1 | A |
| | | | density | 1.54 | A | 1.54 | A | 1.52 | A | 1.55 | A |
| | | after 1,000 print | NN fogging | 0.2 | A | 0.2 | A | 0.5 | A | 0.1 | A |
| | | | density | 1.53 | A | 1.52 | A | 1.48 | A | 1.54 | A |
| | | durability test | member contamination | A | | A | | A | | A | |
| | LL | initial | tribo (μC/g) | −46.1 | | −46.0 | | −47.1 | | −48.9 | |
| | | | LL fogging | 0.2 | A | 0.2 | A | 0.4 | A | 0.1 | A |
| | | | density | 1.53 | A | 1.52 | A | 1.50 | A | 1.53 | A |
| | | after 1,000 print | LL fogging | 0.3 | A | 0.3 | A | 0.5 | A | 0.1 | A |
| | | | density | 1.51 | A | 1.50 | A | 1.47 | A | 1.51 | A |
| | | durability test | member contamination | A | | A | | A | | A | |
| | HH | initial | tribo (μC/g) | −41.1 | | −39.6 | | −37.2 | | −45.2 | |
| | | | HH fogging | 0.3 | A | 0.3 | A | 0.5 | A | 0.2 | A |
| | | | density | 1.53 | A | 1.52 | A | 1.49 | A | 1.54 | A |
| | | after 1,000 print | HH fogging | 0.4 | A | 0.4 | A | 0.7 | A | 0.2 | A |
| | | | density | 1.49 | A | 1.48 | A | 1.46 | A | 1.53 | A |
| | | durability test | member contamination | A | | A | | A | | A | |

TABLE 13-continued

| | | | | | | | | | | | | |
|---|---|---|---|---|---|---|---|---|---|---|---|---|
| | SHH after | initial | tribo (μC/g) | −40.5 | | −40.2 | | −35.4 | | −44.1 | | |
| | standing for | | SHH fogging | 0.5 | A | 0.5 | A | 0.7 | A | 0.2 | A | |
| | 168 hours in | | density | 1.51 | A | 1.50 | A | 1.44 | A | 1.53 | A | |
| | a severe | after 1,000 | SHH fogging | 0.6 | A | 0.6 | A | 0.9 | A | 0.3 | A | |
| | environment | print | density | 1.50 | A | 1.48 | A | 1.43 | B | 1.52 | A | |
| | | durability | member | A | | A | | B | | A | | |
| | | test | contamination | | | | | | | | | |
| cold offset end temperature (° C.) | | | | 105 | | 105 | | 105 | | 115 | | |

TABLE 14

| | | | | example 11 toner 11 | | example 12 toner 12 | | example 13 toner 13 | | example 14 toner 14 | | example 15 toner 15 | | example 16 toner 16 | |
|---|---|---|---|---|---|---|---|---|---|---|---|---|---|---|---|
| heat resistance | storability (50° C./15 days) | | | A | | A | | A | | B | | A | | A | |
| | long-term storability (45° C./95% 3 months) | | | A | | A | | B | | C | | B | | A | |
| environmental stability | NN | initial | tribo (μC/g) | −43.4 | | −42.3 | | −42.6 | | −40.1 | | −41.1 | | −44.3 | |
| | | | NN fogging | 0.2 | A | 0.3 | A | 0.4 | A | 0.5 | A | 0.1 | A | 0.1 | A |
| | | | density | 1.53 | A | 1.53 | A | 1.52 | A | 1.52 | A | 1.55 | A | 1.55 | A |
| | | after 1,000 | NN fogging | 0.3 | A | 0.4 | A | 0.5 | A | 0.7 | A | 0.1 | A | 0.1 | A |
| | | print | density | 1.50 | A | 1.50 | A | 1.47 | A | 1.46 | A | 1.53 | A | 1.55 | A |
| | | durability | member | A | | A | | A | | A | | A | | A | |
| | | test | contamination | | | | | | | | | | | | |
| | LL | initial | tribo (μC/g) | −44.9 | | −45.3 | | −46.3 | | −47.2 | | −47.3 | | −44.3 | |
| | | | LL fogging | 0.2 | A | 0.2 | A | 0.3 | A | 0.6 | A | 0.1 | A | 0.2 | A |
| | | | density | 1.53 | A | 1.52 | A | 1.52 | A | 1.50 | A | 1.51 | A | 1.54 | A |
| | | after 1,000 | LL fogging | 0.4 | A | 0.4 | A | 0.4 | A | 0.9 | A | 0.2 | A | 0.2 | A |
| | | print | density | 1.51 | A | 1.50 | A | 1.50 | A | 1.45 | B | 1.50 | A | 1.52 | A |
| | | durability | member | A | | A | | A | | A | | A | | A | |
| | | test | contamination | | | | | | | | | | | | |
| | HH | initial | tribo (μC/g) | −39.2 | | −38.6 | | −38.5 | | −36.4 | | −41.0 | | −43.8 | |
| | | | HH fogging | 0.4 | A | 0.5 | A | 0.5 | A | 0.7 | A | 0.3 | A | 0.2 | A |
| | | | density | 1.50 | A | 1.51 | A | 1.50 | A | 1.47 | A | 1.52 | A | 1.54 | A |
| | | after 1,000 | HH fogging | 0.5 | A | 0.6 | A | 0.6 | A | 0.9 | A | 0.3 | A | 0.2 | A |
| | | print | density | 1.48 | A | 1.47 | A | 1.47 | A | 1.44 | A | 1.51 | A | 1.53 | A |
| | | durability | member | A | | A | | A | | A | | A | | A | |
| | | test | contamination | | | | | | | | | | | | |
| | SHH after | initial | tribo (μC/g) | −37.4 | | −36.4 | | −36.2 | | −33.1 | | −38.2 | | −42.7 | |
| | standing for | | SHH fogging | 0.4 | A | 0.5 | A | 0.6 | A | 0.8 | A | 0.4 | A | 0.2 | A |
| | 168 hours in | | density | 1.53 | A | 1.46 | A | 1.44 | A | 1.42 | B | 1.51 | A | 1.53 | A |
| | a severe | after 1,000 | SHH fogging | 0.5 | A | 0.7 | A | 0.8 | A | 1.1 | B | 0.3 | A | 0.2 | A |
| | environment | print | density | 1.48 | A | 1.44 | B | 1.41 | B | 1.38 | C | 1.50 | A | 1.52 | A |
| | | durability | member | A | | B | | B | | C | | A | | A | |
| | | test | contamination | | | | | | | | | | | | |
| cold offset end temperature (° C.) | | | | 105 | | 105 | | 105 | | 105 | | 105 | | 105 | |

| | | | | | | example 17 toner 17 | | example 18 toner 18 | | example 19 toner 19 | | example 20 toner 20 | |
|---|---|---|---|---|---|---|---|---|---|---|---|---|---|
| heat resistance | storability (50° C./15 days) | | | | | A | | A | | A | | A | |
| | long-term storability (45° C./95% 3 months) | | | | | A | | A | | A | | A | |
| environmental stability | NN | initial | tribo (μC/g) | | | −44.1 | | −43.5 | | −41.0 | | −43.4 | |
| | | | NN fogging | | | 0.1 | A | 0.1 | A | 0.2 | A | 0.1 | A |
| | | | density | | | 1.57 | A | 1.56 | A | 1.54 | A | 1.55 | A |
| | | after 1,000 | NN fogging | | | 0.2 | A | 0.2 | A | 0.3 | A | 0.2 | A |
| | | print | density | | | 1.56 | A | 1.55 | A | 1.52 | A | 1.53 | A |
| | | durability | member | | | A | | A | | A | | A | |
| | | test | contamination | | | | | | | | | | |
| | LL | initial | tribo (μC/g) | | | −44.8 | | −46.7 | | −45.6 | | −44.9 | |
| | | | LL fogging | | | 0.1 | A | 0.1 | A | 0.3 | A | 0.2 | A |
| | | | density | | | 1.55 | A | 1.55 | A | 1.52 | A | 1.54 | A |
| | | after 1,000 | LL fogging | | | 0.1 | A | 0.2 | A | 0.4 | A | 0.2 | A |
| | | print | density | | | 1.54 | A | 1.54 | A | 1.50 | A | 1.51 | A |
| | | durability | member | | | A | | A | | A | | A | |
| | | test | contamination | | | | | | | | | | |
| | HH | initial | tribo (μC/g) | | | −43.2 | | −41.0 | | −40.0 | | −42.1 | |
| | | | HH fogging | | | 0.2 | A | 0.2 | A | 0.4 | A | 0.3 | A |
| | | | density | | | 1.54 | A | 1.54 | A | 1.50 | A | 1.52 | A |
| | | after 1,000 | HH fogging | | | 0.2 | A | 0.3 | A | 0.5 | A | 0.4 | A |
| | | print | density | | | 1.53 | A | 1.52 | A | 1.47 | A | 1.51 | A |
| | | durability | member | | | A | | A | | A | | A | |
| | | test | contamination | | | | | | | | | | |

TABLE 14-continued

| | | | | | | | | | | | | |
|---|---|---|---|---|---|---|---|---|---|---|---|---|
| | SHH after standing for 168 hours in a severe environment | initial | tribo (μC/g) | −42.0 | | −40.5 | | −37.4 | | −40.1 | | |
| | | | SHH fogging density | 0.2 | A | 0.2 | A | 0.6 | A | 0.4 | A | |
| | | | | 1.53 | A | 1.53 | A | 1.48 | A | 1.50 | A | |
| | | after 1,000 print durability test | SHH fogging density | 0.3 | A | 0.3 | A | 0.7 | A | 0.5 | A | |
| | | | | 1.52 | A | 1.51 | A | 1.46 | A | 1.47 | A | |
| | | | member contamination | A | | A | | A | | A | | |
| cold offset end temperature (° C.) | | | | 105 | | 105 | | 105 | | 105 | | |

TABLE 15

| | | | | example 21 toner 21 | | example 22 toner 22 | | example 23 toner 23 | | example 24 toner 24 | | example 25 toner 25 | | example 26 toner 26 | |
|---|---|---|---|---|---|---|---|---|---|---|---|---|---|---|---|
| heat resistance | storability (50° C./15 days) | | | A | | A | | A | | A | | A | | A | |
| | long-term storability (45° C./95% 3 months) | | | A | | A | | A | | A | | A | | A | |
| environmental stability | NN | initial | tribo (μC/g) | −44.8 | | −45.8 | | −40.1 | | −40.3 | | −40.2 | | −42.8 | |
| | | | NN fogging | 0.1 | A | 0.1 | A | 0.1 | A | 0.2 | A | 0.2 | A | 0.1 | A |
| | | | density | 1.55 | A | 1.56 | A | 1.54 | A | 1.53 | A | 1.54 | A | 1.54 | A |
| | | after 1,000 print | NN fogging | 0.2 | A | 0.2 | A | 0.2 | A | 0.4 | A | 0.3 | A | 0.2 | A |
| | | | density | 1.53 | A | 1.54 | A | 1.53 | A | 1.50 | A | 1.52 | A | 1.53 | A |
| | | durability test | member contamination | A | | A | | A | | A | | A | | A | |
| | LL | initial | tribo (μC/g) | −45.9 | | −46.2 | | −42.3 | | −42.3 | | −42.2 | | −43.2 | |
| | | | LL fogging | 0.2 | A | 0.1 | A | 0.2 | A | 0.3 | A | 0.3 | A | 0.1 | A |
| | | | density | 1.53 | A | 1.55 | A | 1.53 | A | 1.53 | A | 1.53 | A | 1.54 | A |
| | | after 1,000 print | LL fogging | 0.2 | A | 0.2 | A | 0.3 | A | 0.5 | A | 0.4 | A | 0.2 | A |
| | | | density | 1.52 | A | 1.52 | A | 1.51 | A | 1.49 | A | 1.51 | A | 1.53 | A |
| | | durability test | member contamination | A | | A | | A | | A | | A | | A | |
| | HH | initial | tribo (μC/g) | −42.8 | | −43.3 | | −38.8 | | −39.8 | | −39.4 | | −40.2 | |
| | | | HH fogging | 0.3 | A | 0.2 | A | 0.2 | A | 0.3 | A | 0.3 | A | 0.2 | A |
| | | | density | 1.53 | A | 1.54 | A | 1.53 | A | 1.52 | A | 1.51 | A | 1.53 | A |
| | | after 1,000 print | HH fogging | 0.4 | A | 0.3 | A | 0.4 | A | 0.4 | A | 0.4 | A | 0.3 | A |
| | | | density | 1.52 | A | 1.52 | A | 1.51 | A | 1.50 | A | 1.50 | A | 1.50 | A |
| | | durability test | member contamination | A | | A | | A | | A | | A | | A | |
| | SHH after standing for 168 hours in a severe environment | initial | tribo (μC/g) | −41.5 | | −41.9 | | −35.4 | | −36.8 | | −36.8 | | −37.4 | |
| | | | SHH fogging | 0.4 | A | 0.3 | A | 0.4 | A | 0.5 | A | 0.5 | A | 0.3 | A |
| | | | density | 1.51 | A | 1.53 | A | 1.50 | A | 1.49 | A | 1.48 | A | 1.52 | A |
| | | after 1,000 print | SHH fogging | 0.5 | A | 0.4 | A | 0.6 | A | 0.6 | A | 0.6 | A | 0.4 | A |
| | | | density | 1.50 | A | 1.52 | A | 1.48 | A | 1.48 | A | 1.47 | A | 1.49 | A |
| | | durability test | member contamination | A | | A | | A | | A | | A | | A | |
| cold offset end temperature (° C.) | | | | 105 | | 105 | | 105 | | 105 | | 105 | | 105 | |

| | | | | example 27 toner 27 | | example 28 toner 28 | | example 29 toner 29 | | example 30 toner 30 | | example 31 toner particle 1 | |
|---|---|---|---|---|---|---|---|---|---|---|---|---|---|
| heat resistance | storability (50° C./15 days) | | | A | | A | | A | | A | | A | |
| | long-term storability (45° C./95% 3 months) | | | A | | A | | A | | A | | A | |
| environmental stability | NN | initial | tribo (μC/g) | −42.3 | | −42.2 | | −42.3 | | −42.1 | | −43.8 | |
| | | | NN fogging | 0.1 | A | 0.1 | A | 0.1 | A | 0.2 | A | 0.1 | A |
| | | | density | 1.55 | A | 1.55 | A | 1.55 | A | 1.55 | A | 1.55 | A |
| | | after 1,000 print | NN fogging | 0.2 | A | 0.2 | A | 0.2 | A | 0.2 | A | 0.1 | A |
| | | | density | 1.53 | A | 1.51 | A | 1.53 | A | 1.53 | A | 1.53 | A |
| | | durability test | member contamination | A | | A | | A | | A | | A | |
| | LL | initial | tribo (μC/g) | −44.1 | | −44.2 | | −44.1 | | −42.8 | | −44.8 | |
| | | | LL fogging | 0.1 | A | 0.1 | A | 0.2 | A | 0.2 | A | 0.1 | A |
| | | | density | 1.54 | A | 1.53 | A | 1.54 | A | 1.53 | A | 1.54 | A |
| | | after 1,000 print | LL fogging | 0.2 | A | 0.2 | A | 0.2 | A | 0.3 | A | 0.2 | A |
| | | | density | 1.52 | A | 1.50 | A | 1.53 | A | 1.52 | A | 1.52 | A |
| | | durability test | member contamination | A | | A | | A | | A | | A | |
| | HH | initial | tribo (μC/g) | −42.0 | | −40.3 | | −41.2 | | −40.8 | | −41.8 | |
| | | | HH fogging | 0.3 | A | 0.2 | A | 0.2 | A | 0.2 | A | 0.2 | A |
| | | | density | 1.52 | A | 1.51 | A | 1.52 | A | 1.51 | A | 1.54 | A |
| | | after 1,000 print | HH fogging | 0.3 | A | 0.3 | A | 0.3 | A | 0.3 | A | 0.3 | A |
| | | | density | 1.51 | A | 1.49 | A | 1.50 | A | 1.49 | A | 1.52 | A |
| | | durability test | member contamination | A | | A | | A | | A | | A | |

TABLE 15-continued

| | | | | | | | | | | | | | | | | |
|---|---|---|---|---|---|---|---|---|---|---|---|---|---|---|---|---|
| | SHH after standing for 168 hours in a severe environment | initial | tribo (μC/g) | −40.2 | | −41.0 | | −40.7 | | −40.3 | | −40.8 | |
| | | | SHH fogging density | 0.2 | A | 0.2 | A | 0.3 | A | 0.3 | A | 0.2 | A |
| | | | | 1.51 | A | 1.50 | A | 1.50 | A | 1.50 | A | 1.52 | A |
| | | after 1,000 print | SHH fogging density | 0.3 | A | 0.3 | A | 0.5 | A | 0.5 | A | 0.3 | A |
| | | | | 1.49 | A | 1.49 | A | 1.48 | A | 1.48 | A | 1.50 | A |
| | | durability test | member contamination | A | | A | | A | | A | | A | |
| cold offset end temperature (° C.) | | | | 105 | | 105 | | 110 | | 105 | | 105 | |

TABLE 16

| | | | | comparative example No. | | | | | | | | | | | |
|---|---|---|---|---|---|---|---|---|---|---|---|---|---|---|---|
| | | | | 1 | | 2 | | 3 | | 4 | | 5 | | 6 | |
| comparative toner No. | | | | 1 | | 2 | | 3 | | 4 | | 5 | | 6 | |
| heat resistance | storability (50° C./15 days) | | | C | | D | | C | | C | | B | | C | |
| | long-term storability (45° C./95% 3 months) | | | E | | E | | D | | D | | D | | E | |
| environmental stability | NN | initial | tribo (μC/g) | −37.0 | | −36.2 | | −35.2 | | −34.6 | | −36.7 | | −37.0 | |
| | | | NN fogging density | 0.8 | A | 1.3 | B | 0.9 | A | 1.3 | B | 0.7 | A | 1.6 | C |
| | | | | 1.42 | B | 1.38 | C | 1.38 | C | 1.36 | C | 1.41 | B | 1.37 | C |
| | | after 1,000 print | NN fogging density | 1.0 | B | 1.6 | C | 1.1 | B | 1.5 | C | 1.1 | B | 1.9 | C |
| | | | | 1.36 | C | 1.30 | C | 1.34 | C | 1.32 | C | 1.38 | C | 1.33 | C |
| | | durability test | member contamination | A | | A | | A | | A | | A | | A | |
| | LL | initial | tribo (μC/g) | −46.4 | | −46.3 | | −37.9 | | −38.6 | | −37.7 | | −40.2 | |
| | | | LL fogging density | 1.1 | B | 1.5 | C | 1.1 | B | 1.7 | C | 0.8 | A | 1.8 | C |
| | | | | 1.38 | C | 1.36 | C | 1.32 | C | 1.32 | C | 1.38 | C | 1.36 | C |
| | | after 1,000 print | LL fogging density | 1.3 | B | 1.6 | C | 1.3 | B | 1.9 | C | 1.0 | B | 1.5 | C |
| | | | | 1.36 | C | 1.28 | D | 1.28 | D | 1.30 | C | 1.34 | C | 1.33 | C |
| | | durability test | member contamination | B | | B | | B | | B | | B | | B | |
| | HH | initial | tribo (μC/g) | −24.4 | | −27.4 | | −29.2 | | −27.1 | | −32.2 | | −27.9 | |
| | | | HH fogging density | 1.5 | C | 2.0 | D | 1.8 | C | 1.9 | C | 0.9 | A | 2.2 | D |
| | | | | 1.28 | D | 1.34 | C | 1.30 | C | 1.30 | C | 1.36 | C | 1.22 | E |
| | | after 1,000 print | HH fogging density | 1.7 | C | 2.3 | D | 2.0 | D | 2.1 | D | 1.1 | B | 2.5 | E |
| | | | | 1.22 | E | 1.29 | D | 1.26 | D | 1.27 | D | 1.32 | C | 1.20 | E |
| | | durability test | member contamination | B | | B | | B | | B | | B | | C | |
| | SHH after standing for 168 hours in a severe environment | initial | tribo (μC/g) | −16.2 | | −17.2 | | −16.1 | | −15.1 | | −17.1 | | −11.0 | |
| | | | SHH fogging density | 2.8 | E | 2.6 | E | 3.2 | F | 2.5 | E | 2.1 | D | 2.6 | E |
| | | | | 1.25 | D | 1.23 | E | 1.27 | D | 1.22 | E | 1.30 | C | 1.20 | E |
| | | after 1,000 print | SHH fogging density | 3.4 | F | 2.9 | E | 3.6 | F | 2.6 | E | 2.4 | D | 2.9 | E |
| | | | | 1.18 | F | 1.20 | E | 1.23 | E | 1.20 | E | 1.26 | D | 1.15 | F |
| | | durability test | member contamination | D | | D | | D | | D | | D | | E | |
| cold offset end temperature (° C.) | | | | 105 | | 105 | | 115 | | 115 | | 115 | | 115 | |

| | | | | comparative example No. | | | | | | | | | | | |
|---|---|---|---|---|---|---|---|---|---|---|---|---|---|---|---|
| | | | | 7 | | 8 | | 9 | | 10 | | 11 | | | |
| comparative toner No. | | | | 7 | | 8 | | 9 | | 10 | | 11 | | | |
| heat resistance | storability (50° C./15 days) | | | B | | C | | C | | F | | B | | | |
| | long-term storability (45° C./95% 3 months) | | | D | | E | | C | | F | | E | | | |
| environmental stability | NN | initial | tribo (μC/g) | −36.8 | | −33.4 | | −8.2 | | −24.6 | | −37.8 | | | |
| | | | NN fogging density | 0.9 | A | 0.9 | A | 7.8 | F | 4.7 | F | 0.6 | A | | |
| | | | | 1.48 | A | 1.48 | A | 0.80 | F | 0.70 | F | 1.38 | C | | |
| | | after 1,000 print | NN fogging density | 1.2 | B | 1.4 | B | 8.2 | F | 5.4 | F | 0.6 | A | | |
| | | | | 1.44 | B | 1.44 | B | 0.70 | F | 0.61 | F | 1.32 | C | | |
| | | durability test | member contamination | A | | A | | C | | F | | A | | | |
| | LL | initial | tribo (μC/g) | −42.6 | | −39.4 | | −10.3 | | −32.1 | | −43.2 | | | |
| | | | LL fogging density | 1.3 | B | 1.5 | C | 7.9 | F | 5.1 | F | 0.8 | A | | |
| | | | | 1.36 | C | 1.32 | C | 0.78 | F | 0.82 | F | 1.36 | C | | |
| | | after 1,000 print | LL fogging density | 1.6 | C | 1.8 | C | 8.2 | F | 6.4 | F | 0.8 | A | | |
| | | | | 1.32 | C | 1.28 | D | 0.71 | F | 0.56 | F | 1.30 | C | | |
| | | durability test | member contamination | B | | B | | C | | F | | B | | | |
| | HH | initial | tribo (μC/g) | −29.8 | | −27.4 | | −5.9 | | −22.5 | | −25.4 | | | |
| | | | HH fogging density | 1.5 | C | 1.8 | C | 8.1 | F | 5.8 | F | 0.9 | A | | |
| | | | | 1.28 | D | 1.28 | D | 0.82 | F | 0.82 | F | 1.28 | D | | |
| | | after 1,000 print | HH fogging density | 1.8 | C | 2.2 | D | 8.5 | F | 6.4 | F | 0.9 | A | | |
| | | | | 1.22 | E | 1.23 | E | 0.67 | F | 0.50 | F | 1.26 | D | | |
| | | durability test | member contamination | A | | B | | C | | F | | B | | | |

TABLE 16-continued

| | | | | | | | | | | | | |
|---|---|---|---|---|---|---|---|---|---|---|---|---|
| SHH after standing for 168 hours in a severe environment | initial | tribo (μC/g) | −17.4 | | −13.9 | | −4.2 | | −12.5 | | −16.2 | |
| | | SHH fogging | 2.9 | E | 2.4 | D | 9.5 | F | 5.8 | F | 1.8 | C |
| | | density | 1.26 | D | 1.24 | E | 0.54 | F | 0.45 | F | 1.22 | E |
| | after 1,000 print durability test | SHH fogging | 3.5 | F | 2.8 | E | 10.6 | F | 9.2 | F | 1.9 | C |
| | | density | 1.19 | F | 1.19 | F | 0.50 | F | 0.26 | F | 1.15 | F |
| | | member contamination | D | | D | | F | | F | | D | |
| cold offset end temperature (° C.) | | | 105 | | 105 | | 105 | | 105 | | 105 | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-212262, filed Oct. 9, 2013 and No. 2014-127242, filed Jun. 20, 2014, which are hereby incorporated by reference herein in their entirety.

What is claimed is:

1. A toner comprising toner particles, each of which has a surface layer that contains an organosilicon polymer, the organosilicon polymer having a substructure represented by formula (T3)

$$R—Si(O_{1/2})_3 \quad (T3)$$

where R represents an alkyl group having 1 to 6 carbons or a phenyl group, wherein a ratio ST3 of the peak area for the substructure represented by formula (T3) to the total peak area for the organosilicon polymer in a $^{29}$Si-NMR measurement of a tetrahydrofuran-insoluble matter in the toner particles satisfies the relationship ST3≥0.40, and a silicon atom concentration dSi with reference to a total concentration (dC+dO+dSi) of the silicon atom concentration dSi, an oxygen atom concentration dO, and a carbon atom concentration dC in electron spectroscopy for chemical analysis of a surface of the toner particles is 2.5 atom % or more.

2. The toner according to claim 1, wherein ST3/SX2≥1.00 when SX2 is a ratio of the peak area for the structure in which the number of silicon-bonded $O_{1/2}$ is 2.0 to the total peak area for the organosilicon polymer in a $^{29}$Si-NMR measurement of the tetrahydrofuran-insoluble matter in the toner particles.

3. The toner according to claim 1, wherein the organosilicon polymer is obtained by polymerization of an organosilicon compound having a structure represented by formula (Z)

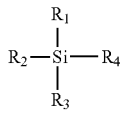

(Z)

where $R_1$ represents an alkyl group having 1 to 6 carbons or a phenyl group, and $R_2$, $R_3$, and $R_4$ each independently represent a halogen atom, hydroxy group, acetoxy group, or alkoxy group.

4. The toner according to claim 3, wherein $R_1$ is a methyl group, ethyl group, propyl group, or phenyl group.

5. The toner according to claim 3, wherein $R_1$ is an alkyl group having 1 to 3 carbons.

6. The toner according to claim 5, wherein the alkyl group is a methyl group, ethyl group, or propyl group.

7. The toner according to claim 3, wherein $R_2$, $R_3$, and $R_4$ are each independently an alkoxy group.

8. The toner according to claim 1, wherein the silicon atom concentration dSi with reference to the total concentration (dC+dO+dSi) is 5.0 atomic % or more.

9. The toner according to claim 1, wherein the silicon atom concentration dSi with reference to the total concentration (dC+dO+dSi) is 10.0 atomic % or more.

10. The toner according to claim 3, wherein $R_1$ is a methyl group.

* * * * *